US006541174B1

(12) United States Patent
Tanikawa et al.

(10) Patent No.: US 6,541,174 B1
(45) Date of Patent: Apr. 1, 2003

(54) METHOD USING TONER AND DEVELOPER FOR DEVELOPING ELECTROSTATIC IMAGE

(75) Inventors: Hirohide Tanikawa, Yokohama (JP); Toshiaki Nakahara, Tokyo (JP); Keita Nozawa, Yokohama (JP); Kazuyoshi Hagiwara, Tokyo (JP); Minoru Shimojo, Kawasaki (JP); Rika Shinba, Kawasaki (JP); Masami Fujimoto, Kawasaki (JP); Tsutomu Onuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,873

(22) Filed: Sep. 1, 2000

Related U.S. Application Data

(62) Division of application No. 08/821,071, filed on Mar. 20, 1997, now Pat. No. 6,187,496, which is a division of application No. 08/350,109, filed on Nov. 29, 1994, now abandoned.

(30) Foreign Application Priority Data

| | | |
|---|---|---|
| Dec. 27, 1993 | (JP) | 5-346992 |
| Nov. 30, 1993 | (JP) | 5-323424 |
| May 31, 1994 | (JP) | 6-118550 |
| Apr. 27, 1994 | (JP) | 6-089949 |

(51) Int. Cl.[7] ..... G03G 13/22

(52) U.S. Cl. ..... 430/126; 430/120; 430/125; 430/902

(58) Field of Search ..... 430/106, 106.6, 430/109, 110, 111, 120, 125, 126, 902, 106.1, 106.2, 108.1, 108.11, 108.3, 108.24, 108.6, 108.7, 108.8, 109.3, 109.4, 111.4, 111.41

(56) References Cited

U.S. PATENT DOCUMENTS

| | | | | |
|---|---|---|---|---|
| 2,297,691 | A | 10/1942 | Carlson | 430/55 |
| 3,666,363 | A | 5/1972 | Tanaka et al. | 430/55 |
| 4,071,361 | A | 1/1978 | Marushima | 430/54 |

(List continued on next page.)

FOREIGN PATENT DOCUMENTS

| | | |
|---|---|---|
| DE | 4130192 | 3/1992 |
| EP | 0392450 | 10/1990 |
| EP | 0410482 | 1/1991 |

(List continued on next page.)

OTHER PUBLICATIONS

Patent & Trademark Office English Language Translation of Japanese Patent 2–217866.

Bulletin entitled: "Reactive and Non–Reactive Modified Silicone Fluids", by Shin–Etsu Chemical Co., Ltd, Japan 1991, pp. 1–9.

*Primary Examiner*—Janis L. Dote

(74) *Attorney, Agent, or Firm*—Fitzpatrick, Cella, Harper & Scinto

(57) ABSTRACT

A toner for developing an electrostatic image is formed of toner particles; wherein each toner particle includes (i) 100 wt. parts of a binder resin having a glass transition point (Tg) of 50–70° C., (ii) 0.2–20 wt. parts of solid wax, and (iii) colorant particles or magnetic powder; (iv) lubricant particles carrying a liquid lubricant, so that the toner particle retains at its surface the liquid lubricant gradually released from the particles (iv). The toner may be further blended with an organically treated inorganic fine powder to provide a developer. The toner or developer retains good lubricity and releasability so that it is suitable to be used in an image forming method including means contacting a latent image-bearing means, such as a contact charging means, a contact transfer means or a contact cleaning means.

127 Claims, 8 Drawing Sheets

U.S. PATENT DOCUMENTS

| | | | | |
|---|---|---|---|---|
| 4,568,625 | A | 2/1986 | Uchiyama et al. | 430/110 |
| 4,810,610 | A | 3/1989 | Grushkin et al. | 430/106.6 |
| 5,213,933 | A | 5/1993 | Osaki et al. | 430/106.6 |
| 5,278,018 | A | 1/1994 | Young et al. | 430/110 |
| 5,354,637 | A | 10/1994 | Shimamura et al. | 430/106.6 |
| 5,364,722 | A | 11/1994 | Tanikawa et al. | 430/110 |
| 5,406,357 | A | 4/1995 | Nakahara et al. | 430/110 |
| 5,437,954 | A | 8/1995 | Saito | 430/110 |

FOREIGN PATENT DOCUMENTS

| | | | |
|---|---|---|---|
| JP | 44-30270 | 12/1969 | |
| JP | 48-24904 | 7/1973 | |
| JP | 48-47345 | 7/1973 | |
| JP | 49-42354 | 4/1974 | |
| JP | 52-30855 | 8/1977 | |
| JP | 54-48245 | 4/1979 | |
| JP | 57-11354 | 1/1982 | |
| JP | 57-13868 | 3/1982 | |
| JP | 58-80650 | 5/1983 | |
| JP | 58-27503 | 6/1983 | |
| JP | 59-197048 | 11/1984 | |
| JP | 59-200251 | 11/1984 | |
| JP | 61-279865 | 12/1986 | |
| JP | 63-30850 | 2/1988 | |
| JP | 63-149669 | 6/1988 | |
| JP | 63-192055 | 8/1988 | |
| JP | 2-3073 | 1/1990 | |
| JP | 2-123385 | 5/1990 | |
| JP | 2-217866 | 8/1990 | 430/110 |
| JP | 2-287367 | 11/1990 | |
| JP | 3-43748 | 2/1991 | |
| JP | 3-53260 | 3/1991 | |
| JP | 3-63660 | 3/1991 | |
| JP | 4-274445 | 9/1992 | |

METHOD USING TONER AND DEVELOPER FOR DEVELOPING ELECTROSTATIC IMAGE

CROSS-REFERENCE TO RELATED APPLICATIONS

This application is a division of application Ser. No. 08/821,071, filed Mar. 20, 1997, now U.S. Pat. No. 6,187,496, which in turn, is a division of application Ser. No. 08/350,109, filed Nov. 29, 1994, now abandoned.

FIELD OF THE INVENTION AND RELATED ART

The present invention relates to a toner and a developer for developing electrostatic images used in image forming methods, such as electrophotography, electrostatic recording and magnetic recording, a process for production thereof, and an image forming method.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by heating, pressing, or heating and pressing, or with solvent vapor to obtain a copy. The residual toner on the photosensitive member without being transferred is cleaned as desired by various methods, and then the above steps are repeated.

Accordingly, it has been required to provide a toner excellent in releasability, lubricity, and transferability. For this reason, toners containing a silicone compound have been disclosed in Japanese Patent Publication (JP-B) 57-13868, Japanese Laid-Open Patent Application (JP-A) 54-48245, JP-A 59-197048, JP-A 2-3073, JP-A 3-63660, U.S. Pat. No. 4,517,272, etc. However, in such a toner containing a silicone compound directly added thereto, a silicone compound lacking mutual solubility with the binder resin shows a poor dispersibility and cannot be uniformly contained in individual toner particles, thus being liable to result in a fluctuation in chargeability of toner particles and a toner showing an inferior developing performance in a continuous use.

A corona discharger has been generally widely used in a printer or a copying machine utilizing electrophotography, as a means for uniformly charging the surface of a photosensitive member (electrostatic image-bearing member) or a means for transferring a toner image on a photosensitive member. On the other hand, a contact charging or transferring method of causing a contact charging member to contact or be pressed against a photosensitive member surface while externally applying a voltage has been developed and commercialized.

Such a contact charging method or a contact transfer method has been proposed in, e.g., JP-A 63-149669 and JP-A 2-123385. In such a method, an electroconductive elastic roller is abutted against an electrostatic image-bearing member and is supplied with a voltage to uniformly charge the electrostatic image-bearing member, which is then subjected to an exposure and a developing step to have a toner image thereon. Further, another electroconductive elastic roller supplied with a voltage is pressed against the electrostatic image-bearing member and a transfer material is passed therebetween to transfer the toner image on the electrostatic image-bearing member onto the transfer material, followed by a fixing step to obtain a copied image.

Accordingly, a greater importance is attached to the releasability, lubricity and transferability of a toner, and a uniformity among the toner particles is required also for this purpose. In order to solve the problem, a toner obtained through polymerization has been proposed in JP-A 57-11354, JP-A 63-192055, etc., but the toner is liable to cause an excessive slippage and by-passing of toner particles at the cleaning section. A similar problem is liable to be caused in capsule toners containing a silicone compound which have been also proposed in a large number.

Compared with a conventionally widely used transfer means utilizing a corona discharge, a contact transfer means can enlarge the area of attachment of a transfer material onto a latent image-bearing member by controlling the force of pressing the transfer roller against the latent image-bearing member. Further, the transfer material is positively pressed and supported against the transfer position, it is possible to minimize a synchronization failure by the transfer material-conveying means and the transfer deviation due to looping or curling of the transfer material. Further, it also becomes easy to comply with the requirement of a shorter transfer material conveying path and a smaller diameter of latent image-bearing member accompanying the size reduction of image forming apparatus.

On the other hand, in such an apparatus of performing a transfer by abutting, a certain pressure is necessarily applied to the transfer apparatus because a transfer current is supplied from the abutting position. When such an abutting pressure is applied, a pressure is also applied to the toner image on the latent image bearing member, thus being liable to cause agglomeration of the toner.

Further, in case where the latent image-bearing surface is composed of a resin, an attachment is liable to be caused between a toner agglomerate and the latent image-bearing member to hinder the transfer to the transfer material and, in an extreme case, a part of a toner image showing a strong attachment is liable to cause a transfer failure to result in a lack of toner image.

The above phenomenon is pronounced in development of line images of 0.1–2 mm. This is because edge development is predominant at line images to provide a large coverage with toner, which is thus liable to cause agglomeration under pressure and transfer failure resulting in a lack. A toner image formed in such instance provides a copied image having only a contour. This defective phenomenon is called "transfer dropout (resulting in a hollow image)".

Such a transfer dropout noticeably occurs on a thick paper of 100 g/cm$^2$ or large, an OHP film having a high degree of smoothness and on a second face during a both face copying. In the case of a thick paper and an OHP film, such a transfer dropout might be frequently caused because of a shortage of transfer electric field and a strong pressure because of a thick transfer material.

The transfer dropout might be frequently caused on a second face in the both face copying because the second face is also passed through a fixing device in the first face-copying so that the adhesion of a toner onto the second face is hindered.

For the above reasons, a transfer apparatus imposes serious requirements on a transfer material while it provides many advantages, such as size reduction and economization of electric power consumption.

On the other hand, a method of improving the dispersibility of a silicone compound by causing inorganic fine powder to adsorb the silicone compound and adding the inorganic fine powder into toner particles has been disclosed in JP-A 49-42354, JP-B 58-27503 and JP-A 2-3073. However, a toner and developer having further improved releasability and transferability are desired.

Addition of particles treated with a silicone compound into toner particles has been disclosed in JP-A 59-200251, JP-A 58-80650, JP-A 61-279865, JP-A 1-100561, JP-A 1-105958, JP-A 2-126265, JP-A 2-287367, JP-A 3-43748, JP-A 4-274445, and JP-A 3-53260. In these references, the silicone compound is caused to adhere onto the particle surfaces for hydrophobization, increased dispersibility of particles and increased charge, so that the silicone compound does not move to the toner particle surfaces. Accordingly, a toner and a developer having further improved releasability, lubricity and transferability are still desired.

Developers including toner particles to the surface of which silicone oil, etc., has been attached, have been disclosed in JP-B 44-32470, JP-B48-24904 and JP-B 52-30855. These developers are accompanied with difficulties such that a small amount of silicone oil, etc., fails to uniformly attach to and cover the toner particles or is liable to be transferred from the toner particles to another member to be lost from the toner particle surfaces. As a result, the effect thereof cannot last for a long period or becomes ununiform, thus resulting in a charging irregularity and an adverse effect to the developing performance. Further, it is difficult to attach the silicone oil, etc. to form and retain a thin and uniform layer of the silicone oil on the toner particle surfaces, so that the effect thereof does not last for a long period but result in a poor developing performance.

Further, in the case of using a developer comprising a mixture of toner particles comprising a binder resin and a colorant, such as a magnetic material, and a flowability improver, such as silica, in an image forming apparatus including a contact charging means and a contact transfer means, there is liable to cause difficulties such that a slight amount of residual toner on the photosensitive member not removed in the cleaning step after the transfer step sticks to the charging roller and the transfer roller pressed against the photosensitive member, and the sticking and amount of such toner are enhanced or increased on an increased number of copying operations to result in a toner melt-sticking and cause charging failure, cleaning failure or transfer failure. As a result, the resultant images are liable to be accompanied with difficulties, such as a decrease and irregularity of image density, white spots in a solid black image, and black spots in a solid white image.

In order to remove a residual toner on a photosensitive member after a transfer step, various means, such as those according to the blade scheme, fur brush scheme and magnetic brush scheme, have been known, but it is difficult to completely remove the residual toner on the photosensitive member after the transfer step.

In order to obviate such a toner sticking onto a photosensitive member, it has been proposed to add both a friction-reducing substance and an abrasive substance to a toner in JP-A 48-47345. However, the friction-reducing substance is liable to form an adhering filmy substance so that the toner is liable to form a film of the friction-reducing substance on a charging roller and a transfer roller to cause charging failure and transfer failure, when used in an image forming apparatus equipped with contact charging means and contact transfer means.

In a medium-speed copying machine, an organic photosensitive member (organic photoconductor) is generally used for the purpose of size-reduction and cost-reduction. In order to reduce the friction of the surface layer of particularly an organic photosensitive member to prevent the deterioration of a charging characteristic, it has been proposed to use an organic photosensitive member containing in its surface layer a lubricant, such as a fluorine-containing resin fine powder, in JP-A 63-30850. Such an organic photosensitive member containing the lubricant is actually provided with a prolonged life, but is caused to have a lower surface smoothness of the photosensitive member because the lubricant shows a poor dispersibility in a binder resin, such as polycarbonate resin, constituting the surface layer. As a result, if the photosensitive member is incorporated in an image forming apparatus including a contact charging means and a contact transfer means, the toner after development is liable to enter the surface concavity, and the performance of cleaning the residual toner is liable to be lowered to result in a toner sticking on the charging roller, the transfer roller and the photosensitive member.

SUMMARY OF THE INVENTION

An object of the present invention is to provide a toner and a developer for developing electrostatic images, a process for production thereof and an image forming method having solved the above-mentioned problems.

A more specific object of the present invention is to provide a toner and a developer for developing electrostatic images excellent in continual releasability, lubricity and transferability and free from deterioration with time and continuous image formation, a process for production thereof and an image forming method.

Another object of the present invention is to provide a toner and a developer for developing electrostatic images excellent in releasability, lubricity and transferability, and also in developing performance and durability, a process for production thereof and an image forming method.

Another object of the present invention is to provide an image forming method wherein a latent image-bearing member is used together with a member pressed thereagainst while suppressing the occurrence of damages, toner sticking and filming.

Another object of the present invention is to provide a toner and a developer for developing electrostatic images free from soiling a member to be pressed against a latent image-bearing member, thus being free from charging abnormality or transfer failure leading to image defects, a process for production thereof and an image forming method.

Another object of the present invention is to provide a toner and a developer for developing electrostatic images excellent in cleanability and not causing by-passing of a cleaner or cleaning failure, a process for production thereof and an image forming method.

Another object of the present invention is to provide a toner and a developer for developing electrostatic images free from or capable of suppressing transfer dropout even on a diversity of transfer materials, a process for production thereof, and an image forming method.

A further object of the present invention is to provide a toner and a developer for developing electrostatic images capable of providing high-quality transfer images and fixed images faithful to a latent image, a process for production thereof and an image forming method.

A still further object of the present invention is to provide a toner and a developer for developing electrostatic images showing an improved cleanability even when attached onto a contact charging member and a contact transfer means, a process for production thereof and a image forming method.

According to the present invention, there is provided a toner for developing an electrostatic image, comprising toner particles; wherein each toner article comprises:

(i) 100 wt. parts of a binder resin having a glass transition point (Tg) of 50–70° C., (ii) 0.2–20 wt. parts of solid wax, and (iii) colorant particles carrying a liquid lubricant, magnetic powder carrying a liquid lubricant, or a mixture thereof;

the toner particle retaining the liquid lubricant at its surface.

According to another aspect of the present invention, there is provided a developer for developing an electrostatic image, comprising toner particles and an external additive; wherein each toner particle comprises:

(i) 100 wt. parts of a binder resin having a glass transition point (Tg) of 50–70° C., (ii) 0.2–20 wt. parts of solid wax, and (iii) particles carrying a liquid lubricant;

the toner particle retaining the liquid lubricant at its surface;

said external additive comprising inorganic fine powder treated with an organic agent.

According to a further aspect of the present invention, there is provided a process for producing a developer, comprising:

blending a binder resin, a solid wax and particles carrying a liquid lubricant to obtain a blend, melt-kneading the blend to obtain a melt-kneaded product, cooling the melt-kneaded product, pulverizing the resultant cooled melt-kneaded product to obtain a pulverized product, classifying the pulverized product to form toner particles, and blending the toner particles with inorganic fine powder treated with an organic agent.

According to a still further aspect of the present invention, there is provided an image forming method, comprising:

charging an electrostatic image-bearing member by a charging means;

exposing to light the charged electrostatic image-bearing to form an electrostatic image thereon;

developing the electrostatic image with a developer to form a toner image on the electrostatic image-bearing member, said developer comprising a mixture of toner particles and inorganic fine powder treated with an organic agent; and transferring the toner image on the electrostatic image-bearing member to an intermediate transfer member or a transfer material;

wherein each of said toner particles comprises:

(i) 100 wt. parts of a binder resin having a glass transition point (Tg) of 50–70° C., (ii) 0.2–20 wt. parts of solid wax, and (iii) colorant particles carrying a liquid lubricant, magnetic powder carrying a liquid lubricant, or a mixture thereof, the toner particle retaining the liquid lubricant at its surface; and at least one of said charging means transfer means is contactable with said electrostatic image-bearing member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
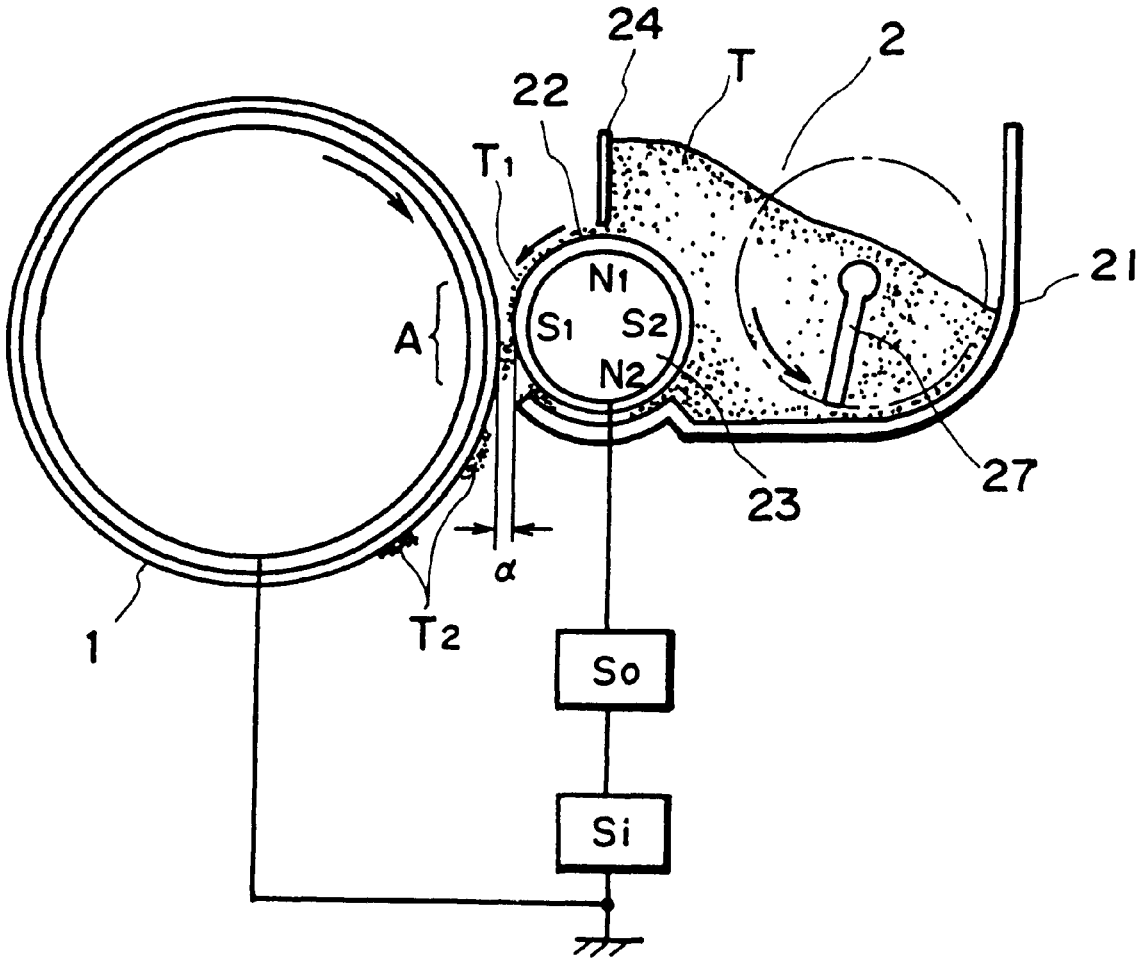
FIG. 1 is an illustration of an image forming apparatus including a developing apparatus usable in the image forming method according to the present invention.
Figure 2:
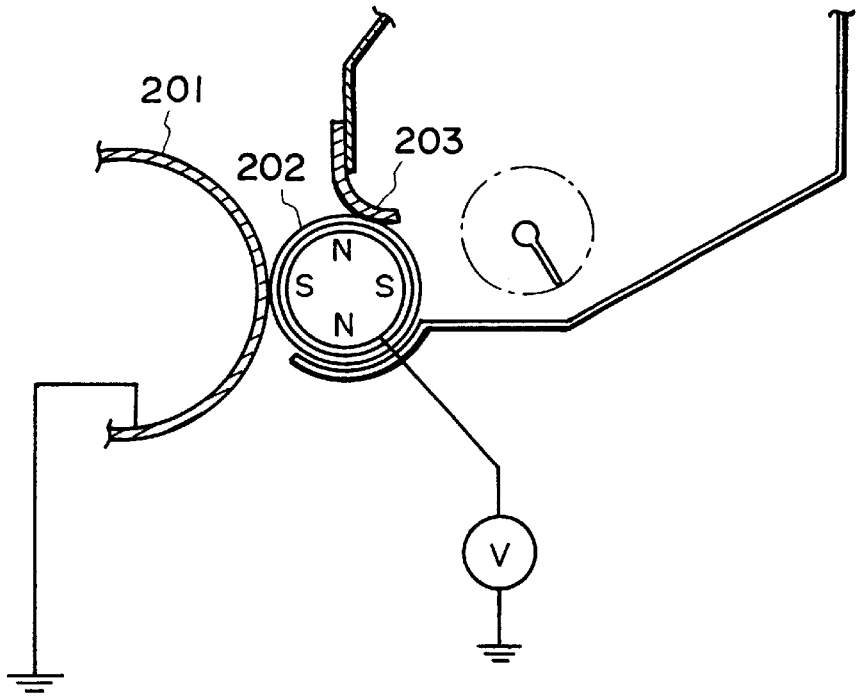
FIGS. 2–5 are respectively an illustration of a developing apparatus including an elastic blade usable in the image forming method of the present invention.
Figure 3:
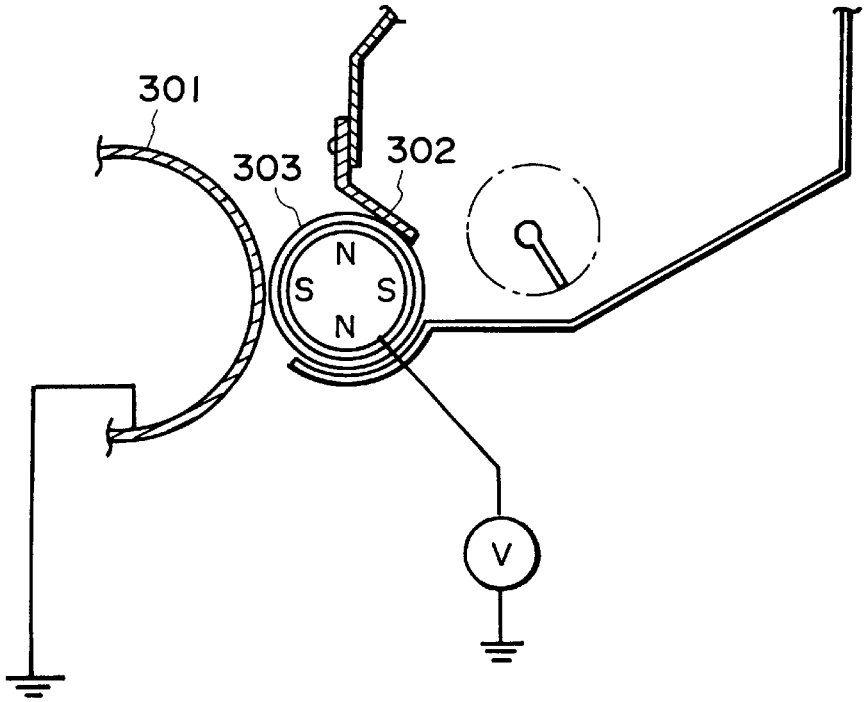
Figure 4:
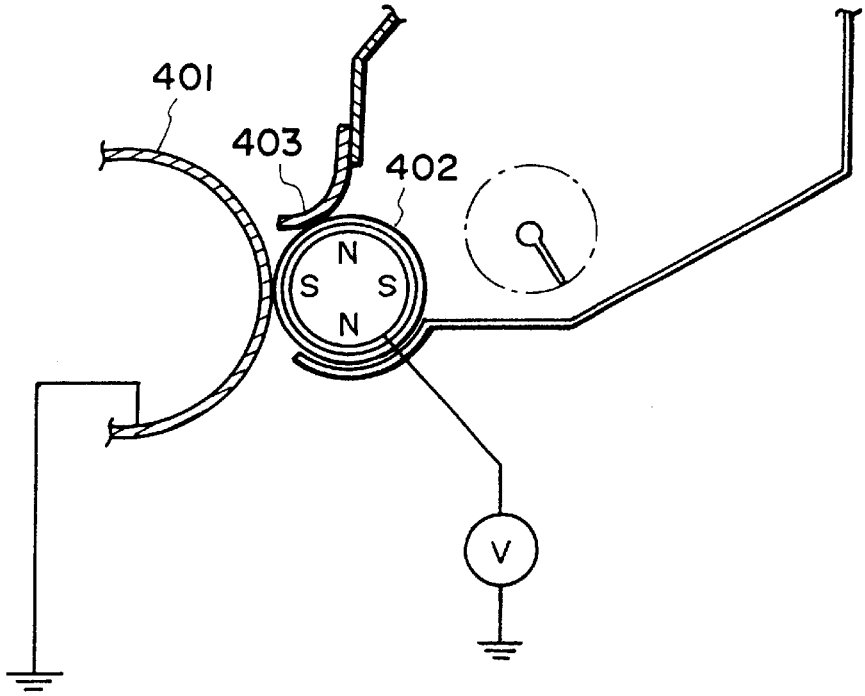
Figure 5:
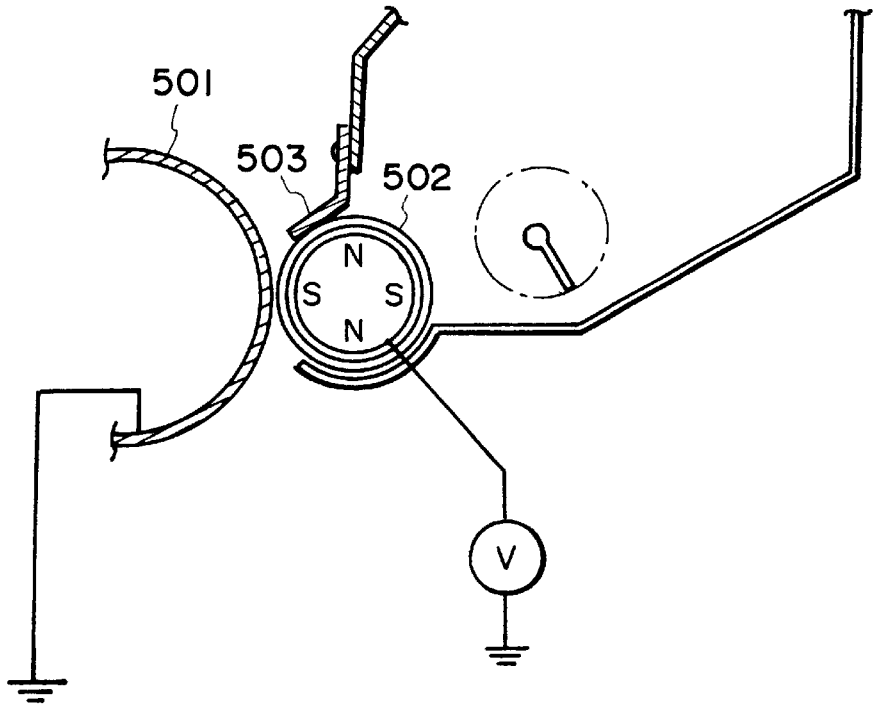

A preferred form of the developer according to the present invention includes toner particles comprising 100 wt. parts of a binder resin having a glass transition point (Tg) of 50–70° C., 0.2–20 wt. parts of a solid wax, and 0.1–20 wt. parts of a colorant carrying a liquid lubricant, 10–200 wt. parts of magnetic powder carrying a liquid lubricant or a mixture thereof, wherein the toner particle has a liquid lubricant at its surface.

Another preferred form of the developer includes toner particles comprising 100 wt. parts of a binder resin having a glass transition point (Tg) of 50–70° C., 0.2–20 wt. parts of a solid wax having an onset temperature of at least 50° C. on its DSC curve, and 0.1–20 wt. parts of a colorant, 10–200 wt. parts of magnetic powder or a mixture thereof, and further 0.1–20 wt. parts of lubricating particles comprising 10–90 wt. % of a liquid lubricant, wherein the toner particle has a liquid lubricant at its surface. The developer further includes, as an external additive, inorganic fine powder treated with an organic processing agent.

Another preferred form of the developer according to the present invention includes toner particles comprising 100 wt. parts of a binder resin having a glass transition point (Tg) of 50–70° C., 0.2–20 wt. parts of a solid wax, and 0.1–20 wt. parts of a colorant carrying a liquid lubricant, 10–200 wt. parts of magnetic powder carrying a liquid lubricant or a mixture thereof, wherein the toner particle has a liquid lubricant at its surface. The developer further includes, as an external additive, inorganic fine powder treated with a nitrogen-containing silane compound and silicone oil.

In the present invention, a liquid lubricant is carried on a colorant, magnetic powder or lubricating particles to be added into toner particles so that the liquid lubricant is present uniformly and in an appropriate amount on the toner particle surfaces. As a result, the toner particles may be provided with releasability, lubricity and an appropriate degree of electrostatic agglomeration. Further, as a solid wax is dispersed in the toner particles, the toner particles are provided with an increased slippability. Further, by externally adding organically treated inorganic fine powder, the flowability and the releasability are enhanced.

The lubricating particles may be preferred by subjecting a liquid lubricant to carrying, adsorption, particle formation, agglomeration, impregnation and encapsulation or internal inclusion.

Examples of the liquid lubricant imparting releasability and lubricity to the toner according to the present invention may include: animal oil, vegetable oil, petroleum-type lubricating oil, and synthetic lubricating oil. Synthetic lubricating oil may be preferably used because of its stability.

Examples of the synthetic lubricating oil may include: liquid silicones, such as dimethylsilicone oil, methylphenylsilicone oil, and various modified silicone oils; liquid polyol esters, such as pentaerythritol ester, and trimethylolpropane ester; liquid polyolefins, such as polyethylene, polypropylene, polybutene, and poly(α-olefins); liquid polyglycol, such as polyethylene glycol, and polypropylene glycol; liquid silicate esters, such as tetradecyl silicate, and tetraoctyl silicate; liquid diesters, such as di-2-ethylhexyl sebacate, and di-2-ethylhexyl adipate; liquid phosphate esters, such as tricresyl phosphate, and propylphenyl phosphate; liquid fluorinated hydrocarbons, such as polychlorotrifluoroethylene, polytetrafluoroethylene, polyvinylidene fluoride, and polyethylene fluoride; liquid polyphenyl ethers, liquid alkylnaphthenes, liquid alkyl aromatics. Among these, liquid silicones and liquid fluorinated hydrocarbons are preferred because of thermal stability and oxidation stability.

Examples of the liquid silicones may include: amino-modified silicone, epoxy-modified silicone, carbonyl-modified silicone, carbinol-modified silicone, methacryl-modified silicone, mercepto-modified silicone, phenol-modified silicone and different functional group-modified silicone; non-reactive silicones, such as polyether-modified silicone, methylstyryl-modified silicone, alkyl-modified silicone, aliphatic acid-modified silicone, alkoxy-modified silicone, and fluorine-modified silicone; and straight silicones, such as dimethylsilicone, methylphenylsilicone and methylhydrogen silicone.

In the present invention, the liquid lubricant on the surface of the colorant or magnetic powder is partially isolated to be present at the toner particle surface to exhibit its effect. Accordingly, curable silicone exhibits rather poor performance. Reactive silicone and silicone oil having a polar group can show an intense adsorption onto the colorant or magnetic powder as the carrier or a mutual solubility with the binder resin, so that they are liable to show an inferior effect depending on the degree of mutual solubility because of little isolation or liberation. A certain non-reactive silicone can show an inferior effect depending on the kind of a side chain providing a mutual solubility with the binder resin of the toner to decrease the migration to the toner particle surface.

For these reasons, dimethylsilicone, fluorine-modified silicone and fluorinated hydrocarbon may preferably be used because of little reactivity or polarity, weak adsorption onto carrier particles and little mutual solubility with the binder resin.

The liquid lubricant used in the present invention may preferably show a viscosity of 10–200,000 cSt, further preferably 20–50,000 cSt, particularly 50–20,000 cSt at 25° C. Below 10 cSt, the liquid lubricant can plasticizes the toner in some cases because of much low molecular weight component, thus being liable to provide a poor anti-blocking property and worsening of developing performance with time. Above 100,000 cSt, the migration within toner particle can become ununiform, and the dispersion thereof on the colorant or magnetic powder becomes ununiform, so that individual toner particles can fail to have uniform releasability, lubricity or chargeability, thus resulting in inferior developing performance, transferability and anti-soiling characteristic during a continuous use.

The viscosity of the liquid lubricant may be measured, e.g., by VISCOTESTER VT500 (mfd. by Haake Corp.).

One of several viscosity sensors for VT500 may be arbitrarily selected, and a measurement sample is placed in the measurement cell for the sensor to effect measurement The viscosity (Pa·sec) displayed on the apparatus may be converted into cSt.

The toner particles according to the present invention may preferably be in a substantially indefinite shape. For example, if the toner particles are spherical or have a shape close thereto, the toner can show excessive lubricity and slippability, thereby causing a cleaning failure because of by-passing at the cleaner section. To the contrary, if the toner particles have an indefinite shape, they cause an appropriate degree of friction so that sufficient cleaning may be effected without impairing the releasability.

In the present invention, the liquid lubricant is carried on the colorant or magnetic powder to be dispersed in the toner particles. As the colorant or magnetic powder is uniformly dispersed in each toner particle, the liquid lubricant is accordingly uniformly dispersed in each toner particle.

For uniformly dispersing the liquid lubricant, such as silicone in toner particles, the dispersion becomes uniform if the liquid lubricant is carried on various carriers than by directly dispersing the liquid lubricant into toner particles.

In the present invention, not only the improvement in dispersibility of a liquid lubricant is intended. The liquid lubricant is further required to be liberated from the carrier particles to effectively exhibit its releasability and lubricating effect and also exhibit a certain degree of adsorption strength so as to prevent excessive liberation during the use of the toner and liberation during the production process.

For this purpose, colorant or magnetic powder is used as the carrier particles. The colorant may be dye, pigment or carbon black.

The carrier particles constituting lubricating particles together with the liquid lubricant may comprise fine powder of an inorganic compound or an organic compound. Examples of the organic compound may include: organic resin, such as styrene resin, acrylic resin, silicone resin, silicone rubber, polyester resin, urethane resin, polyamide resin, polyethylene resin and fluorine resin, and aliphatic compounds. These fine particles may be formed into particles or agglomerated together with the liquid lubricant.

By retaining the liquid lubricant at the surface of the carrier particles and causing the liquid lubricant to be present on or in the vicinity of the toner particle surfaces, the amount of the liquid lubricant at the surface of toner particles may be appropriately controlled.

The liquid lubricant is liberated or isolated from the carrier particles to migrate toward the toner particle surface. In this instance, if the liquid lubricant is strongly adsorbed, the liquid lubricant is little liberated to cause little migration toward the toner particle surface, thus failing to show a sufficient releasability and lubricity of the toner particles. On the other hand, the adsorption is too weak, the liquid lubricant excessively migrates to the toner particle surfaces, thus resulting in abnormal triboelectric chargeability to provide an excessive charge or insufficient charge causing a poor developing performance. Further, the toner particles are liable to show a poor flowability and result in an insufficient supply to the developing sleeve, leading to a density irregularity. If the liquid lubricant is liberated from the toner particle surfaces, the releasability and lubricity effect are lost.

In the present invention, the adsorption strength of the liquid lubricant onto the carrier particles is moderate, so that the liberation of the liquid lubricant from the carrier particles occurs but does not occur excessively. While the liquid lubricant is liberated from the toner particle surface, it is gradually replenished from the carrier particles, so that the releasability and lubricity of the toner particles are retained. The carrier particles are present also at and in the vicinity of the toner particle surface, so that the liquid lubricant migrated to the toner particle surface can be re-adsorbed by the carrier particles and excessive exudation thereof can be prevented, thus not affecting an adverse effect to the developing performance. Further, even if the liquid lubricant is lost from the toner particle surface by liberation, the migration thereof from the interior of the toner particle is caused quickly, whereby the releasability and lubricity are uniformly retained.

Accordingly, it is important that the carrier particles are present also at or in the vicinity of the toner particle surface, in order to retain an appropriate amount of the liquid lubricant at the toner particle surface. An excessive amount of liquid lubricant is adsorbed thereby and an amount of the liquid lubricant lost by liberation is quickly replenished. For example, it is preferred that the liquid lubricant is adsorbed to such an extent that, when the carrier particles are removed from a toner particle, it is possible to recognize the presence of the liquid lubricant on the surface of the removed carrier particles, or on the surface of the carrier particles at the surface of the toner particle.

As is understood from the above description, the toner according to present invention acquires its equilibrium and maximum releasability and lubricity with some time after its production. As a result, the effects are increased during a storage period after the production, but the effects are balanced with the adsorption by the carrier particles, so that the excessive presence of the liquid lubricant at the toner particle surface is prevented, and the storability and continuous image formation characteristic of the toner are not adversely affected.

On the other hand, if the toner is provided with a thermal history of 30–45° C., the equilibrium and maximum effects can be acquired in a shorter period to provide a developer showing a maximum performance stably. Even by such a thermal history application, an equilibrium state is attained without causing adverse effects. Such a thermal history can be imparted at any time after the formation of toner particles, and a pulverization toner may preferably be subjected to such a thermal history after the pulverization.

The liquid lubricant may preferably be carried by the colorant or magnetic powder in a proportion of 0.1–7 wt. parts per 100 wt. parts of the binder resin. It is further preferable to use the liquid lubricant in a proportion of 0.2–5 wt. parts, particularly preferably 0.3–3 wt. parts, still more preferably 0.3–2 wt. parts, per 100 wt. parts of the binder resin.

The magnetic powder may for example comprise: iron oxides, such as magnetite, hematite and ferrite; metals, such as iron, cobalt and nickel, and alloys of these metals with a metal, such as aluminum, cobalt, copper, lead, magnesium, tin, zinc, antimony, beryllium, bismuth, cadmium, calcium, manganese, selenium, titanium, tungsten, or vanadium; and mixtures of the above. It is preferable to use magnetic iron oxide particles containing a compound such as an oxide, a hydrated oxide or a hydroxide of a metal ion such as Si, Al or Mg, at the surface of or within the particles. It is particularly preferred to use silicon-containing magnetic iron oxide particles containing 0.1–3 wt. %, preferably 0.2–2 wt. %, particularly preferably 0.25–1.0 wt. %, of silicon based on the magnetic powder.

The silicon content in the magnetic iron oxide particles referred to herein are based on values measured by fluorescent X-ray analysis using a fluorescent X-ray analyzer ("SYSTEM 3080", mfd. by Rigaku Denki Kogyo K.K.) according to JIS K0119 "general rules on fluorescent X-ray analysis".

Silicon-containing magnetic iron oxide particles adsorbs a liquid lubricant but not strongly, so that they can retain excessive liquid lubricant at the surface without fully liberating the liquid lubricant during the production. On the other hand, the liquid lubricant is liberated moderately to be uniformly present at the surface of toner particles, thus showing effective releasability and lubricity for a long period without deterioration, and also excellent durability during continuous use.

If the liquid lubricant is fully liberated from the magnetic powder during the toner production, the uniform distribution of the liquid lubricant to individual toner particles is failed. If the magnetic powder does not have an adsorption retentivity, the liquid lubricant is caused to be present in a large amount at the toner particle surfaces to exert adverse effects to the developing performance and triboelectric chargeability, thus resulting in difficulties, such as low image density, fog and lowering in image density due to excessive charge, and a lower developing performance during a continuous use.

Silicon-containing magnetic iron oxide particles have a uniform particle size distribution, so that the surface area of magnetic powder contained in each toner particle becomes constant and the liquid lubricant is contained in a constant amount in each toner particle.

If the silicon content is below 0.1 wt. %, the effect of silicon addition is scarce and, above 3 wt. %, a lowering in developing performance (e.g., resulting in a lower image density) is liable to be caused in a high-humidity environment.

The magnetic powder may have a shape of a polyhedron, such as hexahedron, octahedron, decahedron, dodecahedron or tetradecahedron; shapes of needles, flakes and spheres, or an indefinite shape. Among these, the magnetic powder may preferably have a shape of a polyhedron, particularly hexahedron or octahedron.

The magnetic powder used in the present invention carries a liquid lubricant, so that it shows little mutual solubility with the binder resin but shows a releasability. As a result, the magnetic powder at the toner particle surface is liable to be liberated. However, polyhedral magnetic powder can physically prevent such liberation due to its shape.

On the other hand, a spherical magnetic powder can cause liberation in some cases. In such a case, the magnetic powder liberated little by little can be attached to a developing sleeve to cause a lowering in triboelectric charge-imparting ability, leading to a lower developing performance.

However, spherical magnetic iron oxide particles can have surface unevennesses or angles to be closer to an indefinite shape depending on the synthesis conditions, if they contain silicon element, thereby exhibiting a liberation-preventing effect. This effect begins to appear when the silicon content is 0.2 wt. % or more.

The magnetic powder may preferably have a BET specific surface area of 1–40 $m^2/g$, more preferably 2–30 $m^2/g$, further preferably 3–20 $m^2/g$.

The magnetic powder may preferably have a saturation magnetization of 5–200 emu/g, further preferably 10–150 emu/g under a magnetic field of 10 kilo-oersted.

The magnetic powder may preferably have a residual magnetization of 1–100 emu/g, more preferably 1–70 emu/g under a magnetic field of 10 kilo-oersted.

The magnetic powder may have an average particle size of 0.05–1.0 $\mu$m, further preferably 0.1–0.4 $\mu$m.

The magnetic powder may be contained in a proportion of 10–200 wt. parts, preferably 20–170 wt. parts, particularly preferably 30–150 wt. parts, per 100 wt. parts of the binder resin.

The shape of magnetic powder may be determined by observation through a transmission electron microscope or a scanning electron microscope.

The magnetic properties described herein are based on values measured by using a vibrating sample-type magnetometer ("VSM-3S-15", mfd. by Toei Kogyo K.K.) under an external magnetic field of 10 kilo-oersted.

The BET specific surface areas described herein are based on values measured according to the BET multi-point method by using a specific surface area meter ("AUTOSORB 1", mfd. by Yuasa Ionics K.K.) for causing nitrogen gas to be absorbed on the sample surface. This method may be also applied to inorganic fine powder.

As the colorant, known inorganic or organic dyes or pigments may be used. Carbon black and organic pigments are preferred because of their shape suitable for dispersion in toner particles, adsorption strength and dispersed particle size.

Examples thereof may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; C.I. Vat Red 1, 2, 10, 13, 15, 23, 29, 35; C.I. Pigment Blue 2, 3, 15, 16, 17; C.I. Vat Blue 6; C.I. Acid Blue 45; and copper phthalocyanine pigments represented by the following formula (1) and having a phthalocyanine skeleton and 1–5 phthalimidomethyl groups as substituents:

(1)

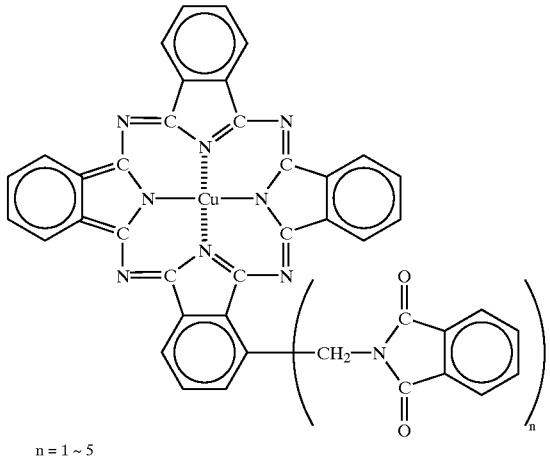

Other examples may include; C.I. Pigment Yellow 1, 2, 3, 4, 5, 6, 7, 10, 11, 12, 13, 14, 15, 16, 17, 23, 65, 73, 83: C.I. Vat Yellow 1, 3, 20.

These colorants may be used in an amount sufficient to provide a required optical density of a fixed image, preferably 0.1–20 wt. parts, more preferably 0.2–10 wt. parts, per 100 wt. parts of the binder resin.

In order to have the colorant or magnetic powder carry a liquid lubricant, the liquid lubricant as it is or in a form diluted with a solvent, etc., may be directly blended with the colorant or magnetic powder to be carried, or directly sprayed onto the colorant or magnetic powder.

However, these methods involve difficulties in the case of magnetic powder such that it is difficult to have the magnetic powder uniformly carry a small amount of liquid lubricant or a shear force or heat is locally applied to cause a strong adsorption of the liquid lubricant. In the case of a silicone lubricant, the lubricant is liable to cause a burning so that the liberation thereof from the carrier particles cannot be effectively performed or the toner particles cannot be provided with a sufficient releasability or lubricity in some cases.

In the present invention, it is preferred to use a kneader or blender capable of applying a compression and a shear, such as a wheel-type kneader because the following three functions are performed:

(1) Due to the compression action, the liquid lubricant present between the colorant particles or the magnetic particles are pressed against the particles surfaces and extended through a spacing between the particles to increase the adhesion with the particle surfaces.

(2) Due to the shearing action, the liquid lubricant is extended while disintegrating the particles.

(3) Due to pressure-smoothing action, the liquid lubricant on the particle surface is uniformly extended.

As a result of the repetition of the above three actions, the agglomerations of the colorant particles or magnetic powder particles are disintegrated, and the liquid lubricant is carried on the disintegrated individual particles. This type of kneader is particularly advantageous in the case of magnetic powder. In this instance, the liquid lubricant may be diluted with a solvent before being carried and dried thereafter.

A blade-type kneader such as a HENSCHEL mixer, ordinarily used for surface treatment of magnetic powder has only a stirring function, so that it can exhibit only a small degree of effect, if any, intended by the present invention, the effect does not last sufficiently, or the treatment becomes ununiform to give an adverse effect to the developing performance.

Preferred examples of the wheel-type kneader may include SHIMPSON MIX-MALLER, MULTIMAL, STOCK-MILL, a reverse flow blender, and IRICH-MILL.

In the treatment for carrying the liquid lubricant, if the treatment intensity is excessively strong or long to cause a temperature increase, the liquid lubricant is liable to strongly stick to or react with the carrier particles, thus preventing the liberation of the liquid lubricant to fail in exhibiting the effect. Accordingly, the treatment condition is also an important factor.

The colorant or magnetic powder is compressed during the above-carrying operation, it is preferred to disintegrate the treated particles by a hammer mill, a pin mill or a jet mill for the effective dispersion of the colorant or magnetic powder, particularly the magnetic powder, in the toner particles.

In the case of a colorant, a charge control agent can be simultaneously subjected to a carrying treatment. This also holds true with methods described hereinafter.

Further, in the case of a colorant, it is also possible to use a method wherein the colorant is blended while dropping a liquid lubricant or a dilution thereof by means of a kneader, followed optionally by pulverization. The solvent may be evaporated after the pulverization. In this instance, it is also possible to adopt a master batch method wherein the kneading is performed together with a small amount of resin. In this instance, it is possible to adopt a method wherein a colorant is absorbed in a liquid lubricant or a solution thereof with a solvent or a method wherein a liquid lubricant or a solution thereof is absorbed with a colorant. The solvent may be evaporated thereafter.

The magnetic powder already carrying a liquid lubricant may preferably have an oil absorption of at least 15 cc/100 g, more preferably at least 17 cc/100 g, further preferably 18.5–30 cc/100 g. Below 15 cc/100 g, the adsorption strength is too strong so that it becomes difficult to provide the toner particles with a releasability and a lubricity. Above 30 cc/100 g, the liquid lubricant is liable to be ununiformly carried so that the toner particles are liable to be ununiform and it becomes difficult to obtain a good effect for a long period.

The oil absorption of magnetic powder may be measured by placing a prescribed amount of sample on a glass plate and drip linseed oil thereon to measure the minimum amount of the dripped linseed oil when the sample magnetic powder becomes pasty.

The magnetic powder used in the present invention may preferably have a bulk density of at most 1.0 g/cm$^3$, more preferably at most 0.9 g/cm$^3$, further preferably at most 0.8 g/$^3$ cm If the bulk density of the magnetic powder is larger than 1.0 g/$^3$ cm, localization of the magnetic powder is liable to occur because of a difference in bulk density between the magnetic powder and the binder resin during blending of the binder resin powder and the magnetic powder before the melt kneading. If the localization of the magnetic powder occurs in the blending before the melt-kneading, the content of the magnetic material is fluctuated among the individual toner particles, whereby a fog is caused as an inferior developing performance.

The bulk density of the magnetic powder may be performed according to JIS-K 5101.

The lubricating particles comprise carrier particles which may be composed of an inorganic compound, examples of which may include: oxides, such as $SiO_2$, $GeO_2$, $TiO_2$, $SnO_2$, $Al_2O_3$, $B_2O_3$ and $P_2O_5$; silicates, borates, phosphates, germanates, borosilicates, aluminosilicates, aluminoborates, aluminoborosilicates, tungstenates, molybdenates and tellurates; complex compounds of the above; silicon carbide, silicon nitride, and amorphous carbon. These may be used singly or in mixture.

The inorganic compound may be obtained in the form of powder through the dry process or the wet process.

In the dry process, a halogenated compound is oxidated in a vapor phase to provide an inorganic compound. For example, a halogenated compound may be thermally decomposed in a gaseous atmosphere containing oxygen and hydrogen. The reaction may be represented by the following scheme:

$$MXn+1/2.nH_2+1/4.O_2 \rightarrow MO_2+nHCl,$$

wherein M represents a metal or metalloid, X denotes a halogen, and n denotes an integer. More specifically, $Al_2O_3$, $TiO_2$, $GeO_2$, $SiO_2$, $P_2O_5$ and $B_2O_3$ may be obtained from $AlCl_3$, $TiCl_4$, $GeCl_4$, $SiCl_4$, $POCl_3$ and $BBr_3$, respectively.

In the above process, a complex compound may be obtained if a plurality of halogenated compounds are used in mixture.

In organic fine powder may be obtained though another dry process such as those utilizing thermal CVD or plasma CVD.

Among the inorganic fine powder, the powder of $SiO_2$, $Al_2O_3$ or $TiO_2$ may preferably be used.

On the other hand, inorganic fine powder may also be produced through known wet processes. For example, an acid decomposition of sodium silicate represented by the following scheme may be used:

$$Na_2O.xSiO_2+HCl+H_2O \rightarrow SiO_2+nH_2O+NaCl.$$

Other examples of the wet process may include: the decomposition of sodium silicate with an ammonium salt or alkali salt; the formation of an alkali earth metal silicate with the use of sodium silicate, followed by decomposition with an acid, to form silicic acid; the conversion of a sodium silicate solution into silicic acid by an ion exchange resin; and the utilization of natural silicic acid or silicates.

In addition, the hydrolysis of a metal alkoxide represented by the following scheme may also be used:

$$M(OR)n+1/2.nH_2O \rightarrow MO_2+nROH,$$

wherein M denotes a metal or a metalloid, R denotes an alkyl group, and n denotes an integer. In this instance, a complex compound may be obtained if two or more metal alkoxides are used.

The carrier particles may preferably comprise an inorganic compound, particularly a metal oxide, because of an appropriate electrical resistivity. It is particularly preferable to use an oxide or a complex oxide of Si, Al or Ti. The surface of such an inorganic fine powder can be hydrophobised with a coupling agent, etc., in advance.

The liquid lubricant depending on its species used can provide excessively chargeable toner particles when it covers the toner particles surfaces. However, unhydrophobised carrier particles can promote the leakage of a charge so as to stabilize the charge of the developer, thereby providing a good developing performance. Accordingly, it is also preferred to use non-surface-treated carrier particles.

Such fine particles may preferably have a particle size of 0.001–20 $\mu$m, more preferably 0.005–10 $\mu$m.

The fine particles may preferably have a BET specific surface area of 5–500 m$^2$/g, more preferably 10–400 m$^2$/g, further preferably 20–350 $m^2/g$. Below 5 $m^2/g$, it becomes difficult to retain the liquid lubricant as lubricating particles having a suitable particle size.

In order to exhibit a desired effect, the liquid lubricant may constitute 10–90 wt. %, preferably 20–85 wt. %, further preferably 40–80 wt. %, of the lubricating particles. If the liquid lubricant amount is below 10 wt. %, the lubricating particles cannot provide the toner with good lubricity and releasability. And, if the lubricating particles are contained in the toner in large amount in compensation therefor, the developing performance and fixability are lowered. Above 90 wt. %, it becomes difficult to obtain lubricating particles having a uniform liquid lubricant content and the uniform dispersion of the liquid lubricant in the toner particles becomes difficult.

In the present invention, the lubricating particles may preferably have a particle size of at least 0.5 $\mu$m, more preferably at least 1 $\mu$m, further preferably at least 3 $\mu$m. It is also preferred that the mode particle size based on volume-basis distribution of the lubricating particles are larger than that of the resultant toner particles.

Such lubricating particles are fragile because of a large amount of the liquid lubricant contained therein, so that a part thereof collapses during the toner production process to be uniformly dispersed in the toner particles and liberate the liquid lubricant to provide the toner particles with lubricity and releasability.

The dispersed product of the lubricating particles are present in the toner particles in a state of keeping the liquid lubricant-retaining function.

Accordingly, the liquid lubricant does not excessively migrate to the toner particle surface, thus not causing deterioration of flowability or developing performance.

On the other hand, an amount of the liquid lubricant liberated from the toner particle surface can be replenished, so that the releasability and lubricity of the toner can be retained.

The lubricating particles can be formed by adding fine particles into a liquid lubricant or a solution thereof diluted with an arbitrary solvent in a blender. The solvent may be evaporated off thereafter. The lubricating particles thus produced can be pulverized thereafter.

Alternatively, it is also possible to form the lubricating particles by adding the liquid lubricant or a dilution thereof to fine particles in a kneader, etc., followed optionally by pulverization thereof. The solvent may be evaporated off thereafter.

The lubricating particles may be contained in an amount of 0.1–20 wt. parts per 100 wt. parts of the binder resin. Below 0.1 wt. part, the lubricity- and releasability-imparting effects are low and, above 20 wt. parts, the fixability and triboelectric chargeability are liable to be impaired.

The lubricating particles may also be obtained by impregnating porous powder with a liquid lubricant.

Examples of the porous powder may include: molecular sieve represented by zeolite, clay minerals such as bentonite, aluminum oxide, titanium oxide, zinc oxide, and resin gel. Among the porous powder, particles, such as those of resin gel, collapsible in the kneading step during the toner production are not limited in particle size. On the other hand, not readily collapsible porous powder may preferably have a primary particle size of at most 15 $\mu$m. Above 15 $\mu$m, the dispersion in the toner is liable to be ununiform.

The porous fine powder before impregnation with the liquid lubricant may preferably have a BET specific surface area of 10–50 $m^2/g$. Below 10 $m^2/g$, the powder cannot retain a large amount of liquid lubricant similarly as ordinary non-porous powder. Above 50 $m^2/g$, the pore diameter becomes small, thus failing to absorb a sufficient amount of liquid lubricant in the pores.

The porous powder may be impregnated with the liquid lubricant by placing the porous powder under vacuum and then dipping the porous powder in the liquid lubricant.

The porous powder impregnated with a liquid lubricant may desirably be mixed in a proportion of 0.1–20 wt. parts per 100 wt. parts of the binder resin. Below 0.1 wt. %, the lubricity and releasability imparting effects are insufficient. Above 20 wt. parts, the chargeability and the fixability of the resultant developer are liable to be impaired.

It is also possible to use capsule-type lubricating particles enclosing a liquid lubricant, or resin particles containing a liquid lubricant inside thereof as by encapsulation, swelling or impregnation.

The binder resin for the toner of the present invention may for example comprise: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-$\alpha$-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer, polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization.

The reaction temperature may depend on the solvent and initiator used and the polymer or copolymer to be produced but may suitably be in the range of 70–230° C. In the solution polymerization, it is preferred to use 30–400 wt. parts of a monomer (mixture) per 100 wt. parts of the solvent.

It is also preferred to mix another polymer in the solution after the polymerization, whereby several polymers can be well mixed.

In order to produce a crosslinked or high-molecular weight polymer component, the emulsion polymerization or suspension polymerization may preferably be adopted.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50–95° C. and selected depending on the polymerization initiator used and the objective polymer. The polymerization initiator should be insoluble or hardly soluble in water, and may be used in an amount of at least 0.05 wt. part, preferably 0.1–15 wt. parts per 100 wt. parts of the vinyl monomer (mixture).

Examples of the initiator may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methylbutyronitrile, 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl-4,4-bis (t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy) hexane, di-t-butyldiperoxyisophthalate, 2,2-bis(4,4-di-t-butyl-peroxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy) hexane, diethylene glycol-bis(t-butylperoxycarbonate), di-t-butylperoxytrimethylazipate, tris(t-butylperoxy)triazine, and vinyl-tris(t-butylperoxy)silane. These initiators may be used singly or in combination.

The polyester resin as a binder resin which may be used in the present invention may be constituted as follows.

Examples of the dihydric alcohol may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

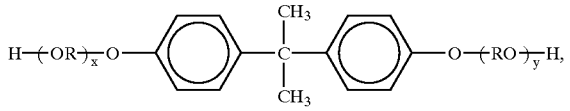

wherein R denotes an ethylene or propylene group, x and y are independently 0 or a positive integer with the proviso that the average of x+y is in the range of 0–10 and diols represented by the following formula (B):

(B)

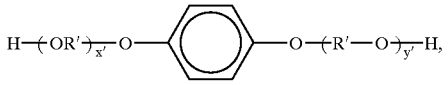

wherein

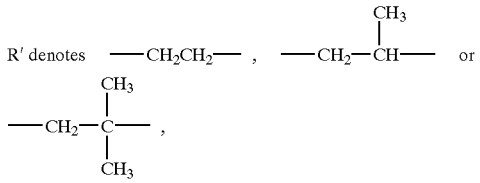

x' and y' are independently 0 or a positive integer with the proviso that the average of x'+y' is in the range of 0–10.

Examples of the dibasic acid may include dicarboxylic acids and derivatives thereof including: benzenedicarboxylic acids, such as phthalic acid, terephthalic acid and isophthalic acid, and their anhydrides or lower alkyl esters; alkyldicarboxylic acids, such as succinic acid, adipic acid, sebacic acid and azelaic acid, and their anhydrides and lower alkyl esters; alkenyl- or alkylsuccinic acid, such as n-dodecenylsuccinic acid and n-dodecyl acid, and their anhydrides and lower alkyl esters; and unsaturated dicarboxylic acids, such as fumaric acid, maleic acid, citraconic acid and itaconic acid, and their anhydrides and lower alkyl esters.

It is preferred to also use polyhydric alcohols having three or more functional groups and polybasic acids having three or more acid groups.

Examples of such polyhydric alcohol having three or more hydroxyl groups may include: sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of polybasic carboxylic acids having three or more functional groups may include polycarboxylic acids and derivatives thereof including: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empol trimer acid, and their anhydrides and lower alkyl esters; and tetracaboxylic acids represented by the formula:

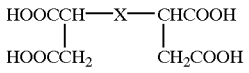

(X denotes a $C_5$ to $C_{30}$-alkylene group or alkenylene group having at least one side chain having at least three carbon atoms), and their anhydrides and lower alkyl esters.

The polyester resin used in the present invention may preferably be constituted from 40–60 mol. %, more preferably 45–55 mol. %, of the alcohol component and 60–40 mol. %, more preferably 55–45 mol. %, of the acid component respectively based on the total of the alcohol and acid components. Further, the total of the polyhydric alcohol and the polybasic acid each having three or more functional groups may preferably constitutes 1–60 mol. % of the total alcohol and acid components constituting the polyester resin.

In view of the developing performance, fixability, durability and cleaning performance of the resultant toner, it is preferred to use a styrene-unsaturated carboxylic acid derivative copolymer, a polyester resin, block copolymer and grafted product of these, and further a mixture of a styrene-copolymer and a polyester resin.

The binder resin may preferably have a peak in a molecular weight region of at least $10^5$ in a molecular weight distribution measured by gel permeation chromatography (GPC). It is further preferred that the binder resin also has a peak in a molecular weight region of $3\times10^3$–$5\times10^4$ in view of the fixability and continuous image forming characteristic.

A binder resin having such a molecular weight distribution may be prepared in the following manner.

A low-molecular weight polymer (L) having a main peak in the molecular weight region of $3\times10^3$–$5\times10^4$ and a high-molecular weight polymer (H) having a main peak in the molecular weight region of at least $10^5$ or containing a gel component, are prepared by solution polymerization, bulk polymerization, suspension polymerization, emulsion polymerization, block copolymerization, graft polymerization, etc. These polymers (L) and (H) are subjected to melt kneading, wherein a part or all of the gel component is severed to provide a tetrahydrofuran (THF)-soluble component in the molecular weight region of at least $10^5$ measurable by GPC.

Particularly preferred methods may be as follows. The polymers (L) and (H) are separately prepared by solution polymerization and one is added to the solution of the other after the polymerization. One of the polymers is prepared by polymerization in the pressure of the other. The polymer (H) is prepared by suspension polymerization, and the polymer (L) is formed by solution polymerization in the presence of the polymer (H). After the polymerization of the polymer (L) in solution polymerization and, into the solution, the polymer (H) is added. The polymer (H) is formed by suspension polymerization in the presence of the polymer (L). By these methods, it is possible to obtain a polymer mixture including the low-molecular weight component and the high molecular weight component uniformly mixed with each other.

In order to provide a positively chargeable toner, it is preferred to use a binder resin selected from styrene-acrylic copolymers, styrene-methacrylic-acrylic copolymers, styrene-methacrylic copolymers, styrene-butadiene copolymer, polyester resins having an acid value of at most 10, block copolymers and grafted products thereof and blended products of these resins. In order to provide a negatively chargeable toner, it is preferred to use a binder resin selected from styrene-acrylic copolymers, styrene-methacrylic-acrylic copolymers, styrene-methacrylic copolymers, copolymers of these monomers with maleic acid monoester, polyester resin, and block copolymers, grafted polymers of blends of these resins in view of a developing performance.

A toner for a pressure fixation scheme may be constituted by using a binder resin, such as low-molecular weight polyethylene, low-molecular weight polypropylene, ethylene-vinyl acetate copolymer, ethylene-acrylate copolymer, higher fatty acid, polyamide resin or polyester resin. These resins may be used singly or in mixture.

On the other hand, in case of providing a heat-fixable toner by using a binder resin comprising a styrene copolymer, the toner or binder resin may preferably satisfy the following characteristics in order to have the liquid lubricant fully exhibit its effect and obviate the difficulties accompanying the plasticizing effect thereof, such as deterioration of anti-blocking characteristic and developing performance.

In the molecular weight distribution by GPC, the toner or binder resin has at least one peak ($P_1$) in a molecular weight region of $3\times10^3$–$5\times10^4$, preferably $3\times10^3$–$3\times10^4$, particularly preferably $5\times10^3$–$2\times10^4$, so as to provide good fixability, developing performance and anti-blocking characteristic. Below $3\times10^3$, it is difficult to obtain a good anti-blocking characteristic. Above $5\times10^4$, it is difficult to obtain a good fixability. It is particularly preferred that there is at least one peak ($P_2$) in a molecular weight region of at least $10^5$, preferably $3\times10^5$–$5\times10^6$, of which a maximum peak in the molecular weight region of at least $10^5$ is present in a molecular weight region of $3\times10^5$–$2\times10^6$, so as to provide good anti-high temperature-offset characteristic, anti-blocking characteristic and developing performance. A higher peak molecular weight in this region provide a stronger high temperature offset characteristic. However, if the peak is in a molecular weight region of at least $5\times10^6$, a fixability can be impaired because of a large elasticity in case of using a heat roller not capable applying a sufficient pressure while there will be no problem in case of using a heat roller capable of applying a sufficient pressure. Accordingly, for providing a toner suitable for use in a medium or low speed machine equipped with a relatively low-pressure heat fixation, the maximum peak in the molecular weight region of at least $10^5$ may preferably be present in the molecular weight region of $3\times10^5$–$2\times10^6$.

The component in the molecular weight region of at most $10^5$ should preferably be at least 50%, more preferably 60–90%, particularly preferably 65–85%, so as to provide good fixability and anti-offset characteristic without being adversely affected by the liquid lubricant. Below 50%, good fixability cannot be obtained and also the pulverizability can be impaired. Above 90%, the toner performances can be adversely affected by the liquid lubricant.

In the case of constituting a toner comprising a polyester resin, the toner or binder resin may preferably have a main peak in a molecular weight region of $3\times10^3$–$1.5\times10^4$, more preferably $4\times10^3$–$1.2\times10^4$, particularly preferably $5\times10^3$–$10^4$, in a molecular weight distribution according to GPC. It is further preferred that there is at least one peak or shoulder in a molecular weight region of at least $1.5\times10^4$, or a component in a molecular weight region of at least $5\times10^4$ occupies at least 5%. Further, it is preferred to have a weight-average molecular weight (Mw)/number average molecular weight (Mn) ratio of at least 10.

By using a binder resin having a molecular weight distribution as described above, the resultant toner including also a liquid lubricant can exhibit very good developing performance, anti-blocking characteristic, fixability and anti-offset characteristic.

If the main peak is present at a molecular weight below $3\times10^3$, the toner is liable to be adversely affected by the liquid lubricant to show inferior anti-blocking characteristic and developing performance. If the main peak is present at a molecular weight exceeding $1.5\times10^4$, a good fixability cannot be attained. In the case where a peak or shoulder is present in a molecular weight region of at least $1.5\times10^4$, a component in a molecular weight region of at least $5\times10^4$ occupies at least 5% or the Mw/Mn ratio is at least 10, the adverse effects of the liquid lubricant can be suppressed.

The binder resin used in the toner according to the present invention may preferably have a glass transition point (Tg) of 50–70° C. As the toner according to the present invention may provide improved performances through a thermal history-imparting step, the toner is liable to cause a blocking during the step if Tg is below 50° C. A Tg above 70° C. is liable to provide an inferior fixability.

The molecular weight distribution of the THF (tetrahydrofuran)-soluble content of a toner or a binder resin used in the present invention may be measured based on a chromatogram obtained by GPC (gel permeation chromatography) in the following manner.

In the GPC apparatus, a column is stabilized in a heat chamber at 40° C., tetrahydrofuran (THF) solvent is caused to flow through the column at that temperature at a rate of 1 ml/min., and about 100 ul of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

A GPC sample is prepared as follows.

A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 micron (e.g., "MAISHORIDISK H-25-5", available from Toso K.K.; and "EKIKURODISK 25 CR", available from German Science Japan K.K.) to recover the filtrate as a GPC sample. The sample concentration is adjusted to provide a resin concentration within the range of 0.5–5 mg/ml.

The toner according to the present invention may be imparted with a further improved slippability by inclusion of a solid wax. The solid wax herein refers to a wax which has an absorption peaktop temperature of at least 50° C. on a DSC (differential scanning calorimeter) curve and has a melting point of at least 25° C. (room temperature).

The solid wax used in the present invention may preferably have a peak onset temperature of at least 50° C. for an absorption peak on temperature increase on a DSC curve. Below 50° C., a blocking is liable to occur during a thermal history-imparting step. The onset temperature may particularly preferably be in the range of 50–120° C., further preferably 60–110° C. It is further preferred that the peaktop temperature of a maximum absorption peak is at most 130° C., particularly in the range of 70–130° C., further preferably 85–120° C. From a DSC curve on temperature increase, it is possible to evaluate the behavior of a wax when a heat is applied thereto, and absorption peaks accompanying transition and melting of the wax. If the peak onset temperature is in the range of 50–120° C., it is possible to obtain particularly satisfactory developing performance, anti-blocking characteristic and low-temperature fixability. In case where the peak onset temperature is below 50° C., the temperature of wax change is too low, and the toner is caused to have an inferior anti-blocking characteristic and inferior developing performance at high temperatures also because of the function of a liquid lubricant. Above 120° C., the temperature of wax change becomes too high, so that an inferior fixability is liable to result. If the maximum absorption peak is at a temperature of at most 130° C., preferably in the range of 70–130° C., particularly preferably in the range of 85–120° C., particularly good fixability and anti-offset characteristic are satisfied. If the maximum absorption peak is present at a peak temperature below 70° C., a sufficient anti-high temperature-offset characteristic is not attained because of too low a melting point. If the peaktop temperature of the maximum peak is in a region exceeding 130° C., sufficient anti-low-temperature offset characteristic and low-temperature fixability tend to be difficult to obtain because of too high a melting point of the wax. If the peak temperature of the maximum peak is present in the above-described range, it becomes easy to take a balance between the anti-offset characteristic and the fixability.

In order to further enhance the anti-high temperature offset characteristic, it is preferred that the absorption peak provides a terminal onset temperature (as determined from a DSC curve on temperature increase) of at least 60° C., further preferably 80–140° C., more preferably 90–130° C., particularly preferably 100–130° C.

It is further preferred that the terminal onset temperature and the onset temperature have a difference therebetween of 70–5° C., more preferably 60–10° C., further preferably 50–10° C.

By satisfying the above condition, it becomes easy to take a balance of low-temperature fixability, anti-offset characteristic, anti-blocking characteristic and developing performance when the wax is used in combination with the liquid lubricant. If the above temperature difference is broader than the above range, an inferior anti-blocking characteristic results even if the low-temperature fixability and anti-offset characteristic are satisfied.

The liquid lubricant used in the present invention shows a release effect at the time of fixation but it is preferred to incorporate a solid wax described below in the toner particles in order to improve the releasability from the fixing member and the fixability at the time of fixation, particularly in the case of a heat-fixable toner.

Paraffin wax and derivatives thereof, montan wax and derivatives thereof, Fischer-Tropsch wax and derivatives thereof, polyolefin wax and derivatives thereof, and carnauba wax and derivatives thereof. The derivatives may include: oxides, block copolymers with a vinyl monomer, and graft-modification products. In addition, it is also possible to use alcohols, aliphatic acids, acid amides, esters, ketones, cured castor oil and derivatives thereof, vegetable waxes, animal waxes, mineral waxes and petrolactam.

Among these solid waxes, preferred examples may include: a low-molecular weight polyolefin obtained through polymerization of an olefin by radical polymerization under a high pressure or in the presence of a Ziegler catalyst, and by-products in the polymerization; low-molecular weight polyolefins obtained by thermal decomposition of high-molecular weight polyolefin; a wax obtained from a distillation residue from synthetic hydrocarbons produced from a mixture gas containing carbon monoxide and hydrogen in the presence of a catalyst, or a wax derived from synthetic hydrocarbons obtained by hydrogenation of the residues. The waxes can contain an anti-oxidant. Also preferred are linear alcohols, aliphatic acids, acid amides esters and montan derivatives. It is also preferred to remove impurities such as aliphatic acids.

Particularly preferred examples of the solid wax may include; products obtained by polymerization of olefins, such as ethylene, in the presence of a Ziegler catalyst, and by-products thereof, and other hydrocarbon waxes such as Fischer-Tropsch wax, having up to several thousand carbon atoms, particularly up to 1000 carbons. It is also preferred to use a long-chain alkyl alcohol having up to several hundred carbon atoms, particularly up to 100 carbon atoms, and a terminal hydroxy group. It is also preferable to use an alkylene oxide adduct to an alcohol.

It is also preferred to use a solid wax prepared by fractionating the above solid waxes into a particular molecular weight fraction by the press sweating method, the solvent method, the vacuum distillation, the supercritical gas extraction method, and fractionating crystallization, such as melt-crystallization and crystal filtration. After the fractionation, it is possible to subject the product to oxidation, block copolymerization or graft-modification. By these methods, it is possible to remove a low-molecular weight fraction, extract a low-molecular weight fraction or removing a low-molecular weight fraction from the extract.

The toner according to the present invention may contain such a solid wax in a proportion of 0.2–20 wt. parts, more effectively 0.5–10 wt. parts, per 100 wt. parts of the binder resin. It is possible to use several species of wax in combination or a mixture of these. Waxes containing functional groups, such as alcohols, aliphatic acids, esters, acid amides and alcohol alkylene oxide adducts can contain polyolefins or hydrocarbons.

In the toner according to the present invention, the liquid lubricant and the solid wax are used in combination, so that it is possible to obtain not only an improved releasability in a molten state at the time of fixation but also improved lubricity and releasability in an ordinary state, thereby further enhancing the effect of the liquid lubricant.

It is also preferred to use a solid wax having a penetration of at most 4.0, and a density of at least 0.93, whereby the toner may be provided with an enhanced slippability and an increased cleanability, the melt-sticking is prevented, and the abrasion of the photosensitive member is minimized. The solid wax may preferably have a penetration of at most 3.0, particularly at most 2.0, and a density of 0.94.

If the density is above 0.93, the wax may be dispersed in a state capable of effectively providing the toner with a sufficient slippability. This is presumably because the wax is dispersed in an appropriate size at the toner particle surface. If the penetration is above 4.0 or the density is below 0.93, a sufficient effect cannot be obtained but the melt-sticking on the photosensitive member is liable to occur.

Another preferred wax may be one having a main component having at least 20 carbon atoms, further at least 30 carbon atoms, particularly at least 40 carbon atoms, in a carbon number distribution as measured by a gas chromatograph. It is particularly preferred to use a wax having continuous carbon number (number of methylene group) distribution giving peaks free from a periodical intensity difference in the present invention, because of a high hardness and a rich lubricity.

In view of the developing performance, fixability and anti-offset characteristics, it is preferred to use a wax having a maximum peak at a carbon number of at least 30, further preferably at least 40, particularly in the range of 50–150.

It is also preferred to use a polyolefin wax, a hydrocarbon wax or a long-chain alkyl alcohol wax having a weight-average molecular weight (Mw)/number-average molecular weight (Mn) ratio of at most 3.0, further at most 2.5, particularly at most 2.0, because of hardness and slippability.

A wax obtained through molecular weight-basis fractionation has also characteristics of slippability and hardness. If the wax is hard, the resultant toner is rich in slippability because of the presence of the wax at the toner particle surface when added to the toner particles. More specifically, the toner does not readily attach to the photosensitive member but can be easily cleaned while preventing the melt-sticking. Further, as the toner is rich in slippability, the abrasive function of the toner is reduced to prevent the scraping of the photosensitive member with the toner, thereby providing the toner particles with a more effective releasability and lubricity in combination with the releasability and lubricity of the liquid lubricant.

The wax may preferably have a number-average molecular weight (Mn) of 300–1500, more preferably 350–1200, further preferably 400–1000, and a weight-average molecular weight (Mw) of 500–4500, more preferably 550–3600, further preferably 600–3000.

If Mn is below 300 or Mw is below 500, the wax can exhibit an excessive plasticizing function when used in combination with the liquid lubricant, thereby being liable to provide an inferior anti-blocking performance and a lower developing performance. If Mn is above 1500 or Mw is above 4500, it becomes difficult to obtain the fixability-improving function of the wax.

The DSC measurement for characterizing the binder resin and the wax used in the present invention is used to evaluate heat transfer to and from these materials and observe the behavior, and therefore should be performed by using an internal heating input compensation-type differential scanning calorimeter which shows a high accuracy based on the measurement principle. A commercially available example thereof is "DSC-7" (trade name) mfd. by Perkin-Elmer Corp. In this case, it is appropriate to use a sample weight of about 10–15 mg for a toner sample or about 2–5 mg for a wax sample.

The measurement may be performed according to ASTM D3418-82. Before a DSC curve is taken, a sample (toner or wax) is once heated for removing its thermal history and then subjected to cooling (temperature decrease) and heating (temperature increase) respectively at a rate of 10° C./min. in a temperature range of 0° C. to 200° C. for taking DSC curves. The temperatures or parameters characterizing the invention are defined as follows.

Glass Transition Point (Tg)

A temperature at an intersection of a DSC curve with a line passing through a mid point between and in parallel with base lines taken before and after the change in specific heat on the DSC curve on temperature increase.

Onset Temperature of a Heat Absorption Peak

A temperature at which a tangential line giving a first maximum differential on a DSC curve on temperature increase intersects the base line.

Peaktop Temperature of the Largest Peak

A peaktop temperature of a peak having the largest height from the base line.

Terminal Onset Temperature of a Heat Absorption Peak

A temperature at which a tangential line giving a last minimum differential on a DSC curve on temperature increase intersects the base line.

The molecular weight distribution of hydrocarbon wax may be obtained based on measurement by GPC (gel permeation chromatography), e.g., under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The penetrations of waxes referred to herein are based on measurement according JIS K-2207 whereby a styrus having a conical tip with a diameter of about 1 mm and an apex angle of 9 degrees is caused to penetrate into a sample for 5 sec. under a prescribed weight of 100 g at a sample temperature of 25° C. The measured value is expressed in the unit of 0.1 mm.

The densities of waxes referred to herein are based on measurement according to JIS K7112 or JIS K6760 at a temperature of 23±1° C. according to the sink and float method, etc.

The carbon number distribution of waxes referred to herein are based on results measured by gas chromatograph (GC) under the following conditions:

Apparatus: HP 5890 Series II (mfd. by Yokogawa Denki K.K.)

Column: SGE HT-5, 6 m×0.53 mm I.D.×0.15 μm

Carrier gas: He 20 ml/min., constant flow mode

Oven temperature: 40° C.→450° C.

Injection port temperature: 40° C.→450° C.

Detector temperature: 450° C.

Detector: FID

Injection port: with pressure control

The injection port was placed under pressure control, and the measurement was performed under the above conditions.

For the toner according to the present invention, it is preferred to incorporate a charge control agent to the toner particles (internal addition) or blend a charge control agent with the toner particles (external addition). By using such a charge control agent, it becomes possible to effect an optimum charge control suitable for the developing system and provide a further stable balance with the liquid lubricant.

Examples of the positive charge control agents may include: nigrosine and modified products thereof with aliphatic acid metal salts, etc., onium salts inclusive of quarternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate; guanidine compounds, and imidazole compounds. These may be used singly or in mixture of two or more species. Among these, triphenylmethane compounds and organic quaternary ammonium salts having non-halogen counter ions are particularly preferred. It is also possible to use a homopolymer of a monomer represented the following formula (1):

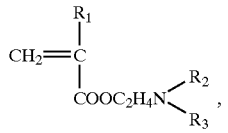

(1)

wherein $R_1$ denotes H or $CH_3$, and $R_2$ and $R_3$ denote a substituted or unsubstituted alkyl group of preferably $C_1$–$C_3$; and a copolymer thereof with another polymerizable monomer described above, such as styrene, acrylic acid ester or methacrylic acid ester, as a positive charge control agent In this instance, the charge control agent can occupy the whole or a part of the binder resin of the toner according to the present invention.

It is particularly preferred to use a compound of the following formula (2):

(2)

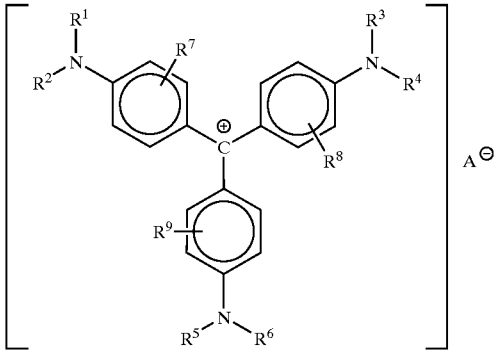

wherein $R^1$–$R^6$ independently denote hydrogen atom, substituted or unsubstituted alkyl group, or substituted or unsubstituted aryl group; $R^7$–$R^9$ independently denote hydrogen atom, halogen atom, alkyl group, or alkoxy group; $A^{\ominus}$ denotes an anion, such as sulfate ion, nitrate ion, borate ion, phosphate ion, hydroxyl ion, organosulfate ion, organosulfonate ion, organophosphate ion, carboxylate ion, organoborate ion, or tetrafluoroborate ion.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

It is preferred to use an azo metal complex represented by the following formula (3):

(3)

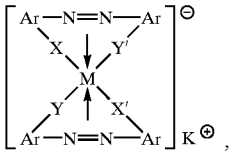

wherein M denotes a coordination center metal, such as Sc, Ti, V, Cr, Co, Ni, Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $K^{\oplus}$ denotes hydrogen, sodium, potassium, ammonium or aliphatic ammonium or nothing.

A particularly preferred center metal is Fe or Cr; a preferred substituent is halogen, alkyl or anilide; and a preferred counter ion is hydrogen alkali metal, ammonium or aliphatic ammonium. It is also preferred to use a mixture of complex salts having different counter ions.

Basic organometal complexes represented by the following formula (4) impart a negative chargeability and may be used in the present invention.

(4)

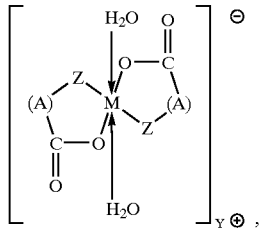

wherein M denotes a coordination center metal, such as Cr, Co, Ni, Mn and Fe and Zn; A denotes

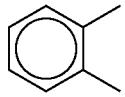

(capable of having a substituent, such as an alkyl),

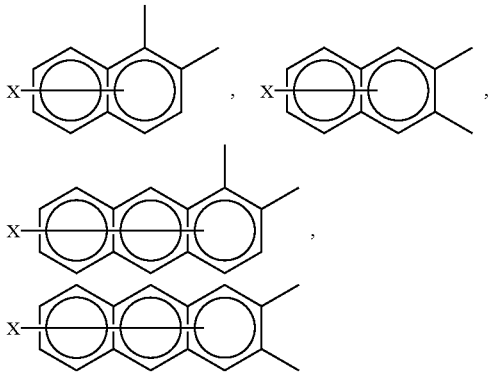

(X denotes hydrogen, halogen, alkyl or nitro),

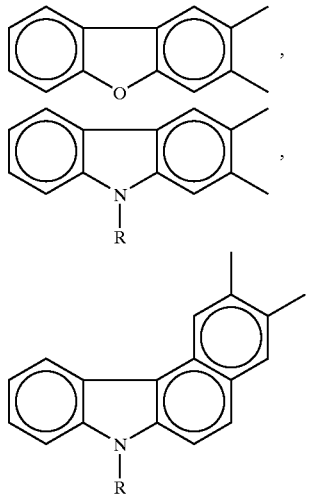

(R denotes hydrogen, $C_1$–$C_{18}$ alkyl or $C_1$–$C_{18}$ alkenyl); $Y^+$ denotes a counter ion, such as hydrogen, sodium, potassium, ammonium, aliphatic ammonium or nothing; and Z denotes —O— or —CO·O—.

A particularly preferred center metal is Fe, Cr, Si, Zn or Al; a preferred substituent is alkyl, anilide, aryl or halogen; and a preferred counter ion is hydrogen, ammonium or aliphatic ammonium.

Such a charge control agent may be incorporated into toner particles (internal addition) or externally added to the toner particles. The amount of the charge control agent can depend on the kind of the binder resin, the presence or absence of another additive and the toner production process including the dispersion method and cannot be determined without regard to these factors, but may preferably be 0.1–10 wt. parts, more preferably be 0.1–5 wt. parts, per 100 wt. parts of the binder resin. In the case of external addition, the charge control agent may preferably be added in an amount of 0.01–10 wt. parts per 100 wt. parts of the binder resin and may preferably be affixed to the toner particle surfaces mechanochemically.

The toner according to the present invention may preferably be produced by sufficiently blending the above-mentioned toner constituent materials by a ball mil, a Henschel mixer or another blender, and melt-kneading the blend by a hot kneading means, such as a hot roll kneader, or extruder, followed by cooling and classification of the kneaded product, mechanical pulverization, and classification.

In the present invention, a colorant or magnetic powder carrying a liquid lubricant is dry-blended with a binder resin powder, so that the liquid lubricant can be uniformly dispersed in the binder resin powder together with the colorant or magnetic powder. Further, during the melt-kneading, the liquid lubricant can be uniformly dispersed in the binder resin together with the colorant or magnetic powder. Then, the kneaded product is pulverized so that the liquid lubricant is uniformly dispersed together with the colorant or magnetic particle in each of individual toner particles.

Further, the liquid lubricant is repetitively liberated from and attached to the colorant or magnetic particle, and a part thereof migrates to the toner particle surface to form an equilibrium state, thereby providing the toner particles with releasability and lubricity. As a result, the surface of each toner particle becomes uniform and all the toner particles become uniform.

Other toner production processes may include: spray-drying of a binder resin solution containing constituent materials dispersed therein to provide toner particles; and a polymerization process including production of an emulsion or suspension liquid containing a dispersion of a mixture of a monomer providing a binder resin and other constituent materials in a dispersion medium, followed by polymerization of the dispersed mixture. Microcapsule toners comprising a core material and a shell material may also be formed.

The toner particles produced in this manner are however caused to have a shape of a sphere or a shape close thereto, so that they are liable to cause an appropriate degree of friction and the residual toner is liable to by pass the cleaner device. Further, the colorant or magnetic particle is not readily allowed to be present at or near the toner particle surface or is liable to be localized at the surface, so that it becomes difficult to control the liquid lubricant amount at the toner particle surface, thus being liable to adversely affect the developing performance.

As has been already mentioned, if the toner particles thus produced are subjected to a thermal history-imparting step, the liquid lubricant is caused to be present stably in a required amount at the toner particle surfaces, thereby exhibiting the effect to the maximum. The thermal history-imparting step is particularly effective for the toner produced by the pulverization process and may be placed at an arbitrary stage after the pulverization, particularly after the classification. The step can be placed even after the addition of the external additives.

The thermal history-imparting step may be effected by leaving the toner for standing in an environment of 30–45° C., preferably 30–40° C., for one day or more. A larger temperature provides a sufficient effect in a shorter period. An equilibrium state is reached with a certain period, and a longer period of standing does not provide an adverse effect. It is also possible to attain an equivalent effect by standing at room temperature with time.

The developer according to the present invention may be obtained by sufficiently blending the toner with inorganic fine powder treated with an organic agent by a blender, such as a Henschel mixer.

The inorganic fine powder treated with an organic agent shows a large releasability and, when blended with the toner retaining a liquid lubricant at its surface, provides a developer with or remarkably enhanced lubricity and releasability. The inorganic fine powder does not adsorb the liquid lubricant on the toner particle surface.

The toner particles retaining a liquid lubricant at the surface are liable to electrostatically agglomerate, but the addition of the organically treated inorganic fine powder provides the developer with not only flowability but also a stable chargeability.

Examples of the inorganic fine powder to be treated with an organic agent may include: fine powdery silica, such as the dry process silica and the wet process silica; powder of other metal oxides, such as alumina, titania, germanium oxide, and zirconium oxide; powder of carbides, such as silicon carbide and titanium carbide; and powder of nitride, such as silicon nitride and germanium nitride.

The inorganic fine powder treated with an organic agent may be used in a proportion of 0.01–8 wt. parts, preferably 0.1–4 wt. parts per 100 wt. parts of the toner.

The inorganic fine powder as the base powder may preferably be one prepared by vapor phase oxidation of a metal halide through a so-called dry process, which per se has been known. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

On the other hand, the inorganic fine powder may also be produced through a wet process which may be selected from various known processes. For example, decomposition of sodium silicate with an acid represented by the following reaction scheme may be utilized.

$$Ma_2O.xSiO_2+HCl+N_2O \rightarrow SiO_2.nH_2O+NaCl.$$

In addition, it is also possible to utilize decomposition of sodium silicate with ammonia salt or alkali salt, conversion of sodium silicate into alkaline earth metal silicate followed by decomposition with an acid to form silicic acid; and natural silicic acid or silicate.

The inorganic fine powder may preferably have a weight-average primary particle size of 0.001–2.0 $\mu$m, more preferably 0.002–0.2 $\mu$m.

The inorganic fine powder may preferably have a BET specific surface area of at least 20 $m^2/g$, more preferably 30–400 $m^2/g$, further preferably 40–300 $m^2/g$.

The inorganic fine powder may preferably be organically treated before mixing with the toner. The treatment may be performed by chemically treating the inorganic fine powder with an organometallic compound reactive with or physically adsorbed by the inorganic fine powder. Preferably, inorganic fine powder formed by vapor phase oxidation of a metal halide with an organosilicon compound or a titanium coupling agent.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

Alternatively, it is also possible to treat the inorganic fine powder with a nitrogen-containing organosilane compound such as a nitrogen-containing silane coupling agent.

Examples thereof may include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorpholine, trimethoxysilyl-γ-propylimidazole, γ-aminopropyldimethylmethoxysilane, γ-aminopropylmethyldimethoxysilane, 4-aminobutyldimethylmethoxysilane, 4-aminobutylmethyldiethoxysilane, and N-(2-aminoethyl) aminopropyldimethoxysilane.

Examples of nitrogen-containing disiloxanes may include: 1,3-bis(3-aminopropyl)-1,1,3,3-tetramethyldisiloxane, 1,3-bis(4-aminobutyl)-1,1,3,3-tetramethyldisiloxane, 1,3-bis{N(2-aminoethyl) aminopropyl}-1,1,3,3-tetramethyldisiloxane, 1,3-bis (dimethylaminopropyl)-1,1,3,3-tetramethyldisiloxane, 1,3-bis(diethylaminopropyl)-1,1,3,3-tetramethyldisiloxane, 1,3-bis(3-propylaminopropyl)-1,1,3,3-tetramethyldisiloxane, and 1,3-bis(3-aminopropyl)-1,1,3,3-tetramethyldisiloxane.

Examples of nitrogen-containing disilazanes may include: 1,3-bis(3-aminopropyl)-1,1,3,3-tetramethyldisilazane, 1,3-bis(4-aminobutyl)-1,1,3,3-tetramethyldisilazane, 1,3-bis{N (2-aminoethyl)aminopropyl}-1,1,3,3-tetramethyldisilazane, 1,3-bis(dimethylaminopropyl)-1,1,3,3-tetramethyldisilazane, 1,3-bis(diethylaminopropyl)-1,1,3,3-tetramethyldisilazane, 1,3-bis(3-propylaminopropyl)-1,1,3,3-tetramethyldisilazane, and 1,3-bis(3-aminopropyl)-1,1,3,3-tetramethyldisilazane.

These organic treating agents may be used singly, in a mixture of two or more species, in combination or successively.

It is preferred to treat the inorganic fine powder with silicone oil in order to provide the developer with releasability.

Silicone oils may be generally represented by the following formula:

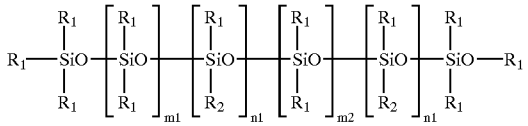

wherein $R_1$ denotes alkyl (e.g., methyl), aryl or hydrogen, $R_2$ denotes amino, fluorine, alkoxy, epoxy, polyether, chloro, aliphatic ester, alkyl or aryl capable of having hydroxyl, or hydrogen; $m_1$, $m_2$, $n_1$, and $n_2$ denote 0 or a positive integer with the proviso that at least one is a positive integer.

Examples of preferred silicone oil may include: methylhydrogensilicone oil, dimethylsilicone oil, phenylmethylsilicone oil, chlorophenyl-modified silicone oil, chloroalkyl-modified silicone oil, alkyl-modified silicone oil, aliphatic acid ester-modified silicone oil, polyether-modified silicone oil, alkoxy-modified silicone oil, carbinol-modified silicone oil, and fluorine-modified silicone oil.

Commercially available silicone oils may also be used. Examples thereof may include: dimethylsilicone oils, such as KF-96 and KF-961 (available from Shin'Etsu Kagaku Kogyo K.K.), TSF451 (available from Toshiba Silicone K.K.) and SH 200 (available from Toray Dow Corning Silicone K.K.).

It is also possible to use a silicone oil having a nitrogen-containing side chain. Such silicone oil may have a partial structure represented by the following formulae:

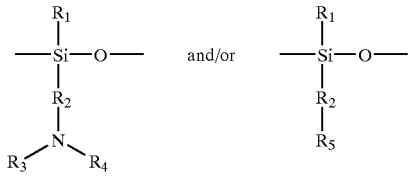

wherein $R_1$ denotes hydrogen, alkyl, aryl or alkoxy; $R_2$ denotes alkylene or phenylene; $R_3$ and $R_4$ denote hydrogen, alkyl or aryl; and $R_5$ denotes a nitrogen-containing heterocyclic group.

The above-mentioned alkyl, aryl, alkylene or phenylene can comprise a nitrogen-containing organo group or have a substituent, such as halogen, without impairing the chargeability.

These silicone oils may be used singly, in mixture of two or more species, in combination or successively. The silicone oil may also preferably be used in combination with the treatment with a silane coupling agent.

Particularly, by externally mixing the inorganic fine powder treated with nitrogen-containing silane compound and silicone oil, it becomes possible to improve the flowability and releasability of the developer, and also improve the stable image forming characteristic even in a low-humidity environment and a high-humidity environment. Further, an improved high-speed image forming characteristic is provided.

In case where the inorganic fine powder is treated with silicone oil, the treated inorganic fine powder exhibits hydrophobicity so that, when mixed with toner particles, it can retain a good chargeability even in a high-humidity environment. The inorganic fine powder treated with silicone oil also promotes the lubricity and releasability of the toner to provide a high transfer efficiency.

In case where the inorganic fine powder is treated with silicone oil, the charge-leakage points of the inorganic fine powder can be lost due to the silicone oil present at the surface, so that charge-up can occur in some cases in a low-humidity environment.

On the other hand, if the inorganic fine powder is treated with a nitrogen-containing silane compound, the treated inorganic powder is provided with a positive chargeability and also a certain degree of hydrophilicity. As a result, when it is mixed with toner particles to provide a developer, the developer can retain charge-leakage points to suppress the charge-up phenomenon (excessive charge of the developer), thereby retaining good chargeability even in a low-humidity environment.

In case where the inorganic fine powder is treated with a nitrogen-containing silane compound exhibiting a particularly excellent uniformity of treatment, the agglomeration of the powder can be suppressed so that, when it is blended with toner particle to provide a developer, the developer can obviate charging abnormality and coating failure on the developing sleeve.

The inorganic fine powder treated with nitrogen-containing silane compound and silicone oil, is caused to have a sufficient hydrophobicity because of the silicone oil treatment and also a certain degree of hydrophobicity because of the treatment with the nitrogen-containing silane compound. Accordingly, the treated inorganic fine powder does not readily cause a charge-up phenomenon even in a low-humidity environment or a lower image density even in a high-humidity environment, thus retaining excellent developing performances. As a result, good chargeability can be retained even during a high-speed image formation using a developing apparatus equipped with a magnetic doctor blade.

The toner carrying a liquid lubricant at its surface is liable to agglomerate electrostatically whereas the agglomeratability of the developer can be suppressed when mixed with the inorganic fine powder treated with the nitrogen-containing silane compound and silicone oil because of the small specific surface area and excellent flowability of the treated inorganic fine powder.

Among the silicone oils, it is preferred to use dimethylsilicone oil, methylphenylsilicone oil, methylhydrogensilicone oil, alkyl-modified silicone oil, and silicone oil having a nitrogen-containing side chain in view of chargeability and uniform treatment characteristic.

The silicone oil for treating the inorganic fine powder may preferably have a viscosity at 25° C. of 0.5–10,000 $mm^2/s$ (0.5–10,000 cSt), more preferably 10–1,000 $mm^2/s$ (10–1,000 cSt).

If the viscosity of the silicone oil exceeds 10,000 $mm^2/s$ (10,000 cSt), small lumps are apt to be formed during the treatment of the inorganic fine powder and, when blended with toner particles to provide a developer, the developer is liable to cause a filming phenomenon (sticking of the developer) on the photosensitive drum, thereby being liable to cause white spots in black solid image formation and black spots in white solid image image formation.

If the viscosity of the silicone oil is below 0.5 $mm^2/s$ (0.5 cSt), the volatile matter content is increased so that it becomes difficult to control the amount of the silicone oil for treating the inorganic fine powder, and also a uniform treatment becomes difficult.

It is preferred to treat 100 wt. parts of inorganic fine powder with 0.1–20 wt. parts, particularly 0.5–10 wt. parts, of the nitrogen-containing silane compound.

The silicone oil functions to improve the hydrophobicity and the lubricity and releasability of the inorganic fine powder. These properties are enhanced as the amount of the silicone oil is increased, but the use of an excessive amount lowers the specific surface area of the inorganic fine powder, thus resulting in a lower flowability of the developer.

It is preferred to treat 100 wt. parts of the inorganic fine powder with 1–100 wt. parts, particularly 5–50 wt. parts, of the silicone oil.

If the treating amount of the silicone oil exceeds 100 wt. parts, the treated inorganic fine powder is caused to have a lower specific surface areas, thus a lower flowability-imparting property.

If the treating amount of the silicone is below 1 wt. part, the hydrophobicity is lowered.

The amount of the nitrogen-containing silane compound (A) and the amount of the silicone oil (S) used for treating the inorganic fine powder may preferably have a ratio N (=A/S) in the range of 1/40–10/1 (=0.25–10), more preferably 1/20–2/1 (=0.05–2), particularly preferably 1/10–1/1 (=0.1–1).

The inorganic fine powder for use together with a positively chargeable toner should preferably be positively chargeable.

Generally, inorganic fine powder treated with silicone oil tends to be negatively chargeable.

For providing a positive chargeability, the inorganic fine powder may be treated with both the silicone oil and the nitrogen-containing silane compound.

In case where $N<0.025$, i.e., the amount of the nitrogen-containing silane compound is relatively small, the treated inorganic fine powder is liable to be negatively chargeable, and the toner mixed therewith is liable to cause reversal fog.

In case where $N>10$, i.e., the amount of the nitrogen-containing silane compound is relatively large, the resultant developer is liable to cause a lower density due to a decrease in chargeability, when left standing in a high-humidity environment.

The treatment of the inorganic fine powder may be performed in a known manner. For example, the inorganic fine powder may be treated according to a wet process wherein the powder is dispersed in a solvent, a treating agent is added thereto and then the solvent is removed. Alternatively, the inorganic fine powder may be treated according to a dry process wherein the powder is mechanically stirred sufficiently, and a treating agent or a solution thereof is sprayed thereto. Of these, the dry processing process is preferred.

In the above treatment, the inorganic fine powder may be treated simultaneously with the nitrogen-containing silane compound and the silicone oil, or successively, first with the silane compound and then with the silicone oil, or vice versa.

In the dry processing process, the silane compound and/or the silicone oil, depending on the viscosity, may be diluted as desired with a solvent, such as alcohol, ketone, ether or hydrocarbon to form a solution to be used for treatment.

In the treatment, it is possible to add some amount of water, ammonium, amine, etc., for promoting the treatment.

After the addition of the treating agent, the system may be heated to 100–300° C. in a nitrogen atmosphere including the removal of the solvent. As a result of the treatment, the inorganic fine powder is provided with hydrophobicity.

The treated inorganic fine powder, e.g., silica, may preferably show a hydrophobicity of 30–90%, as measured by the methanol titration test. More specifically, the hydrophobicity may be measured in the following manner. A sample (ca. 2 g) of treated inorganic fine powder is weighed into a beaker and 50 ml of pure water is added thereto. While the system is stirred by a magnetic stirrer, methanol is added to below the liquid surface. A terminal point is determined as a point of time when the sample disappears from the liquid surface. Based on the amount of methanol (X ml) used up to the terminal point, the hydrophobicity (%) is calculated as $[X/(50+X)]\times 100$.

The toner according to the present invention containing a colorant or magnetic powder carrying a liquid lubricant, can uniformly retain an appropriate amount of liquid lubricant at the toner particle surface and is therefore excellent in releasability, lubricity and transferability, thereby exhibiting a remarkable transfer dropout-preventing effect.

Further, by adding inorganic fine powder treated with a nitrogen-containing silane compound and silicone oil thereto, it is possible to further improve the flowability and releasability of the developer. Further, without impairing these properties, the developer can retain excellent developing performances even in a low-humidity environment as well as in a high-humidity environment, thereby exhibiting a stable continuous image forming performances even in a high-speed image formation.

In order to improve the developing performance and continuous image forming performance, it is also preferable to use another fine powdery inorganic substance, examples of which may include: oxides of metals, such as magnesium, zinc, aluminum, cerium, cobalt, iron, zirconium, chromium, manganese, strontium, tin and antimony; complex metal oxides, such as calcium titanate, magnesium titanate, and strontium titanate; metal salts, such as calcium carbonate, magnesium carbonate, and aluminum carbonate; clay minerals, such as kaolin; phosphoric acid compounds, such as apatite; silicon compounds, such as silicon carbide and silicon nitride; and carbons, such as carbon black and graphite. Among these, it is preferred to use powder of zinc oxide, aluminum oxide, cobalt oxide, manganese dioxide, strontium titanate or magnesium titanate.

For a similar purpose, it is also preferable to add particles of organic substances or complex substances, examples of which may include: resins, such as polyamide resin, silicone resin, urethane resin, melamine-formamide resin, and acrylic resin; and complex substances of rubber, wax, aliphatic compounds or resins with a metal, a metal oxide, a salt or carbon black.

It is also preferable to add powder of a lubricant inclusive of: fluorine-containing resins, such as teflon, and polyvinylidene fluoride; fluorides, such as carbon fluoride; aliphatic acid metal salts, such as zinc stearate; aliphatic acids and aliphatic acid derivatives, such as aliphatic acid esters; sulfides, such as molybdenum sulfide; and amino acids and amino acid derivatives.

The toner or developer according to the present invention can be used together with a carrier to constitute a two-component type developer. The carrier used for constituting a two-component type developer may be a known one, examples of which may include particles having an average particle size of 20–300 $\mu$m of surface-oxidized or -unoxidized metals, such as iron, nickel, cobalt, manganese, chromium and rare earth metals, and alloys or oxides of these metals.

These carrier particles can be coated with styrene resin, acrylic resin, silicone resin, fluorine-containing resin or polyester resin.

The image forming method using the toner according to the present invention will now be described. The developing step may be performed by known methods inclusive of the magnetic monocomponent developing method, the non-magnetic monocomponent developing method, and the two-component developing method using a two-component type developer comprising a toner and a carrier.

The magnetic monocomponent method is described first.

Referring to FIG. 1, almost a right half of a developing sleeve 22 of a developing device 2 is always contacted with a toner stock T stirred by stirring bar 27 in a toner vessel 21, and the toner in the vicinity of the developing sleeve surface is attached to the sleeve surface under a magnetic force exerted by a magnetic force generating means 23 in the sleeve 22 and/or an electrostatic force. As the developing sleeve 22 is rotated, the magnetic toner layer is formed into a thin magnetic toner layer $T_1$ having an almost uniform thickness while moving through a doctor blade 24. The magnetic toner is charged principally by a frictional contact between the sleeve surface and the magnetic toner near the sleeve surface in the toner stock caused by the rotation of the developing sleeve 22. The magnetic toner thin layer on the developing sleeve is rotated to face a latent image-bearing member 1 in a developing region A at the closest gap $\alpha$ between the latent image-bearing member 1 and the developing sleeve. At the time of passing through the developing region A, the magnetic toner in a thin layer is caused to jump and reciprocally move through the gap $\alpha$ between the latent image-bearing member 1 and the developing sleeve 22 surface at the developing region A under an AC-superposed DC electric field applied between the latent image-bearing member 1 and the developing sleeve. Consequently, the magnetic toner on the developing sleeve 22 is selectively transferred and attached to form a toner image $T_2$ on the latent image-bearing member depending on a latent image potential pattern on the member 1.

The developing sleeve surface having passed through the developing region A and selectively consumed the magnetic toner is returned by rotation to the toner stock in the vessel 21 to be replenished with the magnetic toner, followed by repetition of the magnetic thin toner layer $T_1$ on the sleeve 22 connected to a DC supply So and an AC supply Si sleeve 22 and development at the developing region A.

A doctor blade 24 (of a metal or a magnet) is used in the embodiment shown in FIG. 1. The development step in the image forming method according to the present invention can be also preferably be performed by a developing method using an elastic blade abutted against the sleeve surface.

The elastic blade may comprise, e.g., elastomers, such as silicone rubber, urethane rubber and NBR; elastic synthetic resins, such as polyethylene terephthalate; and elastic metals, such as steel and stainless steel. A composite material of these can also be used. It is preferred to use an elastomeric blade.

The material of the elastic blade may largely affect the chargeability of the toner on the toner-carrying member (sleeve). For this reason, it is possible to add an organic or inorganic substance to the elastic material as by melt-mixing or dispersion. Examples of such additive may include metal oxide, metal powder, ceramics, carbon, whisker, inorganic fiber, dye, pigment and surfactant. In order to control the charge-imparting ability, it is also possible to line the part of an elastic blade of a rubber, synthetic resin or metal abutted to the sleeve with a resin, rubber, metal oxide or metal. If the durability is required of the elastic blade and the sleeve, it is preferred to line the part abutted to the sleeve of a metal elastic blade with a resin or rubber.

In the case of a negatively chargeable magnetic toner, it is preferred to compose a blade with urethane rubber, urethane resin, polyamide, nylon or a material readily chargeable to a positive polarity. In the case of a positively chargeable toner, it is preferred to compose a blade with urethane rubber, urethane resin, fluorine-containing resin (such as teflon resin), polyimide resin, or a material readily chargeable to a negative polarity. When the portion abutted to the sleeve of the blade is formed as a molded product of a resin or rubber, it is preferable to incorporate an additive, inclusive of metal oxides, such as silica, alumina, titania tin oxide, zirconium oxide and zinc oxide; carbon black and a charge control agent generally used in a toner.

An upper side of the elastic blade is fixed to the developer vessel and the lower side is pressed with a bending in resistance to the elasticity of the blade against the developing sleeve so as to extend in a direction forward or reverse with respect to the rotation direction of the sleeve and exert an appropriate elastic pressure against the sleeve surface with its inner side (or outer side in case of the reverse abutment). The relevant parts of image forming apparatus including a developing apparatus using an elastic blade are for example shown in FIGS. 2–5.

In FIGS. 2–5, reference numerals 201, 301, 401 and 501 denote an image-bearing member; 202, 303, 402 and 502 denote a developing sleeve; 203, 302, 403 and 503 denote a blade; and V denotes a bias voltage application means. By using such apparatus, it is possible to form a thin but dense layer in a more stable manner regardless of changes in environmental conditions. This is presumably because the toner particles are forcibly rubbed between the elastic blade and the sleeve surface unlike a metal blade disposed with a certain gap from the sleeve, so that the toner is charged under an identical condition without being affected by a change in toner behavior depending on an environmental change.

The toner and the developer according to the present invention is rich in slippability, so that the wearing of the elastic blade and the sleeve can be minimized and a uniform triboelectric change can be retained for a long period. As the developer according to the present invention is rich in slippability, it is possible that the charging becomes ununiform because of insufficient friction in a low-speed image forming apparatus including a metal blade disposed with a gap from the sleeve.

The abutting pressure between the blade and the sleeve may be at least 1 g/cm, preferably 3–250 g/cm, further preferably 5–120 g/cm, in terms of a linear pressure along the generatrix of the sleeve. Below 1 g/cm, the uniform application of the toner becomes difficult, thus resulting in a broad charge distribution of the toner causing fog or scattering. Above 250 g/cm, an excessively large pressure can be applied to the developer to cause deterioration and agglomeration of the developer, and a large torque is required for driving the sleeve.

The spacing $\alpha$ between the latent image-bearing member and the developing sleeve may be set to e.g., 50–500 $\mu$m. In case of using a magnetic blade as a doctor blade, the magnetic blade may preferably be disposed with a spacing of 50–400 $\mu$m from the sleeve surface.

The thickness of the toner layer on the sleeve is most suitably smaller than the gap $\alpha$. It is however possible to set the toner layer thickness such that a portion of many ears of magnetic toner can touch the latent image bearing member.

The sleeve is rotated at a peripheral speed of 100–200% of that of the latent image-bearing member. The alternating bias voltage may be at least 0.1 kV, preferably 0.2–3.0 kV, in terms of a peak-to-peak voltage. The frequency may be 1.0–5.0 kHz, preferably 1.0–3.0 kHz, further preferably 1.5–3.0 kHz. The alternating bias voltage waveform may be rectangular, sinusoidal, saw teeth-shaped or triangular. A normal-polarity voltage, a reverse-polarity voltage or an asymmetrical AC bias voltage having different durations may also be used. It is also preferable to superpose a DC bias voltage.

The sleeve may be composed of a metal or a ceramic. preferably of aluminum or stainless steel (SUS) in view of charge-imparting ability. The sleeve can be used in an as-drawn or as-cut state. However, in order to control the toner conveying ability and triboelectric charge-imparting ability, the sleeve may be ground, roughened in a peripheral or longitudinal direction, blasted or coated. In the present invention, it is preferred to use a sleeve blasted with definite-shaped particles and/or indefinite-shaped particles. These particles may be used singly, in mixture or sequentially for blasting.

The indefinite-shaped particles may be arbitrary abrasive particles.

As the definite-shaped particles, it is possible to use, e.g., rigid balls of metals, such as stainless steel, aluminum, steel, nickel and bronze, or of other materials, such as ceramic, plastic and glass, each having a specific particle size. The definite-shaped particles may preferably comprise spherical or spheroidal particles having substantially a curved surface and a longer diameter/shorter diameter ratio of 1–2, preferably 1–1.5, further preferably 1–1.2. More specifically, the definite-shaped particles for blasting the developing sleeve surface may preferably have a (longer) diameter of 20–250 $\mu$m. In case of blasting with both definite-shaped particles and indefinite-shaped particles, the former particles may preferably be larger than the latter, particularly 1–20 times, preferably 1.5–9 times, the latter in diameter.

In the case of effecting the additional blasting with definite-shaped particles, at least one of the blasting time and the blasting force should be smaller than that for the blasting with indefinite-shaped particles.

It is also preferable to use a developing sleeve having a coating layer thereon containing electroconductive fine particles. The electroconductive fine particles may preferably comprise carbon particles, crystalline graphite particles and a mixture thereof.

The crystalline graphite may be either natural graphite or artificial graphite. The artificial graphite may be formed by once calcining pitch coke molded together with tar pitch, etc., at ca. 1,200° C. and heat-treating the calcined product at a high temperature of ca. 2,300° C. in a graphitization furnace to cause crystalline growth of carbon to form graphite. Natural graphite is formed by application of the subterranean heat and high pressure for a long period under the ground and is yielded from the ground. Because of excellent properties, these graphites are industrially used for wide purposes. More specifically, graphite is a dark grayish or black, glossy and very soft crystalline mineral rich in lubricity. Graphite is used for pencil and, because of heat resistance and chemical stability, also used as a lubricant, a fire resistant material, and an electric material in the form of powder, solid or paint. The crystalline structure is hexagonal or rhombohedral and has a complete layer structure. It is an electrically good conductor because of free electrons between carbon-carbon bonds. In the present invention, either natural or artificial graphite may be used.

The graphite used in the present invention may preferably have a particle size in the range of 0.5–1 $\mu$m.

The coating layer is formed by dispersing electroconductive particles into a layer of a polymer, examples of which may include: thermoplastic resins, such as styrene resin, vinyl resin, polyethersulfone resin, polycarbonate resin, polyphenylene oxide resin, polyamide resin, fluorine-containing resin, cellulose resin, and acrylic resin; thermosetting resins, such as epoxy resin, polyester resin, alkyd resin, phenolic resin, melamine resin, polyurethane resin, urea resin, silicone resin, and polyimide resin; and photocurable resin. Among these, it is preferred to use a resin rich in releasability, such as silicone resin or fluorine-containing resin; or a resin excellent in mechanical property, such as polyethersulfone, polycarbonate, polyphenylene oxide, polyamide, phenolic resin, polyester, polyurethane or styrene resin.

Electroconductive amorphous carbon may be defined as a mass of crystallites formed by combination or pyrolysis of a hydrocarbon or a carbon-containing compound in a state where air is insufficient. It is particularly rich in electroconductivity and can be incorporated in a polymer to impart an electroconductivity, thereby providing an arbitrary degree of electroconductivity to some extent by controlling the addition amount, so that it is widely used. In the present invention, it is preferred to use electroconductive amorphous carbon having a particle size in the range of 10–80 $\mu$m, preferably 15–40 $\mu$m.

Figure 6:
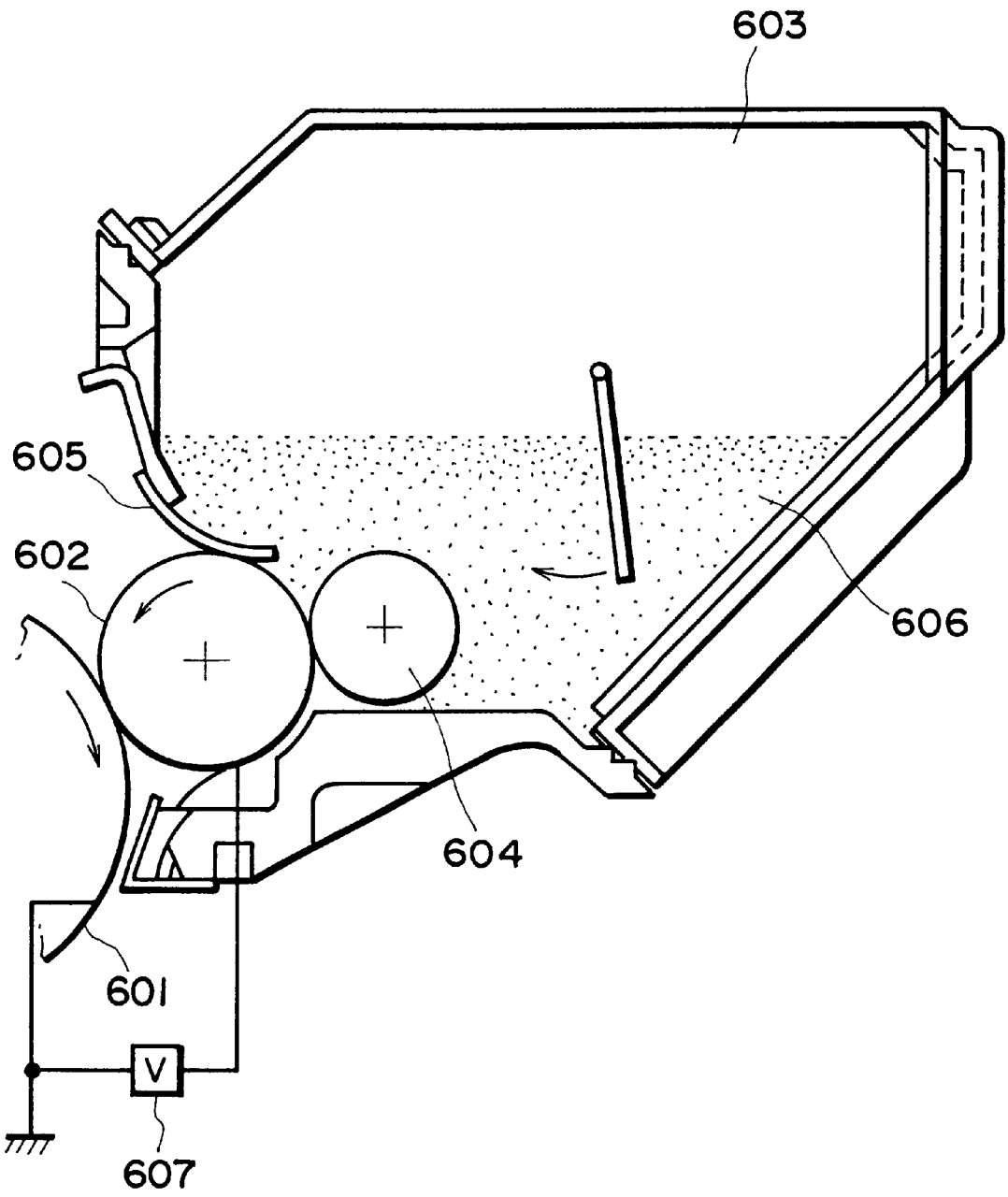
FIGS. 6 and 7 are respectively an illustration of another image forming apparatus including a developing apparatus usable in the image forming method of the present invention.

Next, a non-magnetic monocomponent developing method using the toner or developer according to the present invention will be described for example. This should not be construed as restrictive. FIG. 6 shows a developing apparatus for developing an electrostatic image formed on a latent image-bearing member 601. The electrostatic image may be formed by an electrophotographic means or electrostatic recording means (not shown). The developing apparatus includes a developing sleeve 602 which is a non-magnetic sleeve composed of aluminum or stainless steel.

The developing sleeve can comprise a crude pipe of aluminum or stainless steel as it is. However, the surface thereof may preferably be uniformly roughened by blasting with glass beads, etc., mirror-finished or coated with a resin. The developing sleeve is similar to the one used in the magnetic monocomponent developing method.

Developer 606 is stored in a hopper 603 and supplied to the developing sleeve 602 by a supply roller 604. The supply roller 604 comprises a foam material, such as polyurethane foam and is rotated at a non-zero relative speed with the developing sleeve 602 in a direction identical or reverse to that of the developing sleeve. In addition to the toner supply, the supply roller 604 functions to peel off the developer remaining on the developing sleeve 602 without being used after the development. The developer supplied to the developing sleeve 602 is uniformly applied by a developer-applicator blade 605 to form a thin layer on the sleeve 602.

The abutting pressure between the developer applicator blade and the sleeve may suitably be 3–250 g/cm, preferably 5–120 g/cm, in terms of a linear pressure along the generatrix of the sleeve. Below 3 g/cm, the uniform application of the toner becomes difficult, thus resulting in a broad charge distribution of the toner causing fog or scattering. Above 250 g/cm, an excessively large pressure can be applied to the developer to cause deterioration and agglomeration of the developer, and a large torque is required for driving the sleeve. By controlling the abutting pressure within a range of 3–250 g/cm, the developer according to the present invention can effectively be disintegrated from agglomeration, and the toner can be quickly charged.

The developer applicator blade may preferably be composed of a material having a triboelectric chargeability suitable for charging the toner to a desired. polarity and may be constituted similarly as the one used in the magnetic monocomponent developing method. In the present invention, the blade may suitably be composed of silicone rubber, urethane rubber, styrene-butadiene rubber, etc., and can be coated with polyamide or nylon. Further, an electroconductive rubber can suitably be used to prevent an excessive charge of the toner.

In the toner application system using an applicator blade to form a thin layer of toner on a developing sleeve, it is preferred that the toner layer thickness is set to be smaller than a gap between the developing sleeve 602 and the latent image-bearing member 601, and an alternating electric field is applied across the gap, in order to obtain a sufficient image density. A developing bias voltage of an alternating electric field optionally superposed with a DC electric field may be applied across the gap between the developing sleeve 602 and the latent image-bearing member 601 from a bias voltage supply 607 shown in FIG. 6 so as to promote the movement of the toner from the developing sleeve to the latent image-bearing member, thereby providing a better quality image. These conditions may be similar to those in the magnetic monocomponent developing method.

Figure 7:
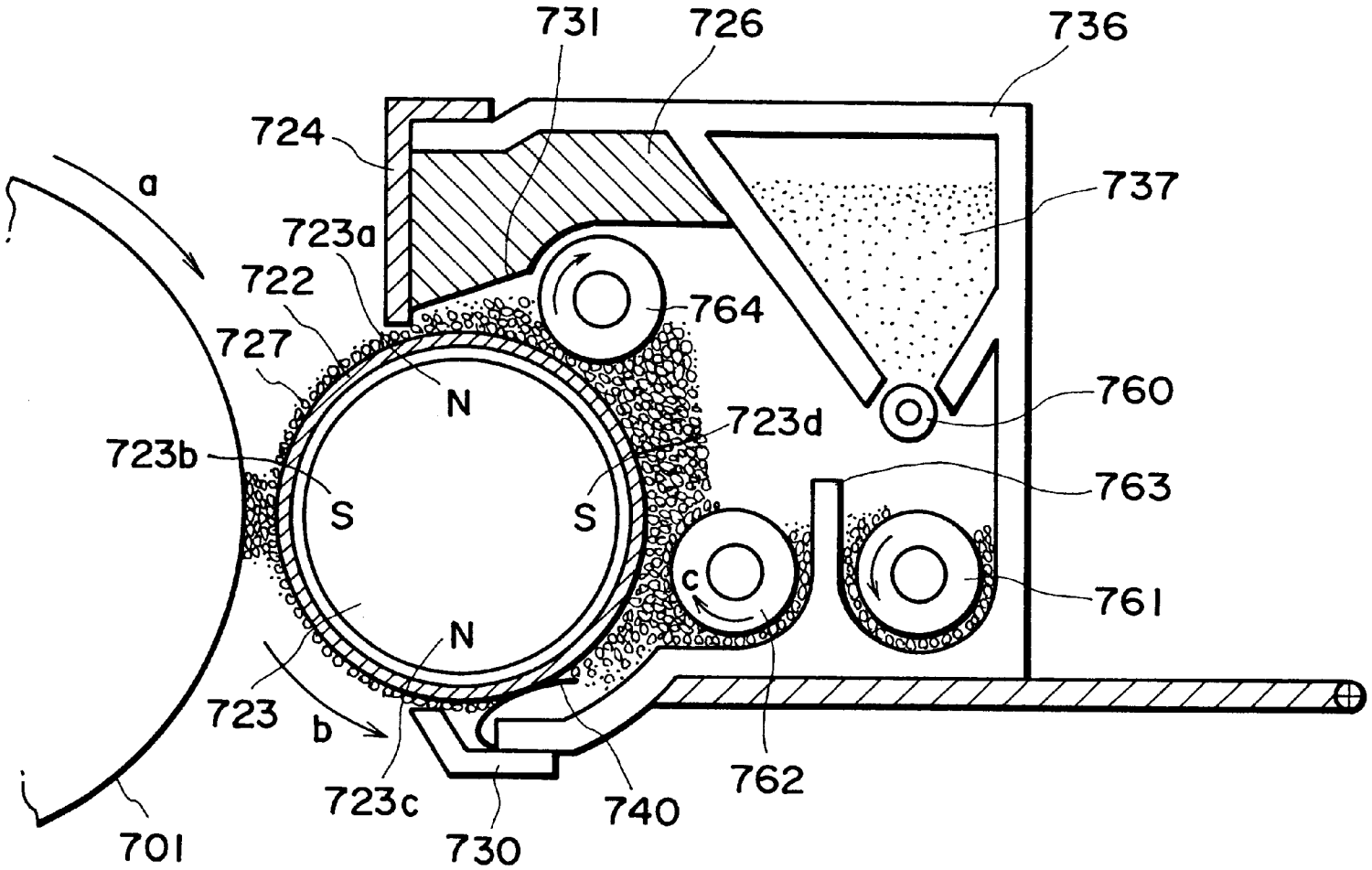

Next, a two-component developing method using the developer according to the present invention will be described with reference to FIG. 7.

A latent image-bearing member 701 may comprise an insulating drum for electrostatic recording, or a photosensitive drum or photosensitive belt having a layer of a photoconductive insulating substance, such as a-Se, CdS, $ZnO_2$, OPC or a-Si. The latent image-bearing member is rotated in the arrow a direction by a drive mechanism (not shown). A developing sleeve 722 is disposed in the vicinity of or in contact with the latent image-bearing member 701 and composed of a non-magnetic material, such as aluminum or SUS 316. The developing sleeve 722 is disposed to project its right half into a laterally extended opening formed at a lower left wall of a developer vessel 736 in a lateral longitudinal direction of the developer vessel. The left half of the developing sleeve 722 is exposed out of the vessel and mounted on a shaft so as to be rotatable in an arrow b direction.

In the developing sleeve 722, a fixed permanent magnet 723 as a fixed magnetic field generating means is disposed at a position as shown. The magnet 723 is fixed in the position as shown while the developing sleeve 722 is rotated. The magnet 723 includes four magnetic poles including N-poles 723*a* and 723*c* and S-poles 723*b* and 723*d*. The magnet 723 can be an electromagnet instead of a permanent magnet.

A non-magnetic blade 724 is disposed along an upper periphery of the opening of the developer vessel 736 where the developing sleeve 722 is disposed so as to be fixed at it support end to the vessel side wall and project its tip toward the inside of the opening than the upper periphery of the opening. The non-magnetic blade may be formed by bending a plate of, e.g., SUS 316 so as to provide an angularly bent cross-section.

A magnetic particle-limiting member 726 is disposed within the developer vessel 736 so that its left surface contacts the right surface of the non-magnetic blade 724 and its lower surface functions as a developer guide surface 731. The non-magnetic blade 724 and the limiting member 726 constitutes a limiting section.

In the developer vessel 736, magnetic particles 727 are placed. The magnetic particles 727 may for example be composed by coating with a resin ferrite particles having a resistivity of at least $10^7$ ohm·cm, preferably at least $10^8$ ohm·cm, and a maximum magnetization of 55–75 emu/g. A toner 737 is stored in a hopper within the developer vessel 736. A sealing member 740 is disposed to seal the toner at a lower part of the vessel 736 and bent along the direction of rotation of the sleeve 722, so as to elastically press the sleeve 722 surface. The sealing member 740 has an end at a downstream side of the sleeve rotation direction in the contact region with the sleeve so as to allow the developer to enter into the developer vessel.

A scattering preventing electrode 730 is disposed to be supplied with a voltage of a polarity identical to the developer so as to guide a free developer generated in the developing step toward the developing sleeve, thereby preventing the scattering of the developer.

A toner supply roller 760 is disposed to operate depending on an output from a toner density detector sensor (not shown). The sensor may be composed based on a developer volume detection scheme, a piezoelectric device, an inductance change detection scheme, an antenna utilizing an alternating bias voltage or an optical density detection scheme. The replenishment of the non-magnetic toner 737 is controlled by rotation and stopping of the roller 760. A fresh developer replenished with the toner 737 is conveyed by a screw 761 while being stirred and mixed. As a result, during the conveyance, the replenished toner is triboelectrically charged. A partition plate 763, has lacks at both longitudinal ends of the developer vessel, where the fresh developer conveyed by the screw 761 is transferred to a screw 762. An S-magnetic pole 723*d* is a conveying pole and functions to recover the developer after the development and convey the developer within the vessel to the limiting section.

In the neighborhood of the pole 723*d*, the fresh developer conveyed by the screw 762 disposed adjacent to the sleeve 722 and the recovered developer are mixed.

A conveying screw 764 is disposed to uniformize the amount of the developer in the developing sleeve axis direction.

A gap of 100–900 μm, preferably 150–800 μm, may be provided between the non-magnetic blade 724 end and the developing sleeve 722 surface. If the distance is smaller than 100 μm, the magnetic particles are plugged thereat to result in an irregularity of developer layer and the developer cannot be applied so as to effect good development, thus resulting in only thin developed images. The gap may preferably be 400 μm or larger in order to prevent ununiform application (so-called blade plugging) with unusable particles present as contamination in the developer. Above 900 μm, the amount of the developer applied onto the developing sleeve is increased to fail in a desired developer layer thickness regulation, and the amount of magnetic particles attached to the latent image-bearing member is increased. Further, the circulation of the developer and the developer limitation by the limiting member 726 are liable to be insufficient to cause an insufficient triboelectric charge of the toner, thus leading to fog.

During the rotation of the sleeve 722 in the arrow b direction, the movement of the magnetic layer is retarded, as it leaves away from the sleeve surface, due to a balance between a constraint by the magnetic force and gravity and the conveying force in the moving direction of the sleeve 722. Some part of magnetic particles can drop due to gravity.

Accordingly, by appropriate selection of the positions of the magnetic poles 723*a* and 723*d* and the fluidity and the magnetic property of the magnetic particles, the magnetic particle layer is conveyed to form a moving layer. Along with the movement of the magnetic particles due to the rotation of the sleeve 722, the toner is conveyed to a developing region and used for development.

The sleeve is rotated at a peripheral speed of 100–300% of that of the latent image-bearing member. The alternating bias voltage may be at least 0.1 kV, preferably 0.2–3.0 kV, in terms of a peak-to-peak voltage. The frequency may be 1.0–5.0 kHz, preferably 1.0–3.0 kHz, further preferably 1.5–3.0 kHz. The alternating bias voltage waveform may be rectangular, sinusoidal saw teeth-shaped or triangular. A normal-polarity voltage, a reverse-polarity voltage or an asymmetrical AC bias voltage having different durations may also be used. It is also preferable to superpose a DC bias voltage.

As the latent image-bearing member, it is preferred to use an amorphous silicon photosensitive member or an organic photosensitive member.

The organic photosensitive member may be of a single layer-type using a single photosensitive layer containing a charge generation substance and a charge transport substance, or of a function separation-type having a charge transport layer and a charge generation layer. In a preferred embodiment, the organic photosensitive member comprises a charge generation layer and a charge transport layer successively on an electroconductive support.

An embodiment of the organic photosensitive member will be described below.

The electroconductive substrate may comprise: a cylinder or a sheet or film of a metal, such as aluminum or stainless steel; a plastic having a coating layer of aluminum alloy, indium tin oxide, etc.; paper or plastic impregnated with electroconductive particles; or a plastic comprising an electroconductive polymer.

The electroconductive substrate may be coated with an undercoating layer for the purpose of providing an improved adhesion of the photosensitive layer, an improved coating characteristic, a protection of the substrate, a coverage of defects on the substrate, an improvement in charge injection from the substrate and a protection of the photosensitive layer from an electrical damage. The undercoating layer may comprise a material, such as polyvinyl alcohol, poly-N-vinylimidazole, polyethylene oxide, ethylcellulose, methylcellulose, nitrocellulose, ethylene-acrylic acid copolymer, polyvinyl butyral, phenolic resin, casein, polyamide, copolymer nylon, glue, gelatin, polyurethane and aluminum oxide. The thickness may be generally 0.1–10 μm, preferably 0.1–3 μm.

The charge generation layer may be formed by dispersing a charge generation substance selected from azo pigments, phthalocyanine pigments, indigo pigments, perylene pigments, polycyclic quinone pigments, squalyryum dyes, pyryllium salts, thiopyllium salts, triphenylmethane dyes, and inorganic substances such as selenium and amorphous silicon, in an appropriate binder resin, followed by application, or vapor deposition of such a charge generation substance. The binder resin may be selected from a wide range inclusive of polycarbonate resin, polyester resin, polyvinylbutyral resin, polystyrene resin, acrylic resin, methacrylic resin, phenolic resin, silicone resin, epoxy resin, and vinyl acetate resin. The binder resin may constitute at most 80 wt. %, preferably 0–40 wt. % of the charge generation layer. The charge generation layer may preferably be formed in a thickness of at most 5 μm, particularly 0.05–2 μm.

The charge transport layer has a function of receiving charge carriers from the charge generation layer under an electric field. The charge transport layer may be formed by applying a charge transport substance dissolved in a solvent optionally together with a binder resin to form a layer in thickness of 5–40 μm, preferably 10–30 μm. Examples of the charge transport substance may include: polycyclic aromatic compounds including a structure such as biphenylene, anthracene, pyrene or phenanthrene, in their main chain or side chain; nitrogen-containing cyclic compounds, such as indole, carbazole, oxadiazole, and pyrazoline; hydrazone compounds, and styryl compounds. The binder resin dispersing such a charge transport substance may comprise, e.g., a resin, such as polycarbonate resin, polyester resin, polymethacrylic acid ester, polystyrene resin, acrylic resin, or polyamide resin; or an organic photoconductive polymer, such as poly-N-vinylcarbazole or polyvinylanthracene.

Among the binder resins, it is particularly preferred to use polycarbonate resin, polyester resin or acrylic resin used in the image forming method according to the present invention because of good cleanability and freeness from cleaning failure, toner sticking and filming of external additive on the photosensitive member. The binder resin may preferably constitute 40–70 wt. % of the charge transport layer.

It is preferred that the outermost layer of the photosensitive member containing a lubricating substance in order to provide improved cleanability and transfer characteristic. The lubricating substance may preferably be a fluorine containing one, particularly a powdery fluorine-containing resin. The effect is enhanced to provide an increased transferability and an remarkable improvement in preventing transfer dropout when combined with the toner according to the present invention.

The powdery fluorine-containing resin may comprise one or more species selected from tetrafluoroethylene resin, trifluorochlorethylene resin, tetrafluoroethylene-hexafluoropropylene resin, vinyl fluoride resin, vinylidene fluoride resin, difluorodichloroethylene resin, and copolymers of these. It is particularly preferred to use tetrafluoroethylene resin or vinylidene fluoride resin. The molecular weight and particle size of the resin may appropriately be selected from commercially available grades. It is particularly preferred to use a one of low-molecular weight grade and having a primary particle size of at most 1 $\mu$m.

The fluorine-containing resin powder constituting the surface layer may appropriately constitute 1–50 wt. %, preferably 2–40 wt. %, more preferably 3–30 wt. %, of the solid matter content in the surface layer. If the content is below 1 wt. %, the surface layer-modifying effect of the fluorine-containing resin becomes insufficient. Above 50 wt. %, the optical transmittance is lowered and the carrier migration can be hindered.

In case where a fluorine-containing resin powder is contained, it is preferred to also add a powder of a fluorine-containing graft polymer in order to provide a good dispersibility in the binder resin of the photosensitive layer.

The fluorine-containing graft polymer used in the present invention may be obtained by copolymerization of an oligomer having a polymerizable functional group at one terminal, and a repetition of a certain recurring unit providing a molecular weight of ca. 1000–10,000 (hereinafter called "macromer") with a polymerizable monomer.

More specifically, the fluorine-containing graft polymer may have a structure of (i) a trunk of a fluorine-containing segment and a branch of non-fluorine-containing segment, as obtained by copolymerization of a non-fluorine-containing macromer synthesized from a non-fluorine-containing polymerizable monomer with a fluorine-containing polymerizable monomer, or (ii) a trunk of a non-fluorine-containing segment and a branch of a fluorine-containing-segment, as obtained by copolymerization of a fluorine-containing macromer synthesized from a fluorine-containing polymerizable monomer with a non-fluorine-containing polymerizable monomer.

As described above, as the fluorine-containing graft polymer comprises a fluorine-containing segment and a non-fluorine-containing segment respectively in a localized form, it can assume a function-separation form such that its fluorine-containing segment is aligned to the fluorine-containing resin powder and its non-fluorine-containing segment is aligned to the binder resin in the photosensitive layer. Particularly, as the fluorine-containing segment is continuously aligned, the fluorine-containing segment can adhere to or be adsorbed by the fluorine-containing resin powder effectively and at a high density. Further, as the non-fluorine-containing segment is aligned to the binder resin, it becomes possible to exhibit a dispersion stability-improving effect for a fluorine-containing resin powder not accomplished by a conventional dispersion aid.

A fluorine-containing resin powder is generally present as agglomerates on the order of several $\mu$m but can be dispersed to its primary particle size of 1 $\mu$m if a fluorine-containing graft polymer is used as the dispersion aid.

In order to effectively utilize the function separation effect to the maximum, it is necessary to adjust the molecular weight of the macromer to ca. 1000–10,000 as mentioned above.

If the molecular weight is below 1000, the segment length is too short so that it shows a reduced adhesion to the fluorine-containing resin powder in case of a fluorine-containing segment or shows a reduced alignment to the surface layer binder resin in case of a non-fluorine-containing segment, whereby the dispersion stability of the fluorine-containing resin powder is impaired anyway.

On the other hand, if the molecular weight is above 10,000, the mutual solubility with the surface layer binder resin may be impaired. This is particularly pronounced in the case of a fluorine-containing segment, and the segment assumes a shrinked coil state in the resin layer, so that the number of its adhesion or adsorption sites to the fluorine-containing resin powder is reduced, thereby impairing the dispersion stability.

The molecular weight of the fluorine-containing graft polymer per se has a large influence and may preferably be in the range of 10,000–100,000. If the molecular weight is below 10,000, the dispersion stabilization effect is insufficient. Above 100,000, the mutual solubility with the surface layer resin is reduced, so that the dispersion stabilization effect is also impaired.

It is preferred that the fluorine-containing segment constitutes 5–90 wt. %, particularly 10–0 wt. %, of the fluorine-containing graft polymer. If the fluorine-containing segment is below 5 wt. %, the dispersion stabilization effect for the fluorine-containing resin powder becomes insufficient and, above 90 wt. %, the mutual solubility with the surface layer resin is impaired.

The fluorine-containing graft polymer may preferably be added in a proportion of 0.1–30 wt. %, particularly 1–20 wt. %, of the fluorine-containing resin powder. If the amount is below 0.1 wt. %, the dispersion stabilization effect for the fluorine-containing resin powder is insufficient and, above 30 wt. %, the fluorine-containing graft polymer is present not only in a state of being adsorbed with the fluorine-containing resin powder but also in an isolated state in the surface layer resin, thus resulting in an accumulation of residual potential on repetition of the electrophotographic cycle.

In order to provide the photosensitive member with a long life, the photosensitive member may preferably have an outermost protective layer and can exhibit a further prolonged life when used in combination with the developer according to the present invention.

The protective layer may preferably comprises one or more species of resins, such as polyester, polycarbonate, acrylic resin, epoxy resin, phenolic resin and phosphazene resin optionally together with their hardener, so as to provide a prescribed hardness. The protective layer may preferably have a thickness of 0.1–6 μm, more preferably 0.5–4 μm in order to obviate an increased residual potential or a lowered sensitivity during continuous image formation because the protective layer is disposed on the photosensitive layer as a layer through which charge does not readily migrate.

The protective layer may be formed by application such as spray coating or beam coating, or by penetration coating by selection of an appropriate solvent.

In order to adjust the electrical resistivity of the protective layer, it is possible to add a charge transport substance as described above or metal oxide particles.

Examples of the metal oxide particles may include: ultra fine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These metal oxides may be used singly or in mixture of two or more species. The two or more species can assume a form of solid solution or a mutually melt-stuck form.

The developer according to the present invention is particularly effective for an organic photosensitive member which is a latent image-bearing member comprising a surface layer of an organic compound, such as a resin.

A surface layer comprising an organic compound is liable to cause an adhesion with the binder resin in the toner. And, if similar materials are used, a chemical bond is liable to occur at a contact point between the toner and the photosensitive member surface, thus being liable to lower the releasability. As a result, there is liable to cause inferior transferability or cleanability, melt-sticking and filming.

The surface of the latent image bearing member may be composed of, e.g., silicone resin, vinylidene chloride resin, ethylene-vinylidene chloride resin, styrene-acrylonitrile copolymer, styrene-methyl methacrylate copolymer, styrene resin, polyethylene terephthalate resin, and polycarbonate resin. These are not exhaustive however, but it is also possible to use copolymers of these resins with another monomer or other blends. Particularly, polycarbonate resin is effective for an image forming apparatus including a photosensitive member in the form of a photosensitive drum having a diameter of at most 50 mm, particularly at most 40 mm, e.g., 25–35 mm. If the surface layer contains a lubricating substance or is provided with a protective layer, a further increased effect can be attained.

This is because, in the case of a photosensitive drum having a small diameter, an identical linear pressure can cause a larger pressure concentration at an abutting portion because of a small curvature radius. A similar phenomenon is expected in the case of a belt form photosensitive member, and the developer according to the present invention is also effective for an image forming apparatus equipped with a belt-form photosensitive member providing a curvature radius of at most 25 mm at the transfer section.

The cleaning may preferably be performed by a blade-cleaning scheme, wherein a blade of urethane rubber, silicone rubber or an elastic resin or a blade of a metal, etc., having a resin tip, is abutted against a photosensitive member in a direction normal or reverse with respect to the photosensitive member moving direction. The blade may preferably be abutted in a direction reverse with respect to the photosensitive member moving direction. The blade may preferably be abutted against the photosensitive member at a linear pressure of at least 5 g/cm, more preferably 10–50 g/cm. The blade cleaning can be combined with the magnetic brush cleaning method, the fur brush cleaning method, or the roller cleaning method.

The toner according to the present invention is excellent in releasability and lubricity in addition to an appropriate degree of friction, so that the toner can be cleaned well by the blade cleaning while preventing the damage or abrasion of the photosensitive member even by abutting the blade. On the other hand, the toner is not liable to cause melt-sticking or filming.

In the image forming method using the toner according to the present invention, the charging step and transfer step can be performed either by using a corona charger which does not contact the photosensitive member or by using a contact charger, such as a roller charger. In view of effective uniform charging, simplicity and low ozone-generating characteristic, a contact-type may preferably be used. The toner according to the present invention shows particularly good performances when used in a system using a contact-type charger.

The toner image formed on the electrostatic image-bearing member may be transferred onto a transfer material, such as paper or a plastic film, either directly or via an intermediate transfer material.

Figure 8:
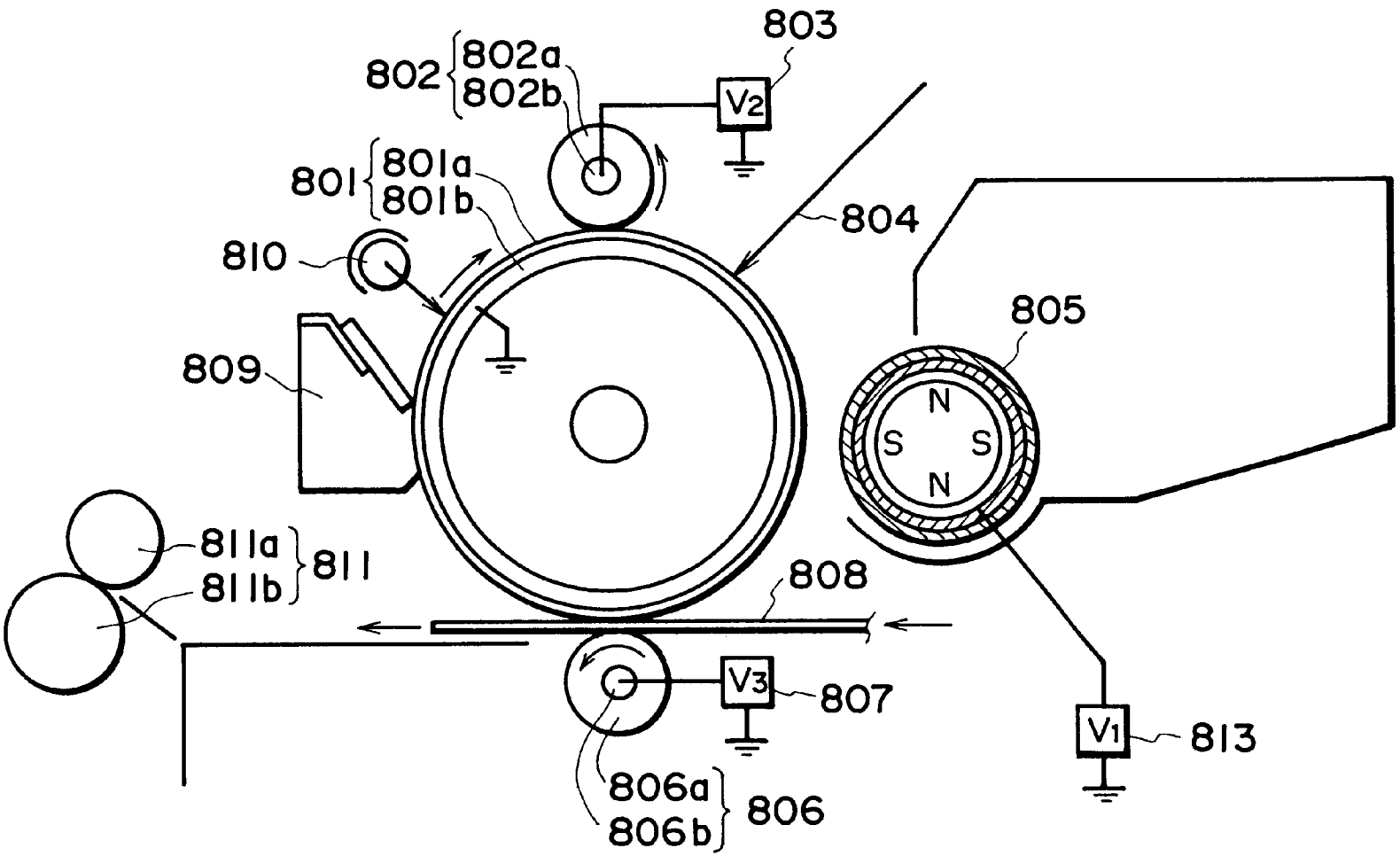
FIG. 8 is a view for illustrating an image forming method according to the present invention.

An example of the image forming system including such contact-type changing and transfer scheme will now be described with reference to FIG. 8.

The system includes an electrostatic image-bearing member 801 in the form of a rotatable drum (photosensitive member). The photosensitive member 801 basically comprises an electroconductive substrate 801*b* and a photoconductor layer 801*a* on its outer surface, and rotates in a clockwise direction in an as-shown state at a prescribed speed (process speed).

A charging roller 802 basically comprises a core metal 802*b* and an electroconductive elastic layer 802*a* disposed to surround the outer surface of the core metal. The charging roller 802 is pressed against the photosensitive member 801 surface and rotated following the rotation of the photosensitive member 801. A charging bias voltage supply 803 is disposed to apply a voltage $V_2$ to the charging roller 802. Thus, the charging roller 802 is supplied with the bias voltage to charge the surface of the photosensitive member to a prescribed potential of a prescribed polarity. Then, an electrostatic image is formed on the photosensitive member 801 by exposure to image light 804 and visualized as a toner image by a developing means 805.

A developing sleeve constituting the developing means 805 is supplied with a bias voltage $V_1$ by a bias voltage supply 813. The toner image formed by development on the photosensitive member 801 is electrostatically transferred to a transfer material 808 by a contact transfer means 806, and the transferred toner image is fixed under heating and pressure onto the transfer material 808 by a heat and pressure application means 811. The contact transfer means 806 is supplied with a transfer bias voltage $V_3$ from a supply 807.

In the image forming apparatus using contact charging and contact transfer schemes, the uniform charging of a photosensitive member and sufficient toner image transfer can be effected at a relatively low bias voltage, compared with the corona charging and corona transfer scheme. This is advantageous in size-reduction of a charger per se and also preventing the formation of corona discharge products, such as ozone.

Other contact charging and transfer means include those using a charging blade and an electroconductive brush.

While these contact charging means have advantages of unnecessity of high voltage and reduction of ozone generation, they are liable to cause a difficulty of toner melt-sticking as the charging member directly contacts the photosensitive member. The toner or developer according to the present invention is most advantageously used to obviate the difficulty when used in combination with such a contact charging means regardless of how the contact charging means works.

The charging roller may preferably be abutted at a pressure of 5–500 g/cm, and supplied with an AC-superposed DC voltage including an AC voltage of 0.5–5 kV, an AC frequency of 50 Hz to 5 kHz and a DC voltage of ±0.2–±1.5 kV, or with a DC voltage of ±0.2–±5 kV.

The charging roller and charging blade may preferably comprise an electroconductive rubber, optionally coated with a releasable film, which may for example comprise a nylon resin, PVDF (polyvinylidene fluoride) or PVDC (polyvinylidene chloride).

Referring again to FIG. 8, a transfer roller 806 basically comprise a central core metal 806*b* and an electroconductive elastic layer 806*a* covering the core metal 806*b*. The transfer roller 806 is pressed against the photosensitive member 801 via a transfer material 808 and is rotated at a peripheral speed which is identical to or different from that of the photosensitive member 801. The transfer material 808 is conveyed between the photosensitive member 801 and the transfer roller 806 while a bias voltage polarity opposite to that of the toner is applied to the transfer roller 806 from a transfer bias voltage supply 807, whereby the toner image on the photosensitive member 801 is transferred onto the front side of the transfer material 808.

The transfer roller 808 may be composed of similar materials as the charging roller 802 and may preferably be operated at an abutting pressure of 5–500 g/cm under application of a DC voltage of ±0.2–±10 kV.

Then, the transfer material 808 carrying a toner image is conveyed to a fixing device 811 which basically comprises a heating roller 811*a* enclosing a halogen heater and an elastic pressure roller 811*b* pressed against the roller 811*a*, and the toner image is fixed onto the transfer material 808 while being passed between the rollers 811*a* and 811*b*.

The fixing may also be performed by a system of heating the toner image via a film or by pressure application if the developer is constituted to be suitable therefor.

The residual toner or other soiling substance remaining on the photosensitive member 801 after the toner image transfer is removed by a cleaning device 809 including a cleaning blade pressed against the photosensitive member in a counter direction. The photosensitive member 801 is thereafter charge-removed by an exposure means 810 for charge removal, and then subjected to a new image formation cycle starting with charging.

Figure 9:
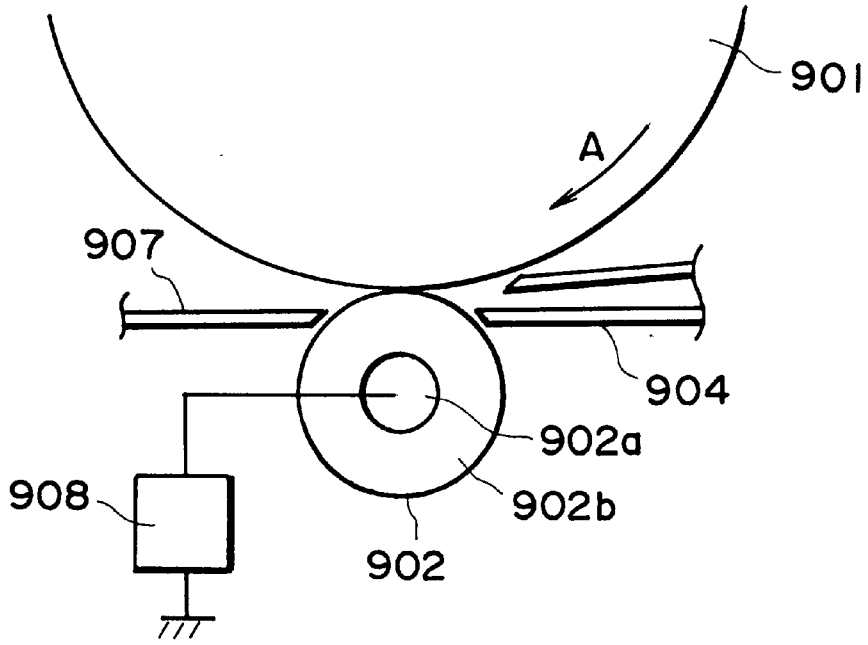
FIGS. 9 and 10 are respectively a view for illustrating a transfer step.

The transfer roller 806 may have a structure as shown as a transfer roller 801 in FIG. 9. Other contact transfer means may include a transfer belt as shown in FIG. 10 and a transfer drum.

FIG. 9 is an enlarged side view of a transfer roller in combination with a latent image-bearing member (photosensitive member) in an image forming apparatus. Referring to FIG. 9, the image forming apparatus includes a cylindrical photosensitive member 901 extending in a direction perpendicular to the drawing and rotating in an arrow A direction, and an electroconductive transfer roller 902 abutted to the photosensitive member 901. In FIG. 9, 904 denotes a transfer material conveying guide, and 907 denotes a transfer material conveying support member.

The transfer roller 902 comprises a core metal 902*a* and an electroconductive elastic layer 902*b*. The electroconductive elastic layer 902*b* comprises an elastic material, such as urethane elastomer or ethylene-propylene-diene terpolymer (EPDM) and an electroconductive material, such as carbon, dispersed therein, so as to provide a volume resistivity of $10^6$–$10^{10}$ ohm·cm. The core metal 902*a* is supplied with a bias voltage of preferably ±0.2–±10 kV, from a constant voltage supply 908.

Figure 10:
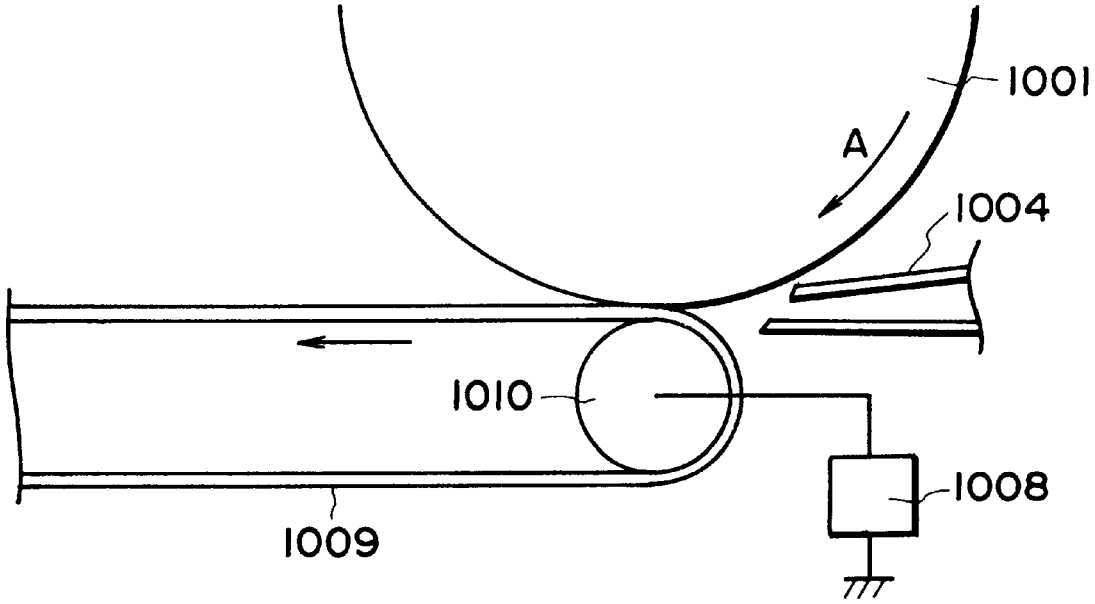

FIG. 10 is a similar illustration including a transfer belt 1009. The transfer belt 1009 is supported around and driven by an electroconductive roller 1010. A transfer pressure may be applied, e.g., by applying a pressure to the end bearing for the core metal 902*a* or 1010. In FIG. 10, 1004 denotes a transfer material conveying guide, and 1008 denotes a voltage supply.

The charger (transfer roller or belt) may preferably be abutted against the photosensitive member 901 (or 1001) at a linear pressure of at least 1 g/cm, preferably 1–300 g/cm, particularly preferably 3–100 g/cm.

The linear pressure (g/cm) may be given by dividing the total force (g) applied to the transfer member (roller or belt) by the abutted length (cm).

If the abutting pressure is below 1 g/cm, a transfer failure is liable to occur due to a conveyance deviation of the transfer material and an insufficient transfer current. The toner according to the present invention is particularly effective in providing a good transferability and preventing transfer failure in a system wherein the transfer roller and the photosensitive member rotate at an identical speed.

In case of using a charging roller or a charging blade, the toner according to the present invention rich in releasability and lubricity, is not liable to soil these members or result in abnormal images due to charging irregularity. Even if the toner is attached, it is readily liberated, so that the damage or excessive abrasion of the photosensitive member can be avoided.

The toner is also excellent in releasability from the photosensitive member, so that it provides a good transferability and an increased transfer efficiency while preventing transfer dropout. It exhibits particularly remarkable effects in a contact transfer system using a transfer roller, a transfer belt, a transfer drum, etc.

As t he transferability is excellent, good transfer is accomplished even at a small transfer current or a small transfer pressure, so that the photosensitive member is less damaged and provided with a longer life.

A part of the liquid lubricant can be transferred from the toner to the photosensitive member and the charging member to increase the releasability of the photosensitive member per se, thereby further increasing the transferability and cleanability. The releasability of the charging member is also increased, and the charging member is less liable to be soiled.

In the present invention, toner particles are made less attachable directly to the contact charging member surface, the contact transfer member surface and the photosensitive member surface, and also the releasability of the toner particles with respect to those surfaces is improved to prevent the sticking of the toner per se. Further, even if the toner particles are attached to the contact charging member surface, the contact transfer member surface and the photosensitive member surface, the toner particles are always moved on or among these members because of the lubricity and releasability of the toner particles and do not remain at the same position, so that toner particles are prevented from sticking. Further, when a cleaning member is abutted to the contact charging member and the contact transfer member, the toner particles attached to these members can be easily removed with an increased cleanability because of the releasability.

Further, the liquid lubricant is slightly transferred also to the cleaning member, thereby increasing the cleaning performance of the cleaning member.

The toner or developer according to the present invention is fixed under heating onto a transfer material such as plain paper or a transparent sheet for an overhead projector (OHP) by a contact heating means in the case of heat fixation.

The contact heating means may for example be a hot-pressure roller fixation apparatus or a hot fixation device including a fixed heating member and a pressing member disposed opposite to the heating member so as to be pressed toward the heating member and cause a transfer material to contact the heating member via a film.

Figure 11:
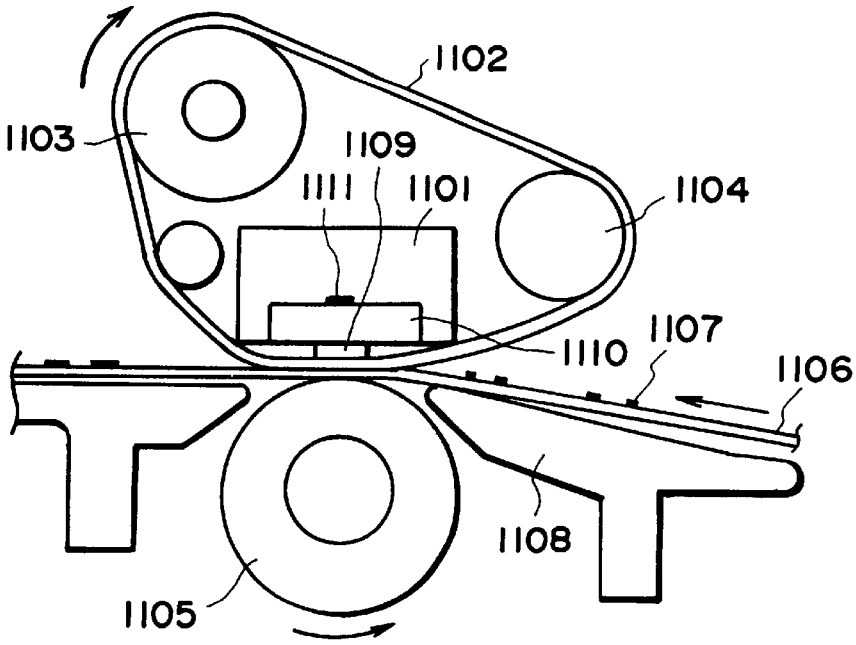
FIG. 11 is a schematic illustration of an embodiment of the fixing apparatus usable in the image forming method according to the present invention.

An embodiment of the fixing device is illustrated in FIG. 11.

Referring to FIG. 11, the fixing device includes a heating member which has a heat capacity smaller than that of a conventional hot roller and has a linear heating part exhibiting a maximum temperature of preferably 100–300° C.

The film disposed between the heating member and the pressing member may preferably comprise a heat-resistant sheet having a thickness of 1–100 μm. The heat-resistant sheet may comprise a sheet of a heat-resistant polymer, such as polyester, PET (polyethylene terephthalate), PFA (tetrafluoroethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The film may preferably have a release layer and/or a low resistivity layer on such a heat-resistant sheet.

An embodiment of the fixing device will be described with reference to FIG. 11.

The device includes a low-heat capacity linear heating member 1101, which may for example comprise an aluminum substrate 1110 of 1.0 mm-t×10 mm-W×250 mm-L, and a resistance material 1109 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 1111. The pulse width may range from ca. 0.5 msec to 5 msec. In contact with the heating member 1101 thus controlled with respect to the energy and temperature, a fixing film 1102 is moved in the direction of an indicated arrow.

The fixing film 1102 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm, preferably less than 40 μm. The film is driven in the arrow direction under tension between a drive roller 1103 and a mating roller 1104.

The fixing device further includes a pressure roller 1105 having a releasable elastomer layer of, e.g., silicone rubber and pressed against the heating member 1101 via the film at a total pressure of 4–20 kg, while moving together with the film in contact therewith. A transfer material 1106 carrying an unfixed toner image 1107 is guided along an inlet guide 1108 to the fixing station to obtain a fixed image by the heating described above.

The above-described embodiment includes a fixing film in the form of an endless belt but the film can also be an elongated sheet driven between a sheet supply axis and a sheet winding axis.

In the above described fixing system, the heating member has a rigid flat surface so that the transfer material at the fixing nip is pressed in a flat state by the pressure roller to fix the toner image thereon. Further, because of the structure, the gap between the fixing film and the transfer material is narrowed immediately before the transfer material enters the nip, so that air between the fixing film and the transfer material is pushed out toward the rear direction.

Under such state, if a transfer material line enters in the longitudinal direction of the heating member, air is pushed out toward the line. In this instance, if the toner image is put lightly on the line, the pushed air goes out toward the rear side while scattering the developer particles therewith.

Particularly, when the transfer paper is not so smooth or is wet, the transfer electric field is weakened and the toner image is only weakly pulled toward the transfer paper. In such a case, the above-mentioned scattering of the toner image is liable to occur. Further, in case of a large process speed, the scattering becomes noticeable because of an increased air pressure.

As the developer according to the present invention has the liquid lubricant at the toner particle surfaces, the developer is liable to be induced and is strongly pulled toward the transfer material, so that the tight developer image is formed by static agglomeration and the above-mentioned scattering can be alleviated.

The toner or the developer according to the present invention is provided with a rather higher charge through triboelectrification, so that the developer on the latent image bearing member is also provided with a high charge and the developer image is more strongly transferred toward the transfer material under a transfer electric field. This is also advantageous in alleviating the scattering.

Hereinbelow, the present invention will be described based on specific Examples to which, however, the present invention should not be construed to be limited. First, specific colorant and magnetic powder used for carrying a liquid lubricant will be described.

Production Examples of Processed Magnetic Powder Carrying Liquid Lubricant 10 kg of magnetite powder and a prescribed amount (shown in Table 1) of liquid lubricant were placed in a SHIMPSON MIX-MALLER ("MPUV-2", mfd. by Matsumoto Chuzo K.K.) and processed for 30 min. therein to have the magnetite powder carry a liquid lubricant. The product was disintegrated by a hammer mill. The properties of the magnetite powder and processed magnetite powder and liquid lubricants used are summarized in the following Table 1.

TABLE 1

| Processed magnetic powder | Unprocessed magnetic powder: Species: Magnetite | Particle shape | Dav.*1 (μm) | σs (emu/g) | σr (emu/g) | BET ($m^2$/g) | Si content (wt. %) | Processed magnetic powder carrying a liquid lubricant: Liquid lubricant (*3) and viscosity (25° C.) | | Carried amount (g) | Oil *2 absorption (cc/100 g) | ρa (g/$cm^3$) |
|---|---|---|---|---|---|---|---|---|---|---|---|---|
| 1 | 1 | octahedral | 0.18 | 81.2 | 1.6 | 8.3 | 0.47 | DMS | 1000 cSt | 100 | 23.2 | 0.39 |
| 2 | 2 | octahedral | 0.14 | 80.1 | 12.8 | 9.7 | 0.71 | PTFE | 100 cSt | 80 | 22.1 | 0.42 |
| 3 | 3 | octahedral | 0.24 | 84.5 | 10.9 | 7.6 | 0.39 | DMSF | 450 cSt | 120 | 24.4 | 0.51 |
| 4 | 4 | hexahedral | 0.17 | 87.1 | 7.8 | 6.3 | 0.56 | DMS | 500 cSt | 100 | 21.2 | 0.38 |
| 5 | 5 | hexahedral | 0.23 | 84.7 | 9.1 | 7.1 | 0.45 | DMS | 300 cSt | 150 | 20.7 | 0.55 |
| 6 | 6 | octahedral | 0.31 | 82.8 | 9.8 | 6.1 | 0.29 | DMS | 100 cSt | 200 | 21.9 | 0.62 |
| 7 | 7 | octahedral | 0.21 | 83.3 | 10.5 | 7.2 | 0.17 | DMS | 300 cSt | 150 | 22.3 | 0.41 |
| 8 | 8 | spherical (polyhedral) | 0.19 | 83.6 | 3.8 | 12.4 | 0.88 | DMS | 1000 cSt | 250 | 19.6 | 0.65 |

*1: Dav. = average particle size
*2: The value means that the magnetic powder retained an oil absorbing power even after the processing.
*3: DMS = dimethylsilicone, PTFE = polytetrafluoroethylene, DMSF = dimethylsilicone having trifluoropropyl group.

Production Example of Processed Colorant 1 and 2 Carrying Liquid Lubricant (Processed Colorant-1)

2 kg of carbon black and 1 kg of triphenylmethane compound-i of the following formula:

Triphenylmethane Compound-1

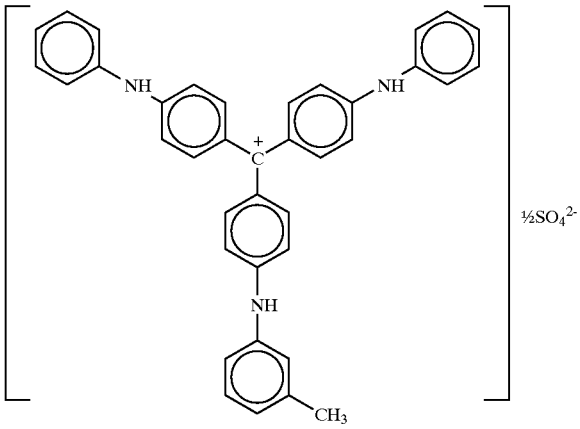

and also 0.5 kg of dimethylsilicone (1000 cst) were placed in the SHIMPSON MIX-MALLER and processed for 30 min., followed by disintegration by a hammer mill to obtain Processed colorant-1 (carrying a liquid lubricant).

(Processed Colorant-2)

2.25 kg of copper phthalocyanine and 0.25 kg of the triphenylmethane compound 1 and also 0.5 kg of dimethylsilicone (1000 cSt) were placed in the SHIMPSON MIX-MALLER and processed for 30 min., followed by disintegration by a hammer mill to obtain Processed colorant-2.

Synthesis Examples of Binder Resins

The binder resins were synthesized in the following manner.

(Synthesis Example 1)

| | |
|---|---|
| Styrene | 80 wt. part(s) |
| Butyl acrylate | 20 wt. part(s) |

-continued

| | |
|---|---|
| 2,2-Bis(4,4-di-t-butylperoxy-cyclohexyl)propane | 0.2 wt. part(s) |

Polymer A was prepared by suspension polymerization of the above ingredients.

| | |
|---|---|
| Styrene | 82 wt. part(s) |
| Butyl acrylate | 18 wt. part(s) |
| Di-t-butyl peroxide | 2.0 wt. part(s) |

Polymer B was prepared from the above ingredients by solution polymerization in xylene as the solvent. Polymer A and Polymer B were mixed in solution in a weight ratio of 30:70 to obtain a styrene-based Binder resin-1.

Binder resin-1 showed Mn=7,200, Mw=283,000 and Tg=60° C.

(Synthesis Example 2)

| | |
|---|---|
| Terephthalic acid | 17 mol. % |
| n-Dodecenylsuccinic acid | 23 mol. % |
| Trimellitic anhydride | 8 mol. % |
| Bisphenol A-propylene oxide 2.2 mol adduct | 52 mol. % |

The above ingredients were subjected to condensation polymerization in the presence of tin oxide as the catalyst to obtain a polyester resin (called Binder resin-2) having Mn=5,200, Mw=41,000 and Tg=60° C.

Solid Wax and Inorganic Fine Powder Solid waxes and Inorganic fine powder having properties shown in the following Tables 2 and 3, respectively, were used for toner production as will be described hereinafter.

TABLE 2

| Solid wax | Composition | DSC Onset (° C.) | DSC Peak (° C.) | GC Peak intensity change | GC Main peak | GPC Mn | GPC Mw | GPC Mw/Mn | Density (g/cm³) | Penel |
|---|---|---|---|---|---|---|---|---|---|---|
| 1 | hydrocarbon | 88 | 101 | every methylene continuous | C61 | 980 | 1260 | 1.28 | 0.95 | 0.5 |
| 2 | hydrocarbon | 89 | 102 | every two other methylene | C58 | 860 | 1070 | 1.24 | 0.96 | 2.0 |
| 3 | hydrocarbon | 91 | 101 | every other methylene (strong & weak) | C68 | 910 | 1430 | 1.57 | 0.96 | 1.0 |
| 4 | alcohol | 64 | 98 | every two other methylene | C48 | 450 | 940 | 1.87 | 0.99 | 1.5 |

TABLE 3

| No. | Base | Treating agent | BET*1 area ($m^2/g$) | Hydro-*2 phobity (%) |
|---|---|---|---|---|
| | | Inorganic fine powder | | |
| 1 | silica | amino-modified silicone oil | 90 | 65 |
| 2 | silica | dimethylsilicone oil | 120 | 70 |
| 3 | silica | hexamethyldisilazane | 230 | 65 |
| 4 | titania | dimethyldichlorosilane & dimethylsilicone oil | 50 | 70 |

*1BET specific area after the hydrophobicity-imparting treatment.
*2According to the methanol titration test.

Production Examples of Toners and Developers

Toner-1 and Developer-1 (Invention)

| | |
|---|---|
| Binder resin-1 | 100 wt. parts |
| Processed magnetic powder-1 | 80 wt. parts |
| Triphenylmethane compound-1 | 2 wt. parts |
| Solid wax-1 | 4 wt. parts |

The above ingredients were pre-blended in a HENSCHEL mixer and then melt-kneaded through a twin-screw extruder set at 130° C. After cooling, the kneaded product was finely pulverized by a jet pulverizer and classified by a pneumatic classifier to obtain Toner-1 (invention) having a weight-average particle size of 8 μm. Toner-1 was then left standing in an environment of 40° C. for 1 day. To 100 wt. parts of Toner-1, 0.8 wt. part of Inorganic fine powder-1 was externally added and blended in a HENSCHEL mixer to obtain Developer-1 (invention).

As a result of GPC measurement, Developer-1 showed peaks at 13,200 and 580,000 and contained 75% of component in a molecular weight region of at most 100,000.

As a result of the fluorescent X-ray analysis, Toner-1 showed a silicon content (excluding the amount derived from the magnetic material) of 0.15 wt. %, which was almost identical to the theoretical value (0.16 wt. %). The silicon content ratio with that in the classified fine powder portion was 1.0032, thus showing a very good dispersion state. Toner-1 (and therefore Developer-1) contained silicone oil as the liquid lubricant, whereby it was confirmed that the liquid lubricant was uniformly contained in the toner particles.

Further, as a result of ESCA (electron spectroscopy for chemical analysis), Toner-1 showed a silicon atom concentration (originated from silicone) and a carbon atom concentration, giving a ratio therebetween at the toner particle surface of 0.017 compared with a theoretical value of 0.0014 based on the assumption of uniform distribution of silicon. This means that silicon was present preferentially at the surface, i.e., the silicone oil as the liquid lubricant was preferentially present at the toner particle surface.

Toner-2 and Developer-2 (Comparative)

| | |
|---|---|
| Binder resin-1 | 100 wt. part(s) |
| Magnetic powder (untreated magnetite-1) | 80 wt. part(s) |
| Triphenylmethane compound-1 | 2 wt. part(s) |
| Solid wax-1 | 4 wt. part(s) |
| Dimethylsilicone (1000 cSt) | 0.8 wt. part(s) |

Toner-2 (comparative) having a weight-average particle size of 8 μm was prepared in the same manner as Toner-1 except for the use of the above ingredients. Toner-2 was then left standing in an environment of 40° C. for 1 day. To 100 wt. parts of Toner-2, 0.8 wt. part of Inorganic fine powder-1 was externally added and blended in a HENSCHEL mixer to obtain Developer-2 (comparative).

As a result of GPC measurement, Developer-2 showed peaks at 13,300 and 590,000 and contained 74% of component in a molecular weight region of at most 100,000.

As a result of the fluorescent X-ray analysis, Toner-2 showed a ratio of a silicon content (excluding the amount derived from the magnetic material) with that in the classified fine powder portion was 1.1614, thus showing a larger content in the classified fine powder.

From the above, it is recognized that the direct mixing of the liquid lubricant with the other starting ingredients caused an ununiform dispersion. Further, as a result of ESCA, Toner-2 showed a silicon/carbon atom ratio at the toner particle surface of 0.041 which indicates further localization of the silicon at the toner particle surface than in Toner-1.

Toner-3 and Developer-3 (Comparative)

| | |
|---|---|
| Binder resin-1 | 100 wt. part(s) |
| Magnetic powder (untreated magnetite-1) | 80 wt. part(s) |
| Triphenylmethane compound-1 | 2 wt. part(s) |
| Solid wax-1 | 4 wt. part(s) |

Toner-3 (comparative) having a weight-average particle size of 8 μm was prepared in the same manner as Toner-1 except for the use of the above ingredients. Toner-3 was then left standing in an environment of 40° C. for 1 day. To 100 wt. parts of Toner-3, 0.8 wt. part of Inorganic fine powder-1 was externally added and blended in a HENSCHEL mixer to obtain Developer-3 (comparative).

As a result of GPC measurement, Developer-3 showed peaks at 13,100 and 570,000 and contained 76% of component in a molecular weight region of at most 100,000.

Toner-4 and Developer-4 (Invention)

| | |
|---|---|
| Binder resin-1 | 100 wt. part(s) |
| Processed magnetic powder-2 | 80 wt. part(s) |
| Triphenylmethane compound-1 | 2 wt. part(s) |
| Solid wax-1 | 4 wt. part(s) |

Toner-4 (invention) having a weight-average particle size of 8 μm was prepared in the same manner as Toner-1 except for the use of the above ingredients. Toner-4 was then left standing in an environment of 40° C. for 1 day. To 100 wt. parts of Toner-4, 0.8 wt. part of Inorganic fine powder-1 was externally added and blended in a HENSCHEL mixer to obtain Developer-4 (invention).

As a result of GPC measurement, Developer-4 showed peaks at 13,000 and 580,000 and contained 75% of component in a molecular weight region of at most 100,000.

Toner-5 and Developer-5 (Invention)

| | |
|---|---|
| Binder resin-1 | 100 wt. part(s) |
| Processed magnetic powder-3 | 80 wt. part(s) |
| Triphenylmethane compound-1 | 2 wt. part(s) |
| solid wax-1 | 4 wt. part(s) |

Toner-5 (invention) having a weight-average particle size of 8 μm was prepared in the same manner as Toner-1 except for the use of the above ingredients. Toner-5 was then left standing in an environment of 40° C. for 1 day. To 100 wt. parts of Toner-5, 0.8 wt. part of Inorganic fine powder-1 was externally added and blended in a HENSCHEL mixer to obtain Developer-5 (invention).

As a result of GPC measurement, Developer-5 showed peaks at 13,100 and 590,000 and contained 76% of component in a molecular weight region of at most 100,000.

Toner-6 and Developer-6 (Invention)

| | |
|---|---|
| Binder resin-1 | 100 wt. part(s) |
| Processed magnetic powder-4 | 80 wt. part(s) |
| Triphenylmethane compound-1 | 2 wt. part(s) |
| Solid wax-2 | 4 wt. part(s) |

Toner-6 (invention) having a weight-average particle size of 8 μm was prepared in the same manner as Toner-1 except for the use of the above ingredients. Toner-6 was then left standing in an environment of 40° C. for 1 day. To 100 wt. parts of Toner-6, 0.8 wt. part of Inorganic fine powder-1 was externally added and blended in a HENSCHEL mixer to obtain Developer-6 (invention).

As a result of GPC measurement, Developer-6 showed peaks at 13,200 and 570,000 and contained 75% of component in a molecular weight region of at most 100,000.

Toner-7 and Developer-7 (Invention)

| | |
|---|---|
| Binder resin-1 | 100 wt. part(s) |
| Processed magnetic powder-5 | 80 wt. part(s) |
| Monoazo iron complex-1 (of the formula shown below) | 2 wt. part(s) |
| Solid wax-3 | 4 wt. part(s) |

Toner-7 (invention) having a weight-average particle size of 8 μm was prepared in the same manner as Toner-1 except for the use of the above ingredients. Toner-7 was then left standing in an environment of 40° C. for 1 day. To 100 wt. parts of Toner-7, 0.8 wt. part of Inorganic fine powder-2 was externally added and blended in a HENSCHEL mixer to obtain Developer-7 (invention).

As a result of GPC measurement, Developer-7 showed peaks at 13,200 and 590,000 and contained 75% of component in a molecular weight region of at most 100,000.

Monoazo Iron Complex-1

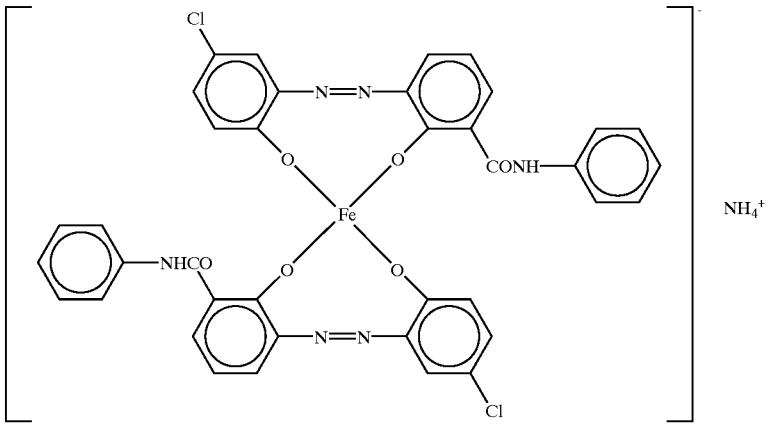

Toner-8 and Developer-8 (Invention)

| | |
|---|---|
| Binder resin-2 | 100 wt. part(s) |
| Processed magnetic powder-6 | 80 wt. part(s) |
| Monoazo iron complex-1 | 2 wt. part(s) |
| Solid wax-4 | 4 wt. part(s) |

Toner-8 (invention) having a weight-average particle size of 8 μm was prepared in the same manner as Toner-1 except for the use of the above ingredients. Toner-8 was then left standing in an environment of 40° C. for 1 day. To 100 wt. parts of Toner-8, 0.8 wt. part of Inorganic fine powder-3 was externally added and blended in a HENSCHEL mixer to obtain Developer-8 (invention).

As a result of GPC measurement, Developer-8 showed a peak at 5,200 and a shoulder at 30,000, contained 13% of component in a molecular weight region of at most 100,000, and showed an Mw/Mn ratio of 25.

Toner-9 and Developer-9 (Invention)

| | |
|---|---|
| Binder resin-1 | 100 wt. part(s) |
| Processed magnetic powder-7 | 100 wt. part(s) |
| Monoazo iron complex-1 | 2 wt. part(s) |
| Solid wax-4 | 4 wt. part(s) |

Toner-9 (invention) having a weight-average particle size of 8 μm was prepared in the same manner as Toner-1 except for the use of the above ingredients. Toner-9 was then left standing in an environment of 40° C. for 1 day. To 100 wt. parts of Toner-9, 1.0 wt. part of Inorganic fine powder-2 was externally added and blended in a HENSCHEL mixer to obtain Developer-9 (invention).

As a result of GPC measurement, Developer-9 showed peaks at 13,300 and 590,000 and contained 73% of component in a molecular weight region of at most 100,000.

Toner-10 and Developer-10 (Invention)

| | |
|---|---|
| Binder resin-2 | 100 wt. part(s) |
| Processed magnetic powder-8 | 100 wt. part(s) |
| Monoazo iron complex-1 | 2 wt. part(s) |
| Solid wax-1 | 4 wt. part(s) |

Toner-10 (invention) having a weight-average particle size of 6 μm was prepared in the same manner as Toner-1 except for the use of the above ingredients. Toner-10 was then left standing in an environment of 40° C. for 1 day. To 100 wt. parts of Toner-10, 1.5 wt. parts of Inorganic fine powder-4 was externally added and blended in a HENSCHEL mixer to obtain Developer-10 (invention).

As a result of GPC measurement, Developer-10 showed a peak at 5,100 and a shoulder at 29,000, contained 12% of component in a molecular weight region of at most 100,000, and showed an Mw/Mn ratio of 24.

Toner-11 and Developer-11 (Invention)

| | |
|---|---|
| Binder resin-1 | 100 wt. part(s) |
| Processed colorant-1 | 7 wt. part(s) |
| Solid wax-1 | 3 wt. part(s) |

Toner-11 (invention) having a weight-average particle size of 8 μm was prepared in the same manner as Toner-1 except for the use of the above ingredients. Toner-11 was then left standing in an environment of 40° C. for 1 day. To 100 wt. parts of Toner-11, 1.0 wt. part of Inorganic fine powder-1 was externally added and blended in a HENSCHEL mixer to obtain Developer-11 (invention).

As a result of GPC measurement, Developer-1 showed peaks at 13,400 and 650,000 and contained 73% of component in a molecular weight region of at most 100,000.

Toner-12 and Developer-12 (Invention)

| | |
|---|---|
| Binder resin-1 | 100 wt. part(s) |
| Processed colorant-1 | 6 wt. part(s) |
| Solid wax-2 | 3 wt. part(s) |

Toner-12 (invention) having a weight-average particle size of 8 μm was prepared in the same manner as Toner-1 except for the use of the above ingredients. Toner-12 was then left standing in an environment of 40° C. for 1 day. To 100 wt. parts of Toner-12, 1.0 wt. part of Inorganic fine powder-1 was externally added and blended in a HENSCHEL mixer to obtain Developer-12 (invention).

As a result of GPC measurement, Developer-12 showed peaks at 13,300 and 640,000 and contained 75% of component in a molecular weight region of at most 100,000.

EXAMPLES 1–4

A commercially available electrophotographic copying machine ("NR6030", mfd. by Canon K.K., equipped with contact charging means, contact transfer means, a urethane rubber blade cleaner, and an organic photosensitive member having a surface layer comprising polycarbonate resin (with 8 wt. % of teflon powder dispersed therein) was remodeled so that the contact transfer roller rotated at an identical speed as the photosensitive drum and the doctor blade in the developing apparatus was replaced by a stainless steel blade having a silicone rubber tip applied thereto, thereby providing a testing machine.

Figure 12:
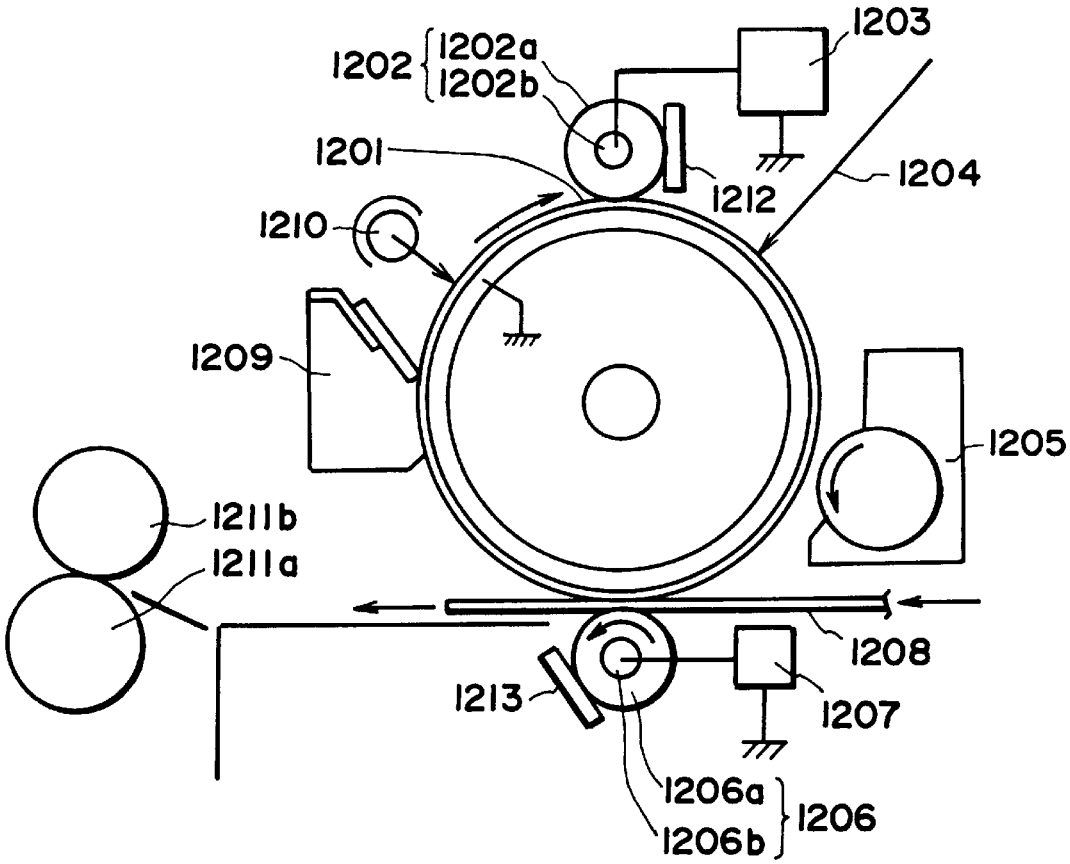
FIG. 12 is a schematic illustration of an image forming apparatus usable in the image forming method according to the present invention.

The testing machine had a structure schematically as shown in FIG. 12.

Referring to FIG. 12, a charging roller 1202 basically comprises a central core metal 1202*b* and an electroconductive elastic layer 1202*a* comprising an epichlorohydrin rubber with carbon black dispersed therein and surrounding the core metal 1202*b*.

The charging roller 1202 is pressed against a photosensitive member 1201 surface at a linear pressure of 40 g/cm and is rotated following the rotation of the photosensitive member 1201. Further, against the charging roller 1202, a felt pad is abutted as a cleaning member 1212.

An electrostatic latent image is formed on the photosensitive member 1201 by exposure with image light 1204 and developed with a developer contained in a developing apparatus 1205 to form a toner image on the photosensitive member 1201. Opposite the photosensitive member 1201 is disposed a transfer roller 1206 as a contact transfer means which basically comprises a central core metal 1206*b* and an electroconductive elastic layer 1206*a* surrounding the core metal and comprising ethylene-propylene-butadiene rubber with carbon black dispersed therein.

The transfer roller is pressed against the photosensitive member 1201 surface at a linear pressure of 20 g/cm and rotated at a peripheral speed identical to that of the photosensitive member 1201. Further, a felt pad 1213 as a cleaning member is pressed against the transfer roller 1206. In FIG. 12, 1203 and 1207 denote a voltage supply, 1208 denotes a transfer material, 1209 denotes a cleaning device, 1210 denotes a pre-exposure lamp (not used); 1211*a* denotes a pressure roller and 1211*b* denotes a heating roller.

By using the above-remodeled test copying machine, Developers 1 and 4–6 were respectively subjected to a continuous copying test of 50,000 sheets and evaluated with respect to the following items. The results are summarized in Tables 4 and 5 appearing hereinafter.

[Continuous Copying Test]

Each developer was evaluated with respect to image density, fog, melt-sticking, filming, cleanability, transfer irregularity, charging irregularity, damage and abrasion of the photosensitive member, and soiling on the charging roller and the transfer roller.

[Transfer Dropout Test]

Thick papers (200 g/m$^2$) and OHP film sheets were used as transfer materials to evaluate dropout from line and character images. With respect to a thick paper, images were formed on both sides, and the image on the second side was evaluated.

[Fixation Scattering]

A developer image was transferred onto a rougher side of a transfer paper of 80 g/m$^2$ of which the moisture was adjusted by standing in a humidity of 80% RH and subjected to a fixation test by using an external fixing apparatus as illustrated in FIG. 11, wherein an unfixed image on a transfer material 1106 was pressed against a heating member 1101 via a film 1102 by a pressing member 1105 disposed opposite to the heating member 1101.

The fixing film 1102 was an endless film comprising a polyimide film having a 10 $\mu$m-thick release coating layer of fluorine-containing resin. The pressure roller 1105 of silicone rubber was used to apply a total pressure of 10 kg between the heating member 1101 and the pressure roller 1105 with a nip of 4.0 mm and at a process speed of 90 mm/sec. The film was driven under tension between a drive roller 1103 and a follower roller 1104. The linear heating member 1101 of a low heat capacity was supplied with pulsed energy to be temperature-controlled at 190° C.

A4-sized paper carrying parallel line images (20 liens of 200 $\mu$m in width formed at a pitch of 1 cm) thereon in parallel with its longitudinal direction was fed to the fixing device in its longitudinal direction to evaluate the fixing performance.

[Blocking Test]

About 20 g of developer was placed in a 100 cc-plastic cup and left standing at 50° C. for 3 days. The state of blocking was evaluated with eyes.

The respective performances were evaluated according to the following standards.

Fog

◎: Excellent. Fog was not recognized with eyes.

○: Good. Fog was not recognized unless observed carefully.

Δ: Fair. Recognized but practically acceptable.

x: Not acceptable. Noticeable fog.

Damage on Photosensitive Member

○: Good. No damage leading to image defects was recognized.

Δ: Fair. Damage leading to image defect appearing in a halftone image.

x: Not acceptable. Damage leading to an image defect in an ordinary image.

Transfer Dropout

◎: Excellent. Almost no dropout recognized.

○: Good. Dropout was not recognized unless observed carefully.

Δ: Fair. Dropout was recognized.

x: Not acceptable. Dropout was clearly recognized.

Blocking

◎: Excellent. No agglomerate recognized.

○: Good. Agglomerate was recognized but easily collapsible.

Δ: Fair. Agglomerate was recognized but was collapsible by shaking.

x: Not acceptable. Agglomerate could be snapped by fingers and could not be easily collapsed.

Surface State of Various Members

◎: Excellent. No toner sticking or soiling at all.

○: Good. Almost no sticking or soiling.

Δ: Fair. Slight toner sticking or soiling.

x: Not acceptable. Toner sticking and soiling were observed.

As a result of evaluation in general, Developers 1 and 4–6 provided high-density images during the continuous image formation without causing melt-sticking, filming, cleaning failure or density irregularity due to transfer irregularity or charging irregularity. Further, the photosensitive member was little damaged and scraped little, so as to allow a longer life or a smaller film thickness. Further, anti-transfer dropout characteristic was good and almost no fixation scattering was observed.

COMPARATIVE EXAMPLES 1 AND 2

Developers 2 and 3 were evaluated in the same manner as in Example 1. The results are also shown in Tables 4 and 5.

Generally, Developer-2 provided images at a low density and with fog. Further, on continuation of the image formation, transfer dropout became noticeable.

Developer 3 gave good quality of images but was accompanied with transfer dropout, fixation scattering and damage and much abrasion of the photosensitive member.

TABLE 4

| | | | | Melt- | | | Irregularity | | Photosensitive member | |
|---|---|---|---|---|---|---|---|---|---|---|
| Example | Developer | Image density | Fog | stick | Filming | Cleaning | Transfer | Charging | Damage | Abration ($\mu$m) |
| Ex. 1 | 1 | 1.35–1.42 | ◎ | none | none | good | none | none | ◎ | 10 |
| 2 | 4 | 1.36–1.38 | ◎ | none | none | good | none | none | ○ | 9 |
| 3 | 5 | 1.37–1.39 | ◎ | none | none | good | none | none | ○ | 10 |
| 4 | 6 | 1.35–1.40 | ◎ | none | none | good | none | none | ○ | 13 |
| Comp. Ex. 1 | 2 | 1.21–1.29 | Δ | none | none | good | none | none | Δ | 12 |
| 2 | 3 | 1.36–1.43 | ◎ | none | occurred | good | none | occurred | × | 21 |

TABLE 5

| | | Transfer dropout | | Fixation | | Surface state | |
|---|---|---|---|---|---|---|---|
| Example | Developer | Thick paper | OHP | scattering | Blocking | Charging roller | Transfer roller |
| Ex. 1 | 1 | ◎ | ◎ | ○ | ◎ | ◎ | ◎ |
| 2 | 4 | ◎ | ◎ | ○ | ◎ | ◎ | ◎ |
| 3 | 5 | ◎ | ◎ | ○ | ◎ | ○ | ◎ |
| 4 | 6 | ◎ | ○ | ○ | ◎ | ◎ | ○ |
| Comp. Ex. 1 | 2 | ○ | Δ | ○ | ○ | Δ | ○ |
| 2 | 3 | × | × | × | ◎ | × | Δ |

EXAMPLES 5–8

The testing apparatus used in Example 1 was further modified with respect to the developing bias voltage and transfer current so that it was applicable to reversal development. Developers 7 to 10 were evaluated by the thus modified apparatus. The results are shown in Tables 6 and 7.

TABLE 6

| | | | | Melt- | | | Irregularity | | Photosensitive member | |
|---|---|---|---|---|---|---|---|---|---|---|
| Example | Developer | Image density | Fog | stick | Filming | Cleaning | Transfer | Charging | Damage | Abration (μm) |
| Ex. 5 | 7 | 1.38–1.40 | ◎ | none | none | good | none | none | ○ | 12 |
| 6 | 8 | 1.37–1.41 | ○ | none | none | good | none | none | ○ | 13 |
| 7 | 9 | 1.36–1.39 | ◎ | none | none | good | none | none | ○ | 12 |
| 9 | 10 | 1.35–1.38 | ○ | none | none | good | none | none | ○ | 10 |

TABLE 7

| | | Transfer dropout | | Fixation | | Surface state | |
|---|---|---|---|---|---|---|---|
| Example | Developer | Thick paper | OHP | scattering | Blocking | Charging roller | Transfer roller |
| Ex. 5 | 7 | ◎ | ◎ | ○ | ◎ | ◎ | ◎ |
| 6 | 8 | ○ | ○ | ○ | ◎ | ◎ | ◎ |
| 7 | 9 | ◎ | ◎ | ○ | ◎ | ○ | ◎ |
| 8 | 10 | ◎ | ◎ | ○ | ◎ | ○ | ◎ |

EXAMPLES 9–10

A commercially available copying machine ("FC-330", mfd. by Canon K.K., equipped with contact charging means, contact transfer means, a urethane blade cleaner, an organic photosensitive member, a sponge applicator roller, and an elastic doctor blade with a silicone rubber tip; cartridge-type) was remodeled so that the contact transfer roller rotated at an identical speed as the photosensitive drum.

Developers 11 and 12 were subjected to a continuous copying test of 3,000 sheets and the performances thereof were evaluated in the same manner as in Example 1. The results are shown in Tables 8 and 9.

TABLE 8

| | | | | Melt- | | | Irregularity | | Photosensitive member | |
|---|---|---|---|---|---|---|---|---|---|---|
| Example | Developer | Image density | Fog | stick | Filming | Cleaning | Transfer | Charging | Damage | Abration (μm) |
| Ex. 9 | 11 | 1.40–1.45 | ◎ | none | none | good | none | none | ○ | 10 |
| 10 | 12 | 1.25–1.29 | ◎ | none | none | good | none | none | ○ | 9 |

TABLE 9

| | | Transfer dropout | | Fixation | | Surface state | |
|---|---|---|---|---|---|---|---|
| Example | Developer | Thick paper | OHP | scattering | Blocking | Charging roller | Transfer roller |
| Ex. 9 | 11 | ◎ | ◎ | ○ | ◎ | ○ | ◎ |
| 10 | 12 | ◎ | ◎ | ○ | ◎ | ○ | ◎ |

Production Examples of Processed Magnetic Powder-9 and 10 Carrying Liquid Lubricant 10 kg of magnetite powder and a prescribed amount (shown in Table 10) of liquid lubricant were placed in a SHIMPSON MIX-MALLER ("MPUV-2", mfd. by Matsumoto Chuzo K.K.) and processed for 30 min. therein to have the magnetite powder carry a liquid lubricant. The product was disintegrated by a hammer mill. The properties of the magnetite powder and processed magnetite powder and liquid lubricants used are summarized in the following Table 10.

TABLE 10

| | Species | Processed magnetic powder-9 Magnetite-9 | Processed magnetic powder-10 Magnetite-10 |
|---|---|---|---|
| Unproceeded magnetic powder | Particle shape | octahdedral | octahedral |
| | Dav. ($\mu$m) | 0.19 | 0.23 |
| | Magnetic property *1 σs ($Am^2/kg$) | 82.5 | 81.9 |
| | σr ($Am^2/kg$) | 11.6 | 12.1 |
| | BET ($m^2/g$) | 8.0 | 7.6 |
| | Si content (wt. %) | 0.47 | 0.40 |
| Proceeded magnetic powder | Liquid lubricant | dimethylsilicone oil 1000 cSt | dimethylsilicone oil 100 cSt |
| | Amount (g) | 100 | 100 |
| | Oil absorption (ml/100 g) | 23.8 | 22.3 |
| | ρa ($g/cm^3$) | 0.44 | 0.49 |

*1: Measured under a magnetic field of $7.95775 \times 10^2$ kA/m (10 kOe)

Production of Organically Treated Inorganic Fine Powder

Inorganic fine powders 5 to 12 were prepared in the following manner and used for toner production as will be described hereinafter.

(Inorganic Fine Powder-5)

100 g of commercially available silica fine powder produced by the dry process ("AEROSIL 200", mfd. by Nippon Aerosil K.K., specific surface area=200 $m^2/g$) was placed in a stainless steel vessel and stirred at room temperature in a nitrogen atmosphere.

| | |
|---|---|
| Aminopropyltriethoxysilane | 3 g |
| Dimethylsilicone oil | 17 g |

("KF96: 50 cSt", mfd. by Shin'Etsu Kagaku Kogyo K.K.; viscosity=50 cSt at 25° C.)

| | |
|---|---|
| n-Hexane | 10 ml |

Into the silica fine powder under stirring, the above-mixture treating agent was sprayed, followed 20 by 30 min. of stirring at room temperature under a nitrogen gas stream. Then, the system was heated and stirred at 100° C. for 30 min., followed by heating to 200° C., stirring for 1 hour, and cooling to obtain Treated silica-5, which showed a hydrophobicity of 70%.

(Inorganic Fine Powder-6)

Treated silica-6 was prepared from commercially available silica fine powder prepared by the dry process ("AEROSIL 130", mfd. by Nippon Aerosil K.K., specific surface area=130 $m^2/g$) by treatment with a mixture treating agent of

| | |
|---|---|
| Aminopropylmethyldimethoxysilane | 1.5 g |
| Methylhydrogen silicone oil | 20 g |

("KF99: 20 cSt", mfd. by Shin'Etsu Kagaku Kogyo K.K.; viscosity=20 cSt at 25° C.)

otherwise in a similar manner as in the preparation of Treated silica-5 described above. The resultant Treated silica-6 showed a hydrophobicity of 77%.

(Inorganic Fine Powder-7)

Treated silica-7 was prepared from commercially available silica fine powder prepared by the dry process ("AEROSIL 300", mfd. by Nippon Aerosil K.K., specific surface area=300 $m^2/g$) by treatment with a mixture treating agent of

| | |
|---|---|
| Aminobutyldimethylmethoxysilane | 10 g |
| Methylphenyl silicone oil | 20 g |

("KF50: 100 cSt", mfd. by Shin'Etsu Kagaku Kogyo K.K.; viscosity=100 cSt at 25° C.)

| | |
|---|---|
| n-Hexane | 20 ml |

otherwise in a similar manner as in the preparation of Treated silica-5 described above. The resultant Treated silica-7 showed a hydrophobicity of 65%.

(Inorganic Fine Powder-8)

Treated silica-8 was prepared from commercially available silica fine powder prepared by the dry process ("AEROSIL 130", mfd. by Nippon Aerosil K.K., specific surface area=130 $m^2/g$) by treatment with a mixture treating agent of

| | |
|---|---|
| 1,3-Bis(3-aminopropyl)-1,1,3,3-tetramethyldisiloxane | 12 g |
| Alkyl-modified silicone oil ("KF414: 100 cSt", mfd. by Shin'Etsu Kagaku Kogyo K.K.; viscosity = 100 cSt at 25° C.) | 4 g |

otherwise in a similar manner as in the preparation of Treated silica-5 described above. The resultant Treated silica-8 showed a hydrophobicity of 48%.

(Inorganic fine powder-9)

Treated silica-9 was prepared from commercially available silica fine powder prepared by the dry process ("AEROSIL 300", mfd. by Nippon Aerosil K.K., specific surface area=300 $m^2/g$) by treatment with a mixture treating agent of

| | |
|---|---|
| 1,3-Bis(4-aminobutyl)-1,1,3,3-tetramethyldisilazane | 2.5 g |
| Amino-modified silicone oil ("KF861: 90 cSt", mfd. by Shin'Etsu Kagaku Kogyo K.K.; viscosity = 90 cSt at 25° C.) | 60 g |

otherwise in a similar manner as in the preparation of Treated silica-5 described above. The resultant Treated silica-9 showed a hydrophobicity of 60%.

(Inorganic Fine Powder-10)

Treated silica-10 was prepared from commercially available silica fine powder prepared by the dry process ("AEROSIL 200", mfd. by Nippon Aerosil K.K., specific surface area=200 $m^2/g$) by treatment with a mixture treating agent of

| | |
|---|---|
| Aminopropyltrimethoxysilane | 10 g |
| Hexamethyldisilazane | 10 g |

otherwise in a similar manner as in the preparation of Treated silica-5 described above. The resultant Treated silica-10 showed a hydrophobicity of 70%.

(Inorganic fine powder-11)

100 g of commercially available silica fine powder produced by the dry process ("AEROSIL 130", mfd. by Nippon Aerosil K.K., specific surface area=130 $m^2/g$) was placed in a stainless steel vessel and stirred at room temperature in a nitrogen atmosphere.

| | |
|---|---|
| Amino-modified silicone oil ("KF393: 60 cSt", mfd. by Shin'Etsu Kagaku Kogyo K.K.; viscosity = 60 cSt at 25° C.) | 15 g |
| n-Hexane | 10 ml |

Into the silica fine powder under stirring, the above-mixture treating agent was sprayed, followed by heating to 280° C., stirring for 1 hour, and cooling to obtain Treated silica-11, which showed a hydrophobicity of 64%.

(Inorganic Fine Powder-12)

Treated silica-12 was prepared from commercially available silica fine powder prepared by the dry process ("AEROSIL 130", mfd. by Nippon Aerosil K.K., specific surface area=130 $m^2/g$) by treatment with a treating agent of

| | |
|---|---|
| Amino-modified silicone oil ("KF8857: 70 cSt", mfd. by Shin'Etsu Kagaku Kogyo K.K.; amino equivalent = 830, viscosity = 70 cSt at 25° C.) | 13 g |

otherwise in a similar manner as in the preparation of Treated silica-11 described above. The resultant Treated silica-12 showed a hydrophobicity of 63%.

Solid Wax

Solid waxes having properties as shown in the following Table 11 were used for toner production described hereinafter.

TABLE 11

| | | Solid wax-5 | Solid wax-6 |
|---|---|---|---|
| Composition | | hydrocarbon | hydrocarbon |
| DSC | onset (° C.) | 89 | 90 |
| | peak (° C.) | 101 | 102 |
| GC | peak intensity change | methylene continuous | every two other methylenes |
| | main peak | C61 | C58 |
| GPC | Mn | 980 | 870 |
| | Mw | 1250 | 1080 |
| | Mw/Mn | 1.28 | 1.24 |
| Density ($g/cm^3$) | | 0.95 | 0.96 |
| Penetration | | 0.5 | 2.0 |

EXAMPLE 11

| | |
|---|---|
| Binder resin-1 | 100 wt. parts |
| Processed magnetic particle-9 | 80 wt. parts |
| Triphenylmethane compound-1 | 2 wt. parts |
| Solid wax-5 | 4 wt. parts |

The above ingredients were pre-blended in a Henschel mixer and melt-kneaded through a twin-screw extruder set at 130° C. After the cooling, the kneaded product was finely pulverized by a jet pulverizer and classified by a pneumatic classifier to obtain Toner-13 having a weight-average particle size of 8 $\mu$m.

Toner-13 was then left standing in an environment of 40° C. for 1 day. To 100 weight parts of Toner 13, 0.8 wt. part of Treated silica-7 was externally added and blended in a HENSCHEL mixer to obtain Developer-13.

As a result of GPC measurement, Developer-13 showed peaks at 13,300 and 580,000, and contained 76% of component in a molecular weight region of at most 100,000.

EXAMPLE 12

To 100 wt. parts of Toner-13 left standing at 40° C. for 1 hour, 0.8 wt. part of Treated silica-8 was externally added and blended in a HENSCHEL mixer to obtain Developer-14.

As an result of GPC measurement, Developer-14 showed peaks at 13,300 and 580,000 and contained 76% of component in a molecular weight range of at most 100,000.

EXAMPLE 13

To 100 wt. parts of Toner-13 left standing at 40° C. for 1 hour, 0.8 wt. part of Treated silica-9 was externally added and blended in a HENSCHEL mixer to obtain Developer-15.

As result of GPC measurement, Developer-15 showed peaks at 13,300 and 580,000 and contained 76% of component in a molecular weight range of at most 100,000.

EXAMPLE 14

To 100 wt. parts of Toner-13 left standing at 40° C. for 1 hour, 0.8 wt. part of Treated silica-10 was externally added and blended in a HENSCHEL mixer to obtain Developer-16.

As result of GPC measurement, Developer-16 showed peaks at 13,300 and 580,000 and contained 76% of component in a molecular weight range of at most 100,000.

EXAMPLE 15

To 100 wt. parts of Toner-13 left standing at 40° C. for 1 hour, 0.8 wt. part of Treated silica-11 was externally added and blended in a HENSCHEL mixer to obtain Developer-17.

As result of GPC measurement, Developer-17 showed peaks at 13,300 and 580,000 and contained 76% of component in a molecular weight range of at most 100,000.

EXAMPLE 16

| | |
|---|---|
| Binder resin-1 | 100 wt. parts |
| Processed magnetic particle-10 | 80 wt. parts |
| Triphenylmethane compound-1 | 2 wt. parts |
| Solid wax-6 | 4 wt. parts |

Toner-14 having a weight-average particle size of 8 μm was prepared from the above ingredients otherwise in the same manner as the preparation of Toner-13 described above.

Toner-14 was then left standing in an environment of 40° C. for 1 day. To 100 wt. parts of Toner-14, 0.8 wt. part of Treated silica-7 was externally added and blended in a HENSCHEL mixer to obtain Developer-18.

As a result of GPC measurement, Developer-18 showed peaks at 13,200 and 570,000 and contained 75% of component in a molecular weight region of at most 100,000.

EXAMPLE 17

| | |
|---|---|
| Binder resin-1 | 100 wt. parts |
| Processed colorant-1 | 7 wt. parts |
| Solid wax-5 | 3 wt. parts |

Toner-15 having a weight-average particle size of 8 μm was prepared from the above ingredients otherwise in the same manner as the preparation of Toner-13 described above.

Toner-15 was then left standing in an environment of 40° C. for 1 day. To 100 wt. parts of Toner-15, 0.8 wt. part of Treated silica-7 was externally added and blended in a HENSCHEL mixer to obtain Developer-19.

As a result of GPC measurement, Developer-19 showed peaks at 13,400 and 640,000 and contained 73% of component in a molecular weight region of at most 100,000.

COMPARATIVE EXAMPLE 3

| | |
|---|---|
| Binder resin-1 | 100 wt. part(s) |
| Magnetic powder (unprocessed magnetite-9) | 80 " |
| Triphenylmethane compound-1 | 2 " |
| Solid wax-5 | 4 " |
| Dimethylsilicone oil (1000 cSt) | 0.8 " |

Toner-16 (comparative) having a weight-average particle size of 8 μm was prepared from the above ingredients otherwise in the same manner as the preparation of Toner-13 described above.

Toner-16 was then left standing in an environment of 40° C. for 1 day. To 100 wt. parts of Toner-14, 0.8 wt. part of Treated silica-5 was externally added and blended in a HENSCHEL mixer to obtain Developer-20 (comparative).

As a result of GPC measurement, Developer-20 showed peaks at 13,400 and 590,000 and contained 75% of component in a molecular weight region of at most 100,000.

COMPARATIVE EXAMPLE 4

| | |
|---|---|
| Binder resin-1 | 100 wt. part(s) |
| Magnetic powder (unprocessed magnetite-9) | 80 " |
| Triphenylmethane compound-1 | 2 " |
| Solid wax-5 | 4 " |

Toner-17 (comparative) having a weight-average particle size of 8 μm was prepared from the above ingredients otherwise in the same manner as the preparation of Toner-13 described above.

Toner-17 was then left standing in an environment of 40° C. for 1 day. To 100 wt. parts of Toner-17, 0.8 wt. part of Treated silica-5 was externally added and blended in a HENSCHEL mixer to obtain Developer-21 (comparative).

As a result of GPC measurement, Developer-21 showed peaks at 13,200 and 570,000 and contained 76% of component in a molecular weight region of at most 100,000.

EXAMPLE 18

To 100 wt. parts of Toner-13 left standing at 40° C. for 1 hour, 0.4 wt. part of Treated silica-5 was externally added and blended in a HENSCHEL mixer to obtain Developer-22.

As result of GPC measurement, Developer-22 showed peaks at 13,300 and 580,000 and contained 76% of component in a molecular weight range of at most 100,000.

EXAMPLES 19–25

A commercially available electrophotographic copying machine ("NP480", mfd. by Canon K.K., equipped with corona charging means, corona transfer means and an organic photosensitive member, and equipped with a black developing apparatus and a color developing apparatus) was remodeled so that the corona charge/corona transfer means were replaced by contact charge/contact transfer means, respectively.

The testing machine had a structure schematically as shown in FIG. 12.

Referring to FIG. 12, a charging roller 1202 basically comprises a central core metal 1202*b* and an electroconductive elastic layer 1202*a* comprising an epichlorohydrin rubber with carbon black dispersed therein and surrounding the core metal 1202*b*.

The charging roller 1202 is pressed against a photosensitive member 1201 surface at a linear pressure of 4 kg/m and is rotated following the rotation of the photosensitive member 1201. Further, against the charging roller 1202, a felt pad is abutted as a cleaning member 1212.

An electrostatic latent image is formed on the photosensitive member 1201 by exposure with image light 1204 and developed with a developer contained in a developing apparatus 1205 to form a toner image on the photosensitive member 1201. Opposite the photosensitive member 1201 is disposed a transfer roller 1206 as a contact transfer means which basically comprises a central core metal 1206*b* and an electroconductive elastic layer 1206*a* surrounding the core metal and comprising ethylenepropylene-butadiene rubber with carbon black dispersed therein.

The transfer roller is pressed against the photosensitive member 1201 surface at a linear pressure of 2 kg/m an d rotated at a peripheral speed identical to that of the photosensitive member 1201. further, a felt pad 1213 as a Cleaning member is pressed against the transfer roller 1206. In FIG. 12, 1203 and 1207 denote a voltage supply, 1208 denotes a transfer material, 1209 denotes a cleaning device, 1210 denotes a pre-exposure lamp (not used); 1211*a* denotes a pressure roller and 1211*b* denotes a heating roller.

By using the above-remodeled copying apparatus while operating the black developing apparatus, Developers 13–15, 18 and 22 were subjected to a continuous copying test of 50,000 sheets in a normal temperature/normal humidity (23° C./60% RH) environment. The results are shown in Table 12.

Further, Developers 13–15 were also subjected to a continuous copying test of 50,000 sheets in a normal temperature/low-humidity (23° C./5% RH) environment and also in a high temperature/high-humidity (30° C./80% RH) environment. The results are shown in Table 13.

Performances in the continuous copying test, transfer dropout and blocking characteristic were evaluated in the same manner as in Example 1.

Fixation scattering characteristic was evaluated in the same manner as in Example 1 except that the process speed was changed to 150 mm/sec.

Further, the developer coating state on the developing sleeve was evaluated according to the following standard:

◎: Excellent. The sleeve was uniformly coated.

○: Good. Non-uniformity was present but not recognized unless carefully observed.

Δ: Fair. Non-uniformity was recognized, but not resultant as a defect in the resultant image.

x: Not acceptable. Many blotches occurred by sticking of toner onto the sleeve surface.

During the continuous image forming test in the normal temperature/normal humidity environment, Developers 13–15, 18 and 22 showed a uniform and stable sleeve coating characteristic and provided high-density images free from fog without causing filming. Further, the photosensitive member was little damaged and scraped little, so as to allow a longer life or a smaller film thickness. Further, anti-transfer dropout characteristic was good and almost no fixation scattering was observed.

Further, Developers 13–15 retained a stable sleeve-coating characteristic and provided high-density images with little fog even in the normal temperature/low humidity environment and the high temperature/high humidity environment.

Developer 20 (comparative) showed a somewhat inferior sleeve-coating characteristic and provided lower-density images with fog. Further, on continuation of the image formation, transfer dropout became noticeable.

Further, while Developer 21 (comparative) showed good sleeve-coating characteristic, image density and anti-fog characteristic, it caused filming and failed to show a good transfer dropout-preventing characteristic. Further, it showed an inferior fixation scattering characteristic and resulted in damage and a large abrasion of the photosensitive member.

TABLE 12

| | | Normal temperature/normal humidity (23° C./60% RH) | | | | | | | | | | | |
|---|---|---|---|---|---|---|---|---|---|---|---|---|---|
| | | | | | | | | Transfer dropout | | | | Surface state | |
| Example | Developer | Sleeve coating | Image density | Fog | Filming | Damage*1 | Abrasion*2 | Thick paper | OHP | Fixation scattering | Block-ing | Charging roller | Transfer roller |
| Ex. 19 | 13 | ◎ | 1.36–1.43 | ◎ | none | ○ | 5 | ◎ | ◎ | ○ | ◎ | ◎ | ◎ |
| 20 | 14 | ◎ | 1.35–1.41 | ◎ | none | ○ | 6 | ◎ | ○ | ○ | ◎ | ◎ | ◎ |
| 21 | 15 | ◎ | 1.36–1.41 | ○ | none | ○ | 5 | ◎ | ○ | ○ | ○ | ◎ | ◎ |
| 22 | 16 | ◎ | 1.30–1.41 | ◎ | none | Δ | 9 | ○ | ○ | ○ | ◎ | ○ | ○ |
| 23 | 17 | ○ | 1.35–1.41 | ◎ | none | ○ | 5 | ○ | ○ | ○ | ○ | ◎ | ◎ |
| 24 | 18 | ◎ | 1.36–1.42 | ◎ | none | ○ | 6 | ◎ | ◎ | ○ | ◎ | ◎ | ◎ |
| 25 | 22 | ◎ | 1.34–1.42 | ◎ | none | ○ | 5 | ◎ | ○ | ○ | ◎ | ◎ | ◎ |
| Comp. Ex. 3 | 20 | ○ | 1.20–1.27 | Δ | none | Δ | 7 | ○ | Δ | ○ | ◎ | Δ | ○ |
| 4 | 21 | ◎ | 1.36–1.42 | ◎ | ocurred | Δ | 12 | Δ | × | × | ◎ | × | Δ |

*1: Damage of photosensitive member

*2: Abration of photosensitive member ($\mu$m/5 × $10^4$ sheets)

TABLE 13

| | | N.T./L.H. (23° C./5% RH) | | | H.T./H.H. (30° C./80% RH) | | |
|---|---|---|---|---|---|---|---|
| Example | Developer | Sleeve-coating | Image density | Fog | Sleeve-coating | Image density | Fog |
| 19 | 13 | ◎ | 1.33–1.44 | ◎ | ◎ | 1.32–1.40 | ◎ |
| 20 | 14 | ◎ | 1.35–1.43 | ◎ | ◎ | 1.25–1.40 | ○ |
| 21 | 15 | ○ | 1.35–1.38 | ○ | ◎ | 1.30–1.39 | ◎ |

EXAMPLE 26

5 wt. parts of Developer 19 was blended with 100 wt. parts of resin-coated magnetic ferrite carrier particles of 50–80 μm in particle size to obtain a two-component type developer. The developer was subjected to a continuous copying test of 30,000 sheets by using the re-modeled copying apparatus used in Example 19 but operating the color developing apparatus. The results are shown in Table 14.

During the successive copying test in the normal temperature/normal humidity environment, Developer-19 provided high-density images with little fog without causing filming. The photosensitive member was damaged little or scraped little. Transfer dropout could be obviated and almost no fixation scattering was caused.

TABLE 14

| (for Example 26) (under 23° C./60% RH) | |
|---|---|
| Developer: | 19 |
| Sleeve-coating characteristic: | – |
| Image density: | 1.37–1.44 |
| Fog: | ○ |
| Filming: | None |
| (Photosensitive member) | |
| Damage: | ○ |
| Scraped amount: | 3 μm/30,000 sheets |

TABLE 14-continued

| (for Example 26) (under 23° C./60% RH) | |
|---|---|
| (Transfer dropout) | |
| Thick paper: | ○ |
| OHP: | ○ |
| Fixation scattering: | ○ |
| Blocking: | ○ |
| (Surface state after continuous image formation) | |
| Charging roller: | ○ |
| Transfer roller: | ○ |

Production Examples of Lubricating Particles 100 parts of a carrier powder (shown in Table 15) was stirred in a HENSCHEL mixer and a prescribed amount of a liquid lubricant (shown in Table 15) diluted with n-hexane was added dropwise thereto. After the addition, the system was stirred at a high speed, followed by removal of n-hexane under vacuum. The product was disintegrated as desired by a hammer mill. The composition and the properties of several lubricating particles (1–10) thus formed are summarized in the following Table 15.

Magnetic Powder

Further, powders of magnetite 11–14 having properties shown in Table 16 were used for toner production described hereinafter.

TABLE 15

| | Fine powder | | Liquid lubricant | | | Lubricating particles | |
|---|---|---|---|---|---|---|---|
| Lubricating particles | Material | BET ($m^2/g$) | Material*2 | | Amount (wt. parts) | Lubricant content (wt. %) | Particle*1 size (μm) |
| 1 | Silica | 200 | DMS | 10,000 cSt | 150 | 60 | ≦200 |
| 2 | Silica | 200 | PTFE | 100 cSt | 150 | 60 | ≦300 |
| 3 | Silica | 200 | DMSF | 1,000 cSt | 150 | 60 | ≦300 |
| 4 | Alumina | 100 | DMS | 10,000 cSt | 150 | 60 | ≦300 |
| 5 | Titania | 50 | DMS | 10,000 cSt | 150 | 60 | ≦300 |
| 6 | Silica treated with hexamethyl-silazane | 170 | DMS | 10,000 cSt | 150 | 60 | ≦300 |
| 7 | Silica | 300 | DMS | 50,000 cSt | 150 | 60 | ≦300 |
| 8 | Silica | 130 | DMS | 500 cSt | 150 | 60 | ≦200 |
| 9 | Silica | 380 | DMS | 1,000 cSt | 300 | 75 | ≦300 |
| 10 | Silica | 50 | DMS | 60,000 cSt | 75 | 43 | ≦300 |

*1All the lubricating particle 1–10 were principally composed of particles in the range of 10–100 μm.

*2DMS = dimethylsilicone, PTFE = polytetrafluoroethylene, DMSF = dimethylsilicone having trifluoropropyl group

TABLE 16

Physical properties of magnetic powder used

| Material | | | | | | |
|---|---|---|---|---|---|---|
| Magnetite | Particle shape | Dav*2 (μm) | $\sigma_s$ (emu/g) | $\sigma_r$ (emu/g) | BET ($m^2$/g) | Si content (wt. %) |
| 11 | Octahedral | 0.18 | 81.2 | 11.6 | 8.3 | 0.47 |
| 12 | Octahedral | 0.24 | 84.5 | 10.9 | 7.6 | 0.39 |
| 13 | Hexahedral | 0.17 | 87.1 | 7.8 | 6.3 | 0.56 |
| 14 | Spherical*1 | 0.19 | 83.6 | 3.8 | 12.4 | 0.88 |

*1indefinite-shaped
*2Dav. (average particle size)

The toners and developers were prepared respectively in the following manner.

Developer 23 (Toner 18)

| | |
|---|---|
| Binder-1 | 100 wt. parts |
| Magnetite-11 (untreated) | 80 " |
| Triphenylmethane compound-1 | 2 " |
| Solid wax-1 | 4 " |
| Lubricating particles-1 | 2 " |

The above ingredients were pre-blended in a Henschel mixer and then melt-kneaded through a twin-screw extruder set at 130° C. After cooling, the kneaded product was finely pulverized by a jet pulverizer and classified by a pneumatic classifier to obtain Toner-18 (invention) having a weight-average particle size of 8 μm. Toner-18 was then left standing in an environment of 40° C. for 1 day. To 100 wt. parts of Toner-18, 0.8 wt. part of Inorganic fine powder-1 was externally added and blended in a HENSCHEL mixer to obtain Developer-23 (invention).

As a result of GPC measurement, Developer-23 showed peaks at 13,200 and 580,000 and contained 75% of component in a molecular weight region of at most 100,000.

Further, as a result of ESCA (electron spectroscopy for chemical analysis), Toner-18 showed a silicon atom concentration (originated from silicone) and a carbon atom concentration, giving a ratio therebetween at the toner particle surface of 0.023 (incidentally, the silicon content in the magnetic material was very slight as observed in Toner-30 (comparative) and could be negligible). This means that silicon was present preferentially at the surface, i.e., the silicone oil as the liquid lubricant was preferentially present at the toner particle surface.

Incidentally, Toner-31 (comparative), when subjected to the same analysis, gave a ratio of 0.039, indicating further localization of silicone at the toner particle surface.

Developer 24 (Toner 19)

| | |
|---|---|
| Binder-1 | 100 wt. parts |
| Magnetite-11 (untreated) | 80 " |
| Triphenylmethane compound-1 | 2 " |
| Solid wax-1 | 4 " |
| Lubricating particles-2 | 2 " |

Toner-19 having a weight-average particle size of 8 μm was prepared from the above ingredients otherwise in the same manner as in production of Toner-18 described above.

Toner-19 was then left standing in an environment of 40° C. for 1 day. To 100 weight parts of Toner 19, 0.8 wt. part of Inorganic fine powder-1 was externally added and blended in a HENSCHEL mixer to obtain Developer-24.

As a result of GPC measurement, Developer-24 showed peaks at 13,100 and 590,000, and contained 76% of component in a molecular weight region of at most 100,000.

Developer 25 (Toner 20)

| | |
|---|---|
| Binder-1 | 100 wt. parts |
| Magnetite-11 (untreated) | 80 " |
| Triphenylmethane compound-1 | 2 " |
| Solid wax-1 | 4 " |
| Lubricating particles-3 | 2 " |

Toner-20 having a weight-average particle size of 8 μm was prepared from the above ingredients otherwise in the same manner as in production of Toner-18 described above.

Toner-20 was then left standing in an environment of 40° C. for 1 day. To 100 weight parts of Toner-20, 0.8 wt. part of Inorganic fine powder-1 was externally added and blended in a HENSCHEL mixer to obtain Developer-25.

As a result of GPC measurement, Developer-25 showed peaks at 13,300 and 580,000, and contained 75 of component in a molecular weight region of at most 100,000.

Developer 26 (Toner 21)

| | |
|---|---|
| Binder-1 | 100 wt. parts |
| Magnetite-12 (untreated) | 80 " |
| Triphenylmethane compound-1 | 2 " |
| Solid wax-1 | 4 " |
| Lubricating particles-4 | 2 " |

Toner-21 having a weight-average particle size of 8 μm was prepared from the above ingredients otherwise in the same manner as in production of Toner-18 described above.

Toner-21 was then left standing in an environment of 40° C. for 1 day. To 100 weight parts of Toner-21, 0.1 wt. part of Inorganic fine powder-1 was externally added and blended in a HENSCHEL mixer to obtain Developer-26.

As a result of GPC measurement, Developer-26 showed peaks at 13,500 and 570,000, and contained 76% of component in a molecular weight region of at most 100,000.

Developer 27 (Toner 22)

| | |
|---|---|
| Binder-1 | 100 wt. parts |
| Magnetite-13 (untreated) | 80 " |
| Triphenylmethane compound-1 | 2 " |
| Solid wax-3 | 4 " |
| Lubricating particles-5 | 2 " |

Toner-22 having a weight-average particle size of 8 μm was prepared from the above ingredients otherwise in the same manner as in production of Toner-18 described above.

Toner-22 was then left standing in an environment of 40° C. for 1 day. To 100 weight parts of Toner-22, 0.1 wt. part of Inorganic fine powder-1 was externally added and blended in a HENSCHEL mixer to obtain Developer-27.

As a result of GPC measurement, Developer-27 showed peaks at 13,300 and 590,000, and contained 75% of component in a molecular weight region of at most 100,000.

Developer 28 (Toner 23)

| | |
|---|---|
| Binder-1 | 100 wt. parts |
| Magnetite-14 (untreated) | 80 " |

-continued

| | |
|---|---|
| Triphenylmethane compound-1 | 2 " |
| Solid wax-4 | 4 " |
| Lubricating particles-6 | 2 " |

Toner-23 having a weight-average particle size of 8 μm was prepared from the above ingredients otherwise in the same manner as in production of Toner-18 described above.

Toner-23 was then left standing in an environment of 40° C. for 1 day. To 100 weight parts of Toner-23, 0.8 wt. part of Inorganic fine powder-1 was externally added and blended in a HENSCHEL mixer to obtain Developer-28.

As a result of GPC measurement, Developer-28 showed peaks at 13,300 and 590,000, and contained 75% of component in a molecular weight region of at most 100,000.

Developer 29 (Toner 24)

| | |
|---|---|
| Binder-2 | 100 wt. parts |
| Magnetite-12 (untreated) | 80 " |
| Monoazo iron complex-1 | 2 " |
| Solid wax-4 | 4 " |
| Lubricating particles-7 | 2 " |

Toner-24 having a weight-average particle size of 8 μm was prepared from the above ingredients otherwise in the same manner as in production of Toner-18 described above.

Toner-24 was then left standing in an environment of 40° C. for 1 day. To 100 weight parts of Toner-24, 1.0 wt. part of Inorganic fine powder-2 was externally added and blended in a HENSCHEL mixer to obtain Developer-29.

As a result of GPC measurement, Developer-29 showed a peak at 5,200 and a shoulder at 280,000, contained 13% of component in a molecular weight region of at most 100,000, and showed an Mw/Mn of 23.

Developer 30 (Toner 25)

| | |
|---|---|
| Binder-2 | 100 wt. parts |
| Magnetite-13 (untreated) | 80 " |
| Monoazo iron complex-1 | 2 " |
| Solid wax-3 | 4 " |
| Lubricating particles-8 | 3 " |

Toner-25 having a weight-average particle size of 8 μm was prepared from the above ingredients otherwise in the same manner as in production of Toner-18 described above.

Toner-25 was then left standing in an environment of 40° C. for 1 day. To 100 weight parts of Toner-25, 1.0 wt. part of Inorganic fine powder-3 was externally added and blended in a HENSCHEL mixer to obtain Developer-30.

As a result of GPC measurement, Developer-30 showed a peak at 5,100 and a shoulder at 29,000, contained 12% of component in a molecular weight region of at most 100,000, and showed an Mw/Mn of 25.

Developer 31 (Toner 26)

| | |
|---|---|
| Binder-1 | 100 wt. parts |
| Magnetite-13 (untreated) | 80 " |
| Monoazo iron complex-1 | 2 " |
| Solid wax-2 | 4 " |
| Lubricating particles-9 | 1 " |

Toner-26 having a weight-average particle 20 size of 8 μm was prepared from the above ingredients otherwise in the same manner as in production of Toner-18 described above.

Toner-26 was then left standing in an environment of 40° C. for 1 day. To 100 weight parts of Toner-26, 0.9 wt. part of Inorganic fine powder-2 was externally added and blended in a HENSCHEL mixer to obtain Developer-31.

As a result of GPC measurement, Developer-31 showed peaks at 13,100 and 570,000, and contained 74% of component in a molecular weight region of at most 100,000.

Developer 32 (Toner 27)

| | |
|---|---|
| Binder-1 | 100 wt. parts |
| Magnetite-14 (untreated) | 80 " |
| Monoazo iron complex-1 | 2 " |
| Solid wax-1 | 4 " |
| Lubricating particles-10 | 3 " |

Toner-27 having a weight-average particle size of 8 μm was prepared from the above ingredients otherwise in the same manner as in production of Toner-18 described above.

Toner-27 was then left standing in an environment of 40° C. for 1 day. To 100 weight parts of Toner-27, 1.2 wt. part of Inorganic fine powder-4 was externally added and blended in a HENSCHEL mixer to obtain Developer-32.

As a result of GPC measurement, Developer-32 showed peaks at 13,400 and 590,000, and contained 73% of component in a molecular weight region of at most 100,000.

Developer 33 (Toner 28)

| | |
|---|---|
| Binder-1 | 100 wt. parts |
| Carbon black | 5 " |
| Triphenylmethane compound-1 | 1 " |
| Solid wax-1 | 3 " |
| Lubricating particles-1 | 1 " |

Toner-28 having a weight-average particle size of 8 μm was prepared from the above ingredients 5 otherwise in the same manner as in production of Toner-18 described above.

Toner-28 was then left standing in an environment of 40° C. for 1 day. To 100 weight parts of Toner-28, 1.0 wt. part of Inorganic fine powder-1 was externally added and blended in a HENSCHEL mixer to obtain Developer-33.

As a result of GPC measurement, Developer-33 showed peaks at 13,400 and 640,000, and contained 73% of component in a molecular weight region of at most 15 100,000.

Developer 34 (Toner 29)

| | |
|---|---|
| Binder-1 | 100 wt. parts |
| Copper phthalocyanine | 4 " |
| Triphenylmethane compound-1 | 0.5 " |
| Solid wax-1 | 3 " |
| Lubricating particles-1 | 1 " |

Toner-29 having a weight-average particle size of 8 μm was prepared from the above ingredients otherwise in the same manner as in production of Toner-18 described above.

Toner-29 was then left standing in an environment of 40° C. for 1 day. To 100 weight parts of Toner 29, 1.2 wt. parts of Inorganic fine powder-1 was externally added and blended in a HENSCHEL mixer to obtain Developer-34.

As a result of GPC measurement, Developer-34 showed peaks at 13,400 and 650,000, and contained 75% of component in a molecular weight region of at most 100,000.

Developer 35 (Toner 30)

| | |
|---|---|
| Binder-1 | 100 wt. parts |
| Magnetite-11 (untreated) | 80 " |
| Triphenylmethane compound-1 | 2 " |
| Solid wax-1 | 4 " |

Toner-30 having a weight-average particle size of 8 μm was prepared from the above ingredients otherwise in the same manner as in production of Toner-18 described above.

Toner-30 was then left standing in an environment of 40° C. for 1 day. To 100 weight parts of Toner-30, 0.8 wt. part of Inorganic fine powder-1 was externally added and blended in a HENSCHEL mixer to obtain Developer-35.

As a result of GPC measurement, Developer-35 showed peaks at 13,300 and 570,000, and contained 75% of component in a molecular weight region of at most 100,000.

Developer 36 (Toner 31)

| | |
|---|---|
| Binder-1 | 100 wt. parts |
| Magnetite-11 (untreated) | 80 " |
| Triphenylmethane compound-1 | 2 " |
| Solid wax-1 | 4 " |
| Dimethyl silicone | 1.2 " |

Toner-31 having a weight-average particle size of 8 μm was prepared from the above ingredients otherwise in the same manner as in production of Toner-18 described above.

Toner-31 was then left standing in-an environment of 40° C. for 1 day. To 100 weight parts of Toner-31, 0.8 wt. part of Inorganic fine powder-1 was externally added and blended in a HENSCHEL mixer to obtain Developer-36.

As a result of GPC measurement, Developer-36 showed peaks at 13,200 and 590,000, and contained 76% of component in a molecular weight region of at most 100,000.

EXAMPLES 27–32

By using the re-modeled test copying machine used in Example 1, Developers 23–28 were subjected to a continuous copying test of 50,000 sheets and evaluated with respect to continuous image forming characteristic, transfer dropout, fixation scattering, and blocking in the same manner as in Example 1. The results are shown in Tables 17 and 18.

As a result of evaluation in general, Developers 23–28 provided high-density images during the continuous image formation without causing melt-sticking, filming, cleaning failure or density irregularity due to transfer irregularity or charging irregularity. Further, the photosensitive member was little damaged and scraped little, so as to allow a longer life or a smaller film thickness. Further, anti-transfer dropout characteristic was good and almost no fixation scattering was observed.

COMPARATIVE EXAMPLES 5 AND 6

Developers 35 and 36 were evaluated in the same manner as in Example 27. The results are also shown in Tables 17 and 18.

Generally, Developer 35 gave good quality of images but was accompanied with transfer dropout, fixation scattering and damage and much abrasion of the photosensitive member.

Developer-36 provided images at a low density and with fog. Further, on continuation of the image formation, transfer dropout became noticeable.

TABLE 17

| | | | | Melt- | | | Irregularity | | Photosensitive member | |
|---|---|---|---|---|---|---|---|---|---|---|
| Example | Developer | Image density | Fog | stick | Filming | Cleaning | Transfer | Charging | Damage | Abration (μm) |
| Ex. 27 | 23 | 1.36–1.39 | ◎ | none | none | good | none | none | ○ | 9 |
| 28 | 24 | 1.35–1.40 | ◎ | none | none | good | none | none | ○ | 10 |
| 29 | 25 | 1.39–1.41 | ◎ | none | none | good | none | none | ○ | 11 |
| 30 | 26 | 1.38–1.40 | ◎ | none | none | good | none | none | ○ | 10 |
| 31 | 27 | 1.35–1.39 | ◎ | none | none | good | none | none | ○ | 10 |
| 32 | 28 | 1.33–1.35 | ○ | none | none | good | none | none | ○ | 9 |
| Comp. Ex. 5 | 35 | 1.36–1.41 | ◎ | none | occurred | good | none | occurred | x | 22 |
| 6 | 36 | 1.19–1.28 | Δ | none | none | good | none | occurred | ○ | 13 |

TABLE 18

| | | Transfer dropout | | Fixation | | Surface state | |
|---|---|---|---|---|---|---|---|
| Example | Developer | Thick paper | OHP | scattering | Blocking | Charging roller | Transfer roller |
| Ex. 27 | 23 | ◎ | ◎ | ○ | ◎ | ◎ | ◎ |
| 28 | 24 | ◎ | ◎ | ○ | ◎ | ◎ | ◎ |
| 29 | 25 | ◎ | ◎ | ○ | ◎ | ◎ | ◎ |
| 30 | 26 | ◎ | ○ | ○ | ◎ | ◎ | ◎ |
| 31 | 27 | ◎ | ◎ | ○ | ◎ | ◎ | ◎ |
| 32 | 28 | ◎ | ○ | ○ | ◎ | ○ | ◎ |
| Comp. Ex. 5 | 35 | x | x | x | ◎ | x | Δ |
| 6 | 36 | ○ | Δ | ○ | ○ | Δ | ○ |

EXAMPLES 33–36

The testing apparatus used in Example 27 was further modified with respect to the developing bias voltage and transfer current so that it was applicable to reversal development. Developers 29–32 were evaluated by the thus modified apparatus. The results are shown in Tables 19 and 20.

TABLE 19

| Example | Developer | Image density | Fog | Melt-stick | Filming | Cleaning | Irregularity Transfer | Irregularity Charging | Photosensitive member Damage | Photosensitive member Abration (μm) |
|---|---|---|---|---|---|---|---|---|---|---|
| Ex. 33 | 29 | 1.40–1.41 | ◎ | none | none | good | none | none | ○ | 10 |
| 34 | 30 | 1.35–1.38 | ○ | none | none | good | none | none | ○ | 11 |
| 35 | 31 | 1.37–1.39 | ◎ | none | none | good | none | none | ○ | 9 |
| 36 | 32 | 1.38–1.40 | ◎ | none | none | good | none | none | ○ | 10 |

TABLE 20

| Example | Developer | Transfer dropout Thick paper | Transfer dropout OHP | Fixation scattering | Blocking | Surface state Charging roller | Surface state Transfer roller |
|---|---|---|---|---|---|---|---|
| Ex. 33 | 29 | ◎ | ◎ | ○ | ◎ | ◎ | ◎ |
| 34 | 30 | ◎ | ◎ | ○ | ◎ | ◎ | ◎ |
| 35 | 31 | ◎ | ◎ | ○ | ◎ | ◎ | ◎ |
| 36 | 32 | ◎ | ○ | ○ | ◎ | ○ | ◎ |

EXAMPLES 37 AND 38

A commercially available copying machine ("FC-330", mfd. by Canon K.K., equipped with contact charging means, contact transfer means, a urethane blade cleaner, an organic photosensitive member, a sponge applicator roller, and an elastic doctor blade with a silicone rubber tip; cartridge-type) was remodeled so that the contact transfer roller rotated at an identical speed as the photosensitive drum.

Developers 33 and 34 were subjected to a continuous copying test of 3,000 sheets and the performances thereof were evaluated in the same manner as in Example 27. The results are shown in Tables 21 and 22.

TABLE 21

| Example | Developer | Image density | Fog | Melt-stick | Filming | Cleaning | Irregularity Transfer | Irregularity Charging | Photosensitive member Damage | Photosensitive member Abration (μm) |
|---|---|---|---|---|---|---|---|---|---|---|
| Ex. 37 | 33 | 1.40–1.42 | ◎ | none | none | good | none | none | ○ | 10 |
| 38 | 34 | 1.38–1.41 | ◎ | none | none | good | none | none | ○ | 9 |

TABLE 22

| Example | Developer | Transfer dropout Thick paper | Transfer dropout OHP | Fixation scattering | Blocking | Surface state Charging roller | Surface state Transfer roller |
|---|---|---|---|---|---|---|---|
| Ex. 37 | 33 | ◎ | ◎ | ○ | ◎ | ◎ | ◎ |
| 38 | 34 | ◎ | ◎ | ○ | ◎ | ◎ | ◎ |

What is claimed is:

1. An image forming method, comprising:

charging an electrostatic image-bearing member by a charging means;

exposing to light the charged electrostatic image-bearing member to form an electrostatic image thereon;

developing the electrostatic image with a developer to form a toner image on the electrostatic image-bearing member, said developer comprising a mixture of toner particles and inorganic fine powder having a BET surface area of at least 20 $m^2/g$ treated with an organic agent; and transferring the toner image on the electrostatic image-bearing member to an intermediate transfer member or a transfer material by a transfer means;

wherein each of said toner particles comprises:

(i) 100 wt. parts of a binder resin having a glass transition point (Tg) of 50–70° C., (ii) 0.2–20 wt. parts of solid wax, and (iii) colorant particles carrying a liquid lubricant, or a magnetic powder carrying a liquid lubricant, or a mixture thereof;

the toner particle retaining the liquid lubricant at its surface; and wherein the liquid lubricant is an oil selected from the group consisting of fluorinated hydrocarbon, non-reactive silicone, dimethylsilicone, methylphenyl silicone and methylhydrogen silicone and the toner particles contain 0.2–5 wt. parts of the liquid lubricant per 100 wt. parts of the binder resin.

2. The image forming method according to claim 1, wherein said charging means is supplied with a bias voltage and is contactable with the electrostatic image-bearing member.

3. The image forming method according to claim 2, wherein said charging means comprises a charging roller, a charging blade or an electroconductive brush.

4. The image forming method according to claim 1, wherein said transfer means is supplied with a bias voltage and is a contact transfer means for contacting the electrostatic image bearing member.

5. The image forming method according to claim 4, wherein said transfer means comprises a transfer roller or a transfer belt.

6. The image forming method according to claim 1, wherein said electrostatic image-bearing member is surface-cleaned after transferring the toner image therefrom.

7. The image forming method according to claim 6, wherein said electrostatic image-bearing member is equipped with a cleaning blade combined with a magnetic brush, a fur brush or a cleaning roller.

8. The image forming method according to claim 1, wherein said colorant particles carrying a liquid lubricant are contained in the toner particles in an amount of 0.1–20 wt. parts per 100 wt. parts of the binder resin.

9. The image forming method according to claim 8, wherein said colorant particles comprise carbon black or an organic pigment.

10. The image forming method according to claim 8, wherein said colorant particles are contained in an amount of 0.2–10 wt. parts per 100 wt. parts of the binder resin.

11. The image forming method according to claim 1, wherein said magnetic powder carrying a liquid lubricant is contained in the toner particles in an amount of 10–200 wt. parts per 100 wt. parts of the binder resin.

12. The image forming method according to claim 11, wherein said magnetic powder is a silicon-containing magnetic powder.

13. The image forming method according to claim 11, wherein said magnetic powder is contained in an amount of 20–170 parts per 100 wt. parts of the binder resin.

14. The image forming method according to claim 13, wherein said magnetic powder is contained in an amount of 30–150 parts per 100 wt. parts of the binder resin.

15. The image forming method according to claim 1, wherein said solid wax has a heat absorption characteristic giving an onset temperature of at least 50° C. on its DSC curve.

16. The image forming method according to claim 15, wherein said solid wax provides a heat-absorption peak having a peak top temperature of at least 50° C. on its DSC curve.

17. The image forming method according to claim 16, wherein said solid wax provides a heat-absorption peak onset temperature of 50–120° C. on its DSC curve on temperature increase.

18. The image forming method according to claim 17, wherein said solid wax provides a heat-absorption peak onset temperature of 60–110° C. on its DSC curve on temperature increase.

19. The image forming method according to claim 17, wherein said solid wax provides a heat-absorption peak showing a terminal onset temperature of at least 80° C. on its DSC curve on temperature increase.

20. The image forming method according to claim 19, wherein said solid wax provides a heat-absorption peak showing a terminal onset temperature of 80–140° C. on its DSC curve on temperature increase.

21. The image forming method according to claim 16, wherein said solid wax provides a maximum heat-absorption peak having a peak top temperature of 70–130° C.

22. The image forming method according to claim 1, wherein said liquid lubricant has a viscosity at 25° C. of 10–200,000 cSt.

23. The image forming method according to claim 22, wherein said liquid lubricant has a viscosity at 25° C. of 20–50,000 cSt.

24. The image forming method according to claim 23, wherein said liquid lubricant has a viscosity at 25° C. of 50–20,000 cSt.

25. The image forming method according to claim 1, wherein said toner particles have been heat-treated.

26. The image forming method according to claim 1, wherein said magnetic powder comprises magnetic iron oxide particles.

27. The image forming method according to claim 26, wherein said magnetic iron oxide particles contain a compound selected from the group consisting of silicon oxide, aluminum oxide, magnesium oxide, silicon hydroxide, aluminum hydroxide and magnesium hydroxide at the surface or inside thereof.

28. The image forming method according to claim 26, wherein said magnetic iron oxide particles contain silicon at the surface or inside thereof.

29. The image forming method according to claim 28, wherein said magnetic iron oxide particles contain 0.1–3 wt. % of silicon based on the total weight of the magnetic iron oxide particles.

30. The image forming method according to claim 29, wherein said magnetic iron oxide particles contain 0.2–2 wt. % of silicon based on the total weight of the magnetic iron oxide particles.

31. The image forming method according to claim 30, wherein said magnetic iron oxide particles contain 0.25–1.0 wt. % of silicon based on the total weight of the magnetic iron oxide particles.

32. The image forming method according to claim 1, wherein said magnetic powder has a BET specific surface area, without any liquid lubricant, of 1–40 $m^2/g$.

33. The image forming method according to claim 32, wherein said magnetic powder has a BET specific surface area, without any liquid lubricant, of 2–30 $m^2/g$.

34. The image forming method according to claim 33, wherein said magnetic powder has a BET specific surface area, without any liquid lubricant, of 3–20 $m^2/g$.

35. The image forming method according to claim 1, wherein said magnetic powder, without any liquid lubricant and under a magnetic field of 10 kilo-oersted, has a saturation magnetization of 5–200 emu/g and a residual magnetization of 1–100 emu/g.

36. The image forming method according to claim 35, wherein said magnetic powder, without any liquid lubricant and under a magnetic field of 10 kilo-oersted, has a saturation magnetization of 10–150 emu/g and a residual magnetization of 1–70 emu/g.

37. The image forming method according to claim 1, wherein said magnetic powder carrying the liquid lubricant has an oil absorption capacity of at least 15 cc/100 g.

38. The image forming method according to claim 1, wherein said magnetic powder carrying the liquid lubricant has an oil absorption capacity of 18.5–30 cc/100 g.

39. The image forming method according to claim 1, wherein said magnetic powder without any liquid lubricant has a bulk density of at most 1.0 $g/cm^3$.

40. The image forming method according to claim 1, wherein said binder resin comprises a styrene copolymer, a polyester resin, or a mixture thereof.

41. The image forming method according to claim 40, wherein the toner comprises a polyester resin as the binder resin and contains a THF-soluble component giving a molecular weight distribution on a GPC chromatogram showing a main peak in a molecular weight region of $3\times10^3$–$1.5\times10^4$ and a ratio Mw/Mn between weight-average molecular weight and number-average molecular weight of at least 10.

42. The image forming method according to claim 1, wherein the toner contains a THF-soluble component giving a molecular weight distribution on a GPC chromatogram showing at least one peak ($P_1$) in a molecular weight region of $3\times10^3$–$5\times10^4$ and at least one peak ($P_2$) in a molecular weight region of at least $10^5$.

43. The image forming method according to claim 42, wherein the THF-soluble component has a molecular weight distribution on a GPC chromatogram showing at least one peak ($P_1$) in a molecular weight region of $3\times10^3$–$3\times10^4$ and at least one peak ($P_2$) in a molecular weight region of $3\times10^5$–$5\times10^6$.

44. The image forming method according to claim 43, wherein the THF-soluble component has a molecular weight distribution on a GPC chromatogram showing at least one peak ($P_1$) in a molecular weight region of $5\times10^3$–$2\times10^4$ and at least one peak ($P_2$) in a molecular weight region of $3\times10^5$–$2\times10^6$.

45. The image forming method according to claim 42, wherein the THF-soluble component has a molecular weight distribution on a GPC chromatogram containing at least 50% of component having a molecular weight of at most $10^5$.

46. The image forming method according to claim 1, wherein said solid wax is selected from the group consisting of paraffin, montan, Fischer-Tropsch, polyolefin and carnauba waxes.

47. The image forming method according to claim 1, wherein said solid wax is contained in an amount of 0.5–10 wt. parts per 100 wt. parts of the binder resin.

48. The image forming method according to claim 1, wherein said solid wax has a penetration of at most 4.0 and a density of at least 0.93.

49. The image forming method according to claim 1, wherein said solid wax has a number-average molecular (Mn) of 300–1500, a weight-average molecular weight (Mw) of 500–4500, and an Mw/Mn ratio of at most 3.0.

50. The image forming method according to claim 49, wherein said solid wax has an Mn of 350–1200, an Mw of 550–3600, and an Mw/Mn ratio of at most 2.5.

51. The image forming method according to claim 50, wherein said solid wax has an Mn of 400–1000, an Mw of 600–3000, and an Mw/Mn ratio of at most 2.0.

52. The image forming method according to claim 49, wherein said solid wax is selected from the group consisting of polyolefin wax, Fischer-Tropsch wax and long-chain alkyl alcohol wax having up to 100 carbon atoms.

53. The image forming method according to claim 1, wherein said solid wax has a carbon number distribution as measured by gas chromatography giving a largest peak at a carbon number of at least 30.

54. The image forming method according to claim 53, wherein said solid wax has a carbon number distribution as measured by gas chromatography giving a largest peak at a carbon number of at least 40.

55. The image forming method according to claim 53, wherein said solid wax has a carbon number distribution as measured by gas chromatography including a principal component composed of continuous carbon numbers.

56. The image forming method according to claim 1, wherein said toner particles contain a positive charge control agent.

57. The image forming method according to claim 1, wherein said toner particles contain a negative charge control agent.

58. An image forming method, comprising:

charging an electrostatic image-bearing member by a charging means;

exposing to light the charged electrostatic image-bearing member to form an electrostatic image thereon;

developing the electrostatic image with a developer to form a toner image on the electrostatic image-bearing member, said developer comprising a mixture of toner particles and an external additive;

transferring the toner image on the electrostatic image-bearing member to an intermediate transfer member or a transfer material by a transfer means;

wherein each of said toner particles comprises:

(i) 100 wt. parts of a binder resin having a glass transition point (Tg) of 50–70° C., wherein the binder resin is selected from the group consisting of (a) a binder resin comprising a styrene homopolymer or copolymer and containing a THF-soluble component providing a molecular weight distribution on a GPC chromatogram showing at least one peak ($P_1$) in a molecular weight region of $3\times10^3$–$5\times10^4$ and at least one peak ($P_2$) in a molecular weight region of at least $10^5$;

(b) a binder resin comprising a polyester resin and containing a THF-soluble component giving a molecular weight distribution on a GPC chromatogram showing a main peak in a molecular weight region of $3\times10^3$–$1.5\times10^4$ and a ratio Mw/Mn between weight average molecular weight and number average molecular weight of at least 10; and (c) mixtures of (a) and (b);

(ii) 0.2–20 wt. parts of solid wax;

(iii) colorant particles, magnetic powder or a mixture thereof, and (iv) lubricating particles carrying a liquid lubricant;

wherein the liquid lubricant is an oil selected from the group consisting of dimethylsilicone, methylphenylsilicone, methylhydrogen silicone, non-reactive silicones and fluorinated hydrocarbons, wherein the lubricating particles are used in a proportion of 1–3 wt. parts per. 100 wt. parts of the binder resin, and the toner particles retain the liquid lubricant at their surface.

59. The image forming method according to claim 58, wherein said charging means is supplied with a bias voltage and is contactable with the electrostatic image-bearing member.

60. The image forming method according to claim 59, wherein said charging means comprises a charging roller, a charging blade or an electroconductive brush.

61. The image forming method according to claim 58, wherein said transfer means is supplied with a bias voltage and is a contact transfer means for contacting the electrostatic image bearing member.

62. The image forming method according to claim 61, wherein said transfer means comprises a transfer roller or a transfer belt.

63. The image forming method according to claim 58, wherein said electrostatic image-bearing member is surface-cleaned after transferring the toner image therefrom.

64. The image forming method according to claim 63, wherein said electrostatic image-bearing member is equipped with a cleaning blade combined with a magnetic brush, a fur brush or a cleaning roller.

65. The image forming method according to claim 58, wherein said lubricating particles carry 10–90 wt. % of the liquid lubricant based on the lubricating particles.

66. The image forming method according to claim 58, wherein said toner particles comprise 0.1–20 wt. parts of colorant particles, 10–200 wt. parts of magnetic powder or a mixture thereof per 100 weight parts of the binder resin and wherein the lubricating particles carry 10–90 wt. % of the liquid lubricant based on the lubricating particles.

67. The image forming method according to claim 58, wherein said lubricating particles are inorganic compound particles carrying the liquid lubricant.

68. The image forming method according to claim 67, wherein said inorganic compound particles comprise particles of at least one member selected from the group consisting of $SiO_2$ $GeO_2$, $TiO_2$, $SnO_2$, $Al_2O_3$, $B_2O_5$, $P_2O_3$, silicates borates, phosphates, germanates, borosilicates, aluminosilicates, aluminoborates, aluminoborosilicates, tungstenates, molybdenates, tellurates, silicon carbide, silicon nitride and amorphous carbon.

69. The image forming method according to claim 68, wherein said inorganic compound particles comprise particles selected from the group consisting of $SiO_2$, $Al_2O_3$ and $TiO_2$.

70. The image forming method according to claim 67, wherein the inorganic compound particles have a particle size of 0.001–20 $\mu$m.

71. The image forming method according to claim 70, wherein the inorganic compound particles have a particle size of 0.005–10 $\mu$m.

72. The image forming method according to claim 67, wherein-the inorganic compound particles have a BET specific surface area of 5–500 $m^2/g$.

73. The image forming method according to claim 72, wherein the inorganic compound particles have a BET specific surface area of 10–400 $m^2/g$.

74. The image forming method according to claim 73, wherein the inorganic compound particles have a BET specific surface area of 20–350 $m^2/g$.

75. The image forming method according to claim 67, wherein said liquid lubricant constitutes 20–85 wt. % of the lubricating particles.

76. The image forming method according to claim 75, wherein said liquid lubricant constitutes 40–80 wt. % of the lubricating particles.

77. The image forming method according to claim 58, wherein said lubricating particles have a particle size of at least 0.5 $\mu$m.

78. The image forming method according to claim 77, wherein said lubricating particles have a particle size of at least 1 $\mu$m.

79. The image forming method according to claim 78, wherein said lubricating particles have a particle size of at least 3 $\mu$m.

80. The image forming method according to claim 58, wherein said lubricating particles are porous powder carrying the liquid lubricant.

81. The image forming method according to claim 80, wherein said porous powder has a BET specific surface area of 10–50 $m^2/g$.

82. The image forming method according to claim 58, wherein said external additive is inorganic fine powder treated with an organic agent, said fine powder comprising an inorganic compound selected from the group consisting of silica, alumina, titania, germanium oxide, zirconium oxide, silicon carbide, titanium carbide, silicon nitride and germanium nitride and said fine powder having a BET specific surface area of at least 20 $m^2/g$ prior to treatment with the organic agent.

83. The image forming method according to claim 82, wherein said organic agent comprises an organosilicone compound or a titanium coupling agent.

84. The image forming method according to claim 83, wherein said organosilicone compound comprises a nitrogen-containing silane coupling agent or silicone oil.

85. The image forming method according to claim 58, wherein said solid wax has a heat absorption characteristic giving an onset temperature of at least 50° C. on its DSC curve.

86. The image forming method according to claim 85, wherein said solid wax provides a heat-absorption peak having a peaktop temperature of at least 50° C. on its DSC curve.

87. The image forming method according to claim 86, wherein said solid wax provides a maximum heat-absorption peak having a peak top temperature of 70–130° C.

88. The image forming method according to claim 85, wherein said solid wax provides a heat-absorption peak onset temperature of 50–120° C. on its DSC curve on temperature increase.

89. The image forming method according to claim 88, wherein said solid wax provides a heat absorption peak onset temperature of 60–110° C. on its DSC curve on temperature increase.

90. The image forming method according to claim 88, wherein said solid wax provides a heat-absorption peak showing a terminal onset temperature of at least 60° C. on its DSC curve on temperature increase.

91. The image forming method according to claim 90, wherein said solid wax provides a heat-absorption peak showing a terminal onset temperature of 80–140° C. on its DSC curve on temperature increase.

92. The image forming method according to claim 58, wherein said liquid lubricant has a viscosity at 25° C. of 10–200,000 cSt.

93. The image forming method according to claim 92, wherein said liquid lubricant has a viscosity at 25° C. of 20–50,000 cSt.

94. The image forming method according to claim 93, wherein said liquid lubricant has a viscosity at 25° C. of 50–20,000 cSt.

95. The image forming method according to claim 58, wherein said magnetic powder is a silicon-containing magnetic powder.

96. The image forming method according to claim 58, wherein said toner particles have been heat treated.

97. The image forming method according to claim 58, wherein said magnetic powder comprises magnetic iron oxide particles.

98. The image forming method according to claim 97, wherein said magnetic iron oxide particles contain a compound selected from the group consisting of silicon oxide, aluminum oxide, magnesium oxide, silicon hydroxide, aluminum hydroxide and magnesium hydroxide at the surface or inside thereof.

99. The image forming method according to claim 97, wherein said magnetic iron oxide particles contain silicon at the surface or inside thereof.

100. The image forming method according to claim 99, wherein said magnetic iron oxide particles contain 0.1–3 wt. % of silicon based on the magnetic iron oxide particles.

101. The image forming method according to claim 100, wherein said magnetic iron oxide particles contain 0.2–2 wt. % of silicon based on the magnetic iron oxide particles.

102. The image forming method according to claim 101, wherein said magnetic iron oxide particles contain 0.25–1.0 wt. % of silicon based on the magnetic iron oxide particles.

103. The image forming method according to claim 58, wherein said magnetic powder has a BET specific surface area of 1–40 $m^2/g$.

104. The image forming method according to claim 103, wherein said magnetic powder has a BET specific surface area of 2–30 $m^2/g$.

105. The image forming method according to claim 104, wherein said magnetic powder has a BET specific surface area of 3–20 $m^2/g$.

106. The image forming method according to claim 58, wherein said magnetic powder has a saturation magnetization of 5–200 emu/g and a residual magnetization of 1–100 emu/g under magnetic field of 10 kilo-oersted.

107. The image forming method according to claim 58, wherein said magnetic powder has a saturation magnetization of 10–150 emu/g and a residual magnetization of 1–70 emu/g under a magnetic field of 10 kilo-oersted.

108. The image forming method according to claim 58, wherein said magnetic powder is contained in an amount of 20–170 parts per 100 wt. parts of the binder resin.

109. The image forming method according to claim 108, wherein said magnetic powder is contained in an amount of 30–150 parts per 100 wt. parts of the binder resin.

110. The image forming method according to claim 58, wherein said colorant particles are contained in an amount of 0.2–10 wt. parts per 100 wt. parts of the binder resin.

111. The image forming method according to claim 58, wherein said magnetic powder has a bulk density of at most 1.0 $g/cm^3$.

112. The image forming method according to claim 58, wherein the THF-soluble component of binder resin (a) has a molecular weight distribution on a GPC chromatogram showing at least one peak ($P_1$) in a molecular weight region of $3\times10^3$–$3\times10^4$ and at least one peak ($P_2$) in a molecular weight region of $3\times10^5$–$5\times10^6$.

113. The image forming method according to claim 112, wherein the binder resin (a) has THF-soluble component which has a molecular weight distribution on a GPC chromatogram showing at least one peak ($P_1$) in a molecular weight region of $5\times10^3$–$2\times10^4$ and at least one peak ($P_2$) in a molecular weight region of $3\times10^5$–$2\times10^6$.

114. The image forming method according to claim 58, wherein the THF-soluble component of binder resin (a) has a molecular weight distribution on a GPC chromatogram containing at least 50% of component having a molecular weight of at most $10^5$.

115. The image forming method according to claim 58, wherein said solid wax is selected from the group consisting of paraffin wax, montan wax, Fischer-Tropsch wax, polyolefin wax and carnauba wax.

116. The image forming method according to claim 58, wherein said solid wax is contained in an amount of 0.5–10 wt. parts per 100 wt. parts of the binder resin.

117. The image forming method according to claim 58, wherein said solid wax has a penetration of at most 4.0 and a density of at least 0.93.

118. The image forming method according to claim 58, wherein said solid wax has a number-average molecular (Mn) of 300–1500, a weight-average molecular weight (Mw) of 500–4500, and an Mw/Mn ratio of at most 3.0.

119. The image forming method according to claim 118, wherein said solid wax has an Mn of 350–1200, an Mw of 550–3600, and an Mw/Mn ratio of at most 2.5.

120. The image forming method according to claim 119, wherein said solid wax has an Mn of 400–1000, an Mw of 600–3000, and an Mw/Mn ratio of at most 2.0.

121. The image forming method according to claim 118, wherein said solid wax is selected from the group consisting of polyolefin wax, hydrocarbon wax, and long-chain alkyl alcohol wax having up to 100 carbon atoms.

122. The image forming method according to claim 58, wherein said solid wax has a carbon number distribution as measured by gas chromatography giving a largest peak at a carbon number of at least 30.

123. The image forming method according to claim 122, wherein said solid wax has a carbon number distribution as measured by gas chromatography giving a largest peak at a carbon number of at least 40.

124. The image forming method according to claim 122, wherein said solid wax has a carbon number distribution as measured by gas chromatography including a principal component composed of continuous carbon numbers.

125. The image forming method according to claim 58, wherein said toner particles contain a positive charge control agent.

126. The image forming method according to claim 58, wherein said toner particles contain a negative charge control agent.

127. The image forming method according to claim 58, wherein said external additive comprises inorganic fine powder having a BET surface area of at least 20 $m^2/g$ treated with nitrogen-containing organosilane compound and silicone oil.

* * * * *